US005517706A

United States Patent [19]

Kashima et al.

[11] Patent Number: 5,517,706

[45] Date of Patent: May 21, 1996

[54] SOFA-BED

[76] Inventors: Hiroshi Kashima, 23-3-410, Higashiserigaya; Osamu Kashima, 1-9-301, Namiki 2-chome, Kanagawa-ku, both of Yokohama-shi, Kanagawa, Japan

[21] Appl. No.: 108,627

[22] PCT Filed: Dec. 25, 1992

[86] PCT No.: PCT/JP92/01708

§ 371 Date: Dec. 9, 1993

§ 102(e) Date: Dec. 9, 1993

[87] PCT Pub. No.: WO93/12695

PCT Pub. Date: Jul. 8, 1993

[30] Foreign Application Priority Data

Dec. 31, 1991 [JP] Japan ..... 3-359985

[51] Int. Cl.[6] ..... A47C 17/04

[52] U.S. Cl. ..... 5/12.1; 5/52; 5/53.2; 5/59.1

[58] Field of Search ..... 5/12.1, 52, 53.1, 5/53.2, 59.1

[56] References Cited

U.S. PATENT DOCUMENTS

| | | | |
|---|---|---|---|
| 2,610,329 | 9/1952 | Strathaus | 5/59.1 |
| 2,645,788 | 7/1953 | Knoll et al. | 5/59.1 |
| 2,679,653 | 6/1954 | Blanke et al. | 5/59.1 X |
| 2,710,412 | 6/1955 | Bayer | 5/59.1 |
| 2,866,496 | 12/1958 | Glass | 5/52 X |
| 3,248,742 | 5/1966 | Johnson | 5/59.1 X |

FOREIGN PATENT DOCUMENTS

| | | | |
|---|---|---|---|
| 4729777 | 9/1977 | Japan . | |
| 61-32515 | 7/1985 | Japan . | |
| 62-87564 | 6/1987 | Japan . | |
| 5861062 | 4/1993 | Japan . | |
| 799315 | 8/1958 | United Kingdom | 5/52 |

*Primary Examiner*—Michael F. Trettel
*Attorney, Agent, or Firm*—Kanesaka & Takeuchi

[57] ABSTRACT

A sofa-bed is comfortable to use in a bed mode and its backrest can be put away in the position so as not to be an obstacle. A movable backrest of the sofa-bed 10 is divided into two movable half backrests 20,22 or a right movable half backrest and a left one, and the sofa-bed can be changed between the bed mode and the sofa mode by positioning movable half backrests 20.22 individually in first positions substantially above a head board 16 and a foot board 18 or in second positions appropriately parallel to an center line extending in longitudinal direction of the sofa bed.

17 Claims, 82 Drawing Sheets

SOFA-BED

FIELD OF THE INVENTION

This invention relates to a sofa-bed which can be changed between a bed-mode and a sofa-mode or used as a bed and a sofa.

DESCRIPTION OF THE PRIOR ART

Many types of sofa-bed have been sold.

In a typical sofa bed, its mattress is longitudinally divided into two half portions, and when the sofa bed is used as a sofa (sofa-mode), a back half portion of the mattress is raised to use as a backrest.

A well-known problem of said type of the sofa bed is so uncomfortable to sleep because when the users use it as the bed, the divided portion of the mattress causes a bump portion and it touches on the back of the users.

Further more although the softness (or the hardness) required for a sitting portion and the backrest portion are different in general, selection of the softness is impossible because said type of prior sofa bed needs same composing element to be used in both the sitting portion and the backrest.

Some sofa beds with a backrest only to use as a backrest are provided to resolve said problems (e.g. Japanese Utility Model Opening No.187654 of 1985, Japanese Utility Model Opening No.164010 of 1979 and Japanese Patent Opening No.109509 of 1990). In these sofa beds, their backrests are removed from their mattress portions to other portions when the backrests are not used.

The problems of these types of sofa bed are that their backrests are to be nuisances in not using them. The backrest of the sofa bed, for example, disclosed in Japanese Utility Model Opening No.187654 of 1985 is laid on the floor in front of the sofa bed when the sofa bed used as the bed, and so the backrest prevents the user from moving on the bed.

So the applicant disclosed the sofa-bed in Japanese Patent Opening No.359985 of 1992 which can be changed between a bed-mode and a sofa-mode or used both as a bed and a sofa. This sofa-bed has the excellent advantages that the sofa-bed is not only comfortable in using as a bed but also possible to locate its backrest on the position where the backrest is not to be an obstacle. But a mattress on a panel is partially covered with a part of each movable half backrest put away on both end boards in bed-mode, so the lying area is decreased by said covered portion and a large size mattress specially ordered is required to make up the decreased area.

Furthermore the applicant disclosed another sofa-bed in Japanese Patent Opening No.335647 of 1992 which can change its mode between a bed-mode and a sofa-mode. Also this sofa-bed has the excellent advantages that the sofa-bed is not only comfortable in using as a bed but also possible to locate its backrest on the position where the backrest is not to be an obstacle, but in using as a sofa there has been felt need for lying in relaxed posture like in couch.

Accordingly, it is an object of the present invention to provide a sofa-bed which is not only comfortable in using as a bed but also possible to locate its backrest on the position where the backrest is not to be an obstacle.

It is still more object of the present invention to provide a sofa-bed which uses its backrest usefully in a bed mode.

It is another object of the present invention to provide a sofa-bed which is able to have visual beauty obtained by using its backrest in a bed mode.

It is another object of the present invention to provide a sofa-bed which can easily change its mode between a bed mode and a sofa mode.

It is another object of the present invention to provide a sofa-bed which is changeable in its mode with ease between a bed mode and a sofa mode, and can be exactly adjusted in the angle of its backrest vertically or in the front and backward direction, and is protected from the break when excessive weight is loaded on the backrest.

It is another object of the present invention to provide a sofa-bed whose lying area is not decreased by put away the backrest when the backrest is not used and which keeps larger lying area.

It is another object of the present invention to provide a sofa-bed which is not only comfortable in using as a bed but also possible to locate its backrest on the position where the backrest is not to be an obstacle while the user can lie in relaxed posture.

DISCLOSURES OF THE INVENTION

The subject of the invention, in one point of view, to achieve above described objects consists in a sofa-bed (10) comprising a head board (16); a foot board (18) and a movable backrest, said movable backrest can be divided into two movable half backrests, a right movable half backrest (20) and a left movable half backrest (22), which are movable between a first position substantially above said each board (16,18) and a second position approximately parallel to a center line extending in a longitudinal direction of said sofa-bed (10), and in a bed mode said each movable half backrest (20,22) is put away in said first position and in a sofa mode said each movable half backrest (20,22) is supported in said second position.

Another subject of the invention in another point of view consists in a sofa-bed (10) comprising a head board (16) and a foot board (18), said each board (16,18) is divided into vertical two portions, an upper movable half board and a lower fixed half board, which are equipped with cushions (26), and said each movable half board is movable between a first position substantially above said fixed half board and a second position where it is used as a backrest in sofa mode, and said each movable half board is put away in said first position in bed mode and supported in said second position in sofa mode.

Another subject of the invention in another point of view consists in a sofa-bed (10) further comprising a movable mechanisms (28) which supports said movable half backrests (20,22) or said movable half boards on said head board (16) (or said foot board (18)) moveably between said first positions and said second positions, and said movable mechanisms (140) can adjust said movable half backrests (20,22) or said movable half boards supported in said second positions at least either in vertical direction or in the front and back direction and further includes a position controlling and break preventing mechanism which prevents the break of said sofa-bed by absorbing the load when excessive weight is loaded on said movable half backrests (20,22) or said movable half boards.

Another subject of the invention in another point of view consists in a sofa-bed (510,550,560,570) changeable between a bed mode and a sofa mode comprising a panel (14), a head board (16) and a foot board (18) mounted to both ends of said panel (14) and a movable backrest (520, 580), said movable backrest (520,580) can be divided into two movable half backrests (521,522;581,582), and said each movable half backrest (521,522;581,582) is movable between a first position where said movable half backrests are closely piled or arranged in a row along said head board (16) (or said foot board (18)) and a second position where said movable half backrests are located between said head board (16) side and foot board (18) side, and said movable half backrests (521,522;581,582) are held in said first position in a bed mode while held in said second position in a sofa mode.

Another subject of the invention in another point of view consists in a sofa-bed (510,550,560,570) wherein said each movable half backrest (521,522;581,582) is supported on said head board (16) (or said foot board (18) movable to said first position where said movable half backrests are closely piled or arranged in a row along said head board or said foot board and to an intermediate position where said closely piled or arranged movable half backrests are substantially parallel to a longitudinal center line of said panel (14) and to said second position where said movable half backrests are located between said head board (16) side and foot board (18) side.

Another subject of the invention in another point of view consists in a sofa-bed (510,550,560,570) further comprising a movable mechanism (140,240,260) which supports said each movable half backrest (521,522;581,582) on said head board (16) (or said foot board (18)) moveably between said first position and said second position keeping their closely piled or arranged state.

Another subject of the invention in another point of view consists in a sofa-bed (510,550,560,570) wherein said movable mechanism (140,240,260) can adjust one of said movable half backrest (521,581) which is directly supported by said movable mechanism at least either in vertical direction or in the front and back direction, and said movable mechanism (140,240,260) includes a position controlling and break preventing mechanism which prevents the break of said sofa-bed when excessive weight is loaded on said movable half backrests (521,581) by absorbing the load.

Another subject of the invention in another point of view consists in a sofa-bed (510,550,560,570) further comprising a coupling mechanism (540,560) for coupling said each movable half backrest (521,522;581,582) together so as to move one of them between said intermediate position and said second position 5.

Another subject of the invention in another point of view consists in a sofa-bed (510,550,560) wherein said coupling mechanism (540) comprises a hinge for coupling an end portion of one of said movable half backrests (521,522) to an end portion of the other so that said each movable half backrest (521,522) may be in closely piled or arranged state and in a straight lined state.

Another subject of the invention in another point of view consists in a sofa-bed (610,710) changeable between a bed mode and a sofa mode comprising a panel (14), a head board (16) and a foot board (18) mounted to both ends of said panel (14), a backrest (630) also serving as an armrest and a movable backrest (620), wherein said backrest (630) is mounted on said head board (16) (or said foot board (18)) and is divided into a fixed half body (632) and a movable half body (631) which is movable between a first position along said head board (16) (or said foot board (18)) and a second position appropriately parallel to a center line extending in a longitudinal direction of said panel (14), and said movable backrest (620) is movable between a first position along said foot board (18) (or said head board (16)) and a second position being close to said movable half body (631) of said backrest (630) located in said second position and extending with said movable half body to the longitudinal direction, and in said bed mode said movable half body (631) of said backrest (630) is held in said its first position and said movable backrest (620) is held in said its first position and, in said sofa mode, said movable half body (631) of said backrest (630) is held in said its second position and said movable backrest (620) is held in said its second position.

Another subject of the invention in another point of view consists in a sofa-bed (610,710) further comprising a movable mechanism (140,240) which supports said movable backrest (620) on said foot board (or said head board (16)) moveably between said first position and said second position.

Another subject of the invention in another point of view consists in a sofa-bed (610,710) wherein said a movable mechanism (140,240) can adjust said movable backrest (620) at least either in a vertical direction or in the front and back direction or in its longitudinal direction and further includes a position controlling and break preventing mechanism which prevents the break of said sofa-bed by absorbing the load when excessive weight is loaded on said movable backrest (620).

Another subject of the invention in another point of view consists in a sofa-bed (610,710) further comprising a coupling mechanism (650) for coupling, in said sofa mode, said movable half body (631) of said backrest (630) held in said second position to said movable backrest (620) held in said second position.

According to the sofa-bed (10) of the present invention, each movable half backrest (20,22) (or movable half board) is not to be an obstacle because they are individually put away on positions substantially above the head board (16) and foot board (18) in bed mode.

And also the sofa-bed has a practical use, for example, if the user reads a book sitting up in the sofa bed, he can lean on said movable half backrest (20,22). Furthermore in the case that cushions (26) are provided to the movable half backrest (20,22) (or the movable half board), a visual impression of the sofa-bed is improved or the sofa-bed impresses a man who looks the sofa-bed as a luxurious bed.

Moreover in the case that the sofa-bed is equipped with a movable mechanism (28) which supports said movable half backrest (20,22) or said movable half board on the head board (16) (or foot board (18)) moveably between a first position and a second position, the changing between bed mode and sofa mode can be done easily.

And in the case that the movable mechanism (28) is equipped with a position controlling and break preventing mechanism, the problem of the uneven accuracy of woodwork of the sofa-bed (10) after assembled can be resolved by adjusting the position of the movable half backrest (20,22) or the movable half board at least either in the vertical direction or the front and back, furthermore even if excessive weight is loaded on the movable half backrest (20,22) or the movable half board, the product is prevented from breaking by absorbing the excessive weight.

According to the sofa-bed (510,550,560,570) of this invention, in bed mode, since each movable half backrest (521,522;581,582) is put away in the position substantially above the head board (16) (or foot board (18)) and along it keeping the state that they are close to each other vertically or in the front and back, they are not to be obstacles. And the movable backrests (520) are located on only one end of the bed when the sofa-bed is not in use, therefore the dead space on the mattress (12) is decreased and larger lying space is gained.

And also the sofa-bed has a practical use, for example, if the user reads a book sitting up in the sofa bed, he can lean on said movable half backrest (521,522;581,582). Furthermore in the case that cushions (26) are provided to the movable half backrest (521,922;581,582), a visual impression of the sofa-bed is improved or the sofa-bed impresses a man who looks the sofa-bed as a luxurious bed.

Moreover in the case that the sofa-bed is equipped with a movable mechanism (140,240,260) which supports said movable half backrest (521,522;581,582) on the head board (16) (or foot board (18)) moveably between a first position and an intermediate position and equipped with a coupling mechanism (540,590) which couples one of the movable half backrest (521,522;621,622) to the other moveably between the intermediate position and a second position, the changing between bed mode and sofa mode can be done easily.

And in the case that the movable mechanism (140,240, 260) is equipped with a position controlling and break preventing mechanism, the problem of the uneven accuracy of woodwork of the sofa-bed (510,550,560,570) after assembled can be resolved by adjusting the position of the movable half backrest (521,522;581,582) at least either in the vertical direction or in the front and backward direction, furthermore even if excessive weight is loaded on the movable half backrest (521,522;581,582), the product is prevented from being broken by absorbing the excessive weight.

According to the sofa-bed (610,710) of this invention, in the bed mode, since the backrest (630) and the movable backrest (620) are respectively located in the position substantially above the head board (16) or foot board (18) and along it, they are not to be obstacles.

And also the sofa-bed has a practical use, for example, if the user reads a book sitting up in the sofa-bed in the bed mode, he can lean on the backrest (630) and/or the movable backrest (620). Furthermore in the case that cushions are provided to the backrest and the movable backrest (620), a visual impression of the sofa-bed is improved or the sofa-bed impresses a man who looks the sofa-bed as a luxurious bed.

If the user wants to change the mode of the sofa-bed (610,710) from the bed mode to the sofa, he needs to move the movable half body (631) of the backrest (630) from the first position along the head board (16) (or foot board (18)) to the second position approximately parallel to the center line extending to the longitudinal direction of the panel (14). And in the next step, the user may move said movable backrest (620) from the first position along the foot board (18) (or the head board (18)) to the second position approximately parallel to the center line extending to the longitudinal direction of the panel (14) where the backrest 620 (is) close to the movable half body (631) of the backrest (630) being in above mentioned second position and extends together to longitudinal direction.

In a such sofa mode, the user can sit comfortably on the sofa-bed (610,710) as lying in a couch, by using the fixed half body (632) of the backrest (630) along the head board (16) (or foot board (18)) as a backrest and using the movable half body (631) of the backrest (630) in the second position as an armrest.

On the other hand, the movable half body (631) of the backrest (630) and the movable backrest (620) respectively held in their second positions may be used as a backrest. Then in the case that the sofa-bed includes the coupling mechanism 650 for coupling together the movable backrest (620) and the movable half body (631) being in the second position and for supporting them, and the movable half body (631) and the movable backrest (620) are prevented from being warped to their back sides by the load of sitting user's weight.

Moreover in the case that the sofa-bed is equipped with a movable mechanism (140,240) which supports said movable backrest (620) on the foot board (18) (or head board (16)) moveably between a first position and a second position, the changing between bed mode and sofa mode can be done easily.

And in the case that the movable mechanism (140,240) is equipped with a position controlling and break preventing mechanism, the problem of the uneven accuracy of woodwork of the sofa-bed (610,710) after assembled can be resolved by adjusting the position of the movable backrest (620) at least one direction among in the vertical direction, in the front and back and in the right and left, furthermore even if excessive weight is loaded on the movable backrest (620), the product is prevented from being broken by absorbing the excessive weight.

BRIEF DESCRIPTION OF THE DRAWINGS

FIG. 27 is an enlarged perspective view illustrating the movable mechanism of the fourth embodiment.

FIG. 31 is a perspective view showing a movable mechanism of the fifth embodiment of the sofa-bed of the present invention seeing from the rear side of the sofa-bed in a sofa mode, a part of the movable half backrest being broken away for clearness.

FIG. 61 is an exploded view in perspective of a movable mechanism of the eleventh embodiment of this invention.

FIG. 64 is a plan view showing a movable half backrest of a twelfth embodiment of this invention moving from the first position to the second.

FIG. 71 is a perspective view illustrating a state of a movable half backrest of the fifteenth embodiment substantially being side position of the first position.

FIG. 79 is an enlarged plan view illustrating the pivotal mechanism of the sixteenth embodiment.

FIG. 80 is a fragmentary view taken in direction of the arrow VIII of FIG. 79.

BEST MODE OF CARRYING OUT THE INVENTION

Figure 1:
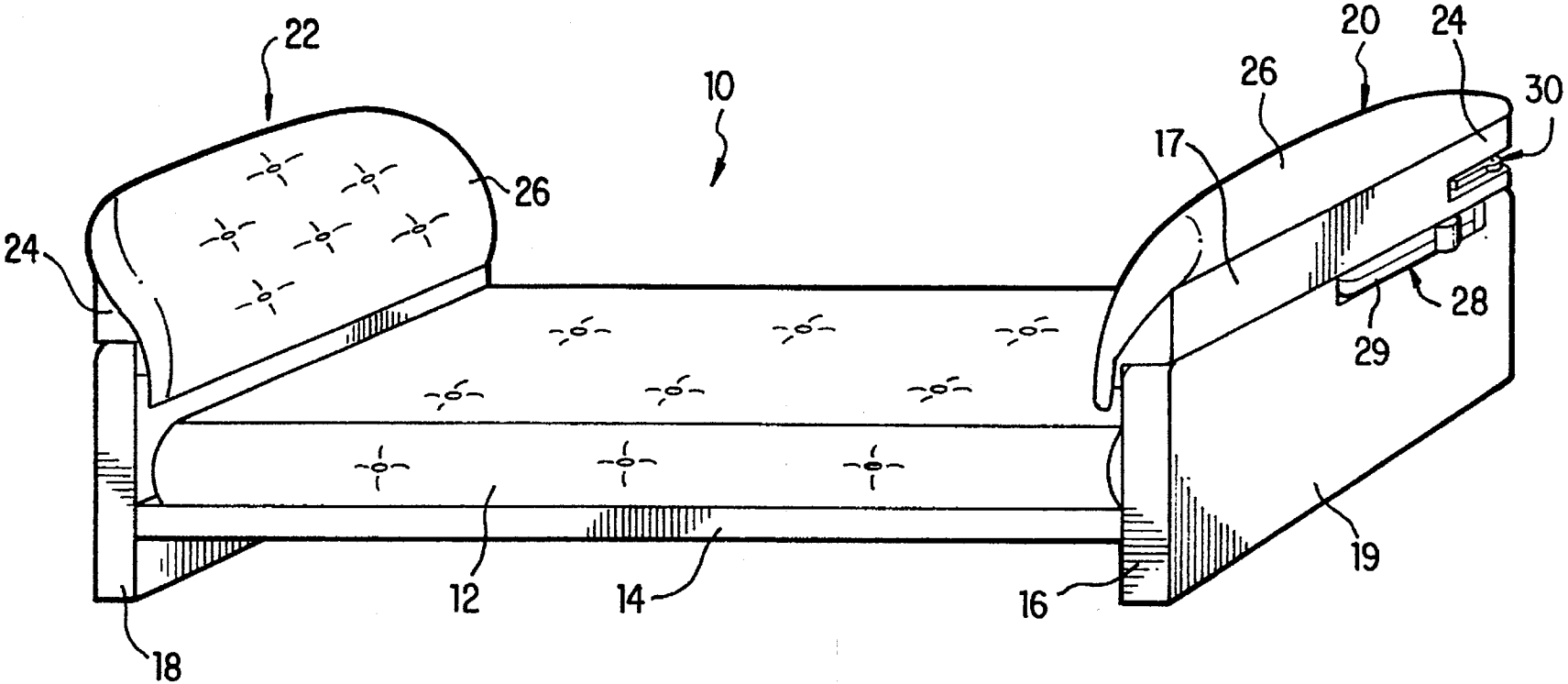
FIG. 1 is a perspective view illustrating a state using the sofa-bed of the first embodiment of this invention as a bed.

The various embodiments of the present invention are shown in the drawings.

Figure 2:
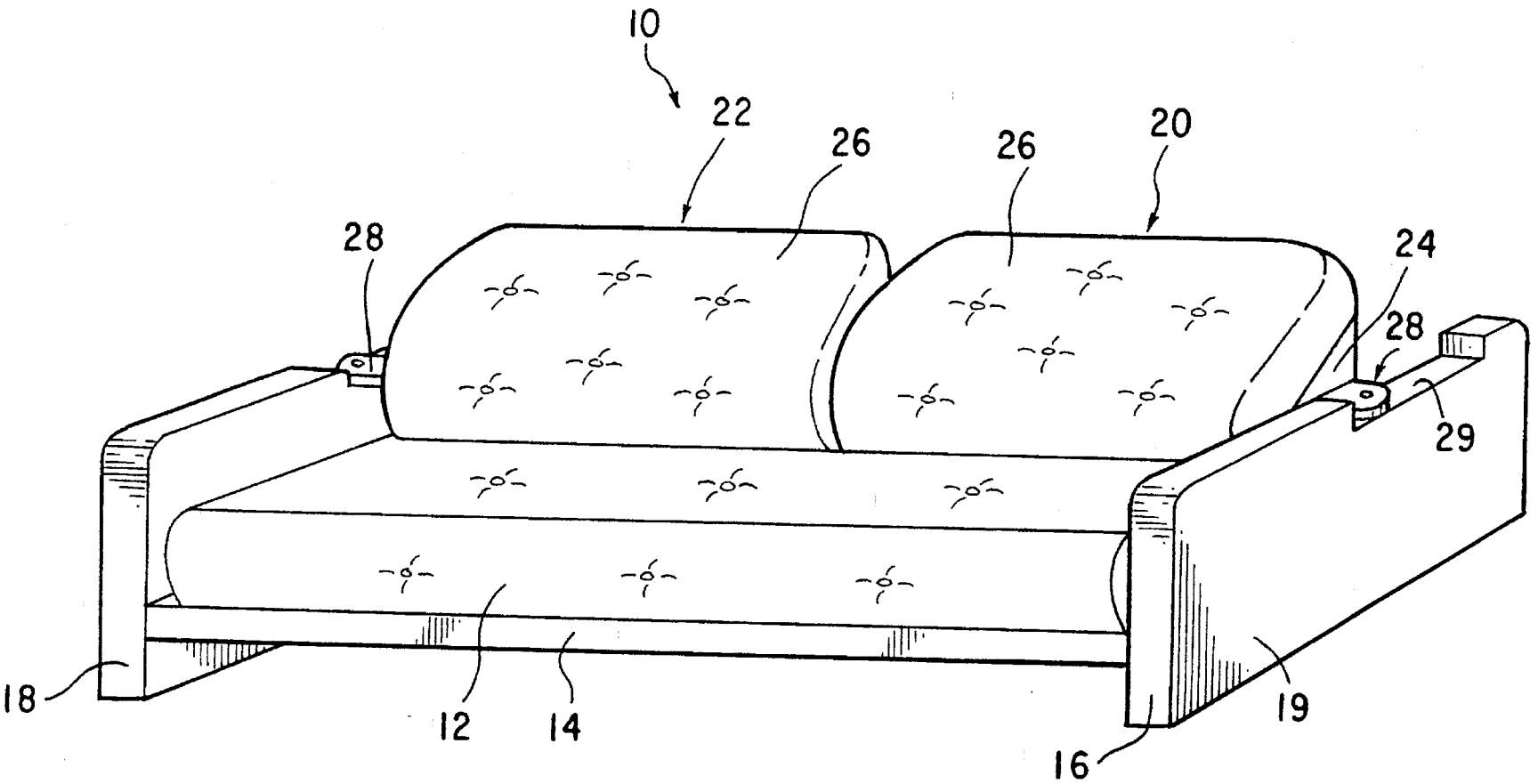
FIG. 2 is a perspective view illustrating a state using the sofa-bed of the first embodiment of this invention as a sofa.

FIG. 1 is a perspective view illustrating a state of a sofa-bed 10 of the first embodiment of the invention as it is used in a bed mode, and FIG. 2 shows a state in a sofa mode.

The sofa-bed 10 of the first embodiment can be easily used as a sofa only by setting movable half backrests 20,22 of a movable backrest, put away on a head side and a foot side (a first position) in a bed mode, in a position of a sofa mode (a second position).

The basic structure of the sofa-bed 10 of the embodiment includes a panel 14 for supporting a mattress on it and a head board 16, also serving as an armrest, and a foot board 18, also serving as an armrest, supporting both end portions of panel 14 in longitudinal direction (if the head of a user is in the foot board 18 side, the foot board serves as the head board.).

Furthermore the sofa-bed 10 comprises two movable half backrests 20,22 being put away on the head board 16 and the foot board 18 such that the outer surface 17 of the movable half backrest and the outer surface 19 of the head board 16 are in the same plan in a bed mode (see FIG. 1), and in a sofa mode (see FIG. 2) they are moved to the positions where they serve as backrests.

These movable half backrest 20,22 are equipped with the bases 24 appropriately inclined for using as a backrest, and cushion portion 26 comprised of an outer cover, cushion, etc. are adhere to the backrest portion of the base 24. The base 24 may be formed by an upper movable half board which is a divided upper part of the head board 16 or foot board 18.

Movable half backrests 20,22 are coupled to a movable means, movable mechanism 28, etc. as hereinafter described, and are coupled to the head board 16 or the foot board 18 via the movable mechanism 28 removably. Rear sides of said two movable half backrests are equipped with a coupling mechanism 30 (Refer to FIGS. 6, 7, 8 and 9 hereinafter) for coupling said two movable half backrests 20,22 to withstand the weight of the user in a sofa mode.

Thus in the sofa-bed of the present embodiment, the two movable half backrests 20,22 used as the backrests in a sofa mode are respectively coupled to the head board 16 and the foot board 18 via the movable mechanism 28, and in a bed mode said two movable half backrests 20 and 22 are respectively put away on the head board 16 and foot board 18 such that outer surface of the movable half backrest 20 and the outer surface of the head board 16 (or foot board 18) are in a plane; therefore the user need not put away the backrests into a space under the panel of bed or behind a mattress, and so the sofa-bed looks nice and in the sofa mode the movable half backrests 20,22 may be used as a backrest.

A sofa-bed of prior art with its mattress divided into a seat portion and a backrest is uncomfortable to sleep in bed mode because of the divided mattress, but in this embodiment the sofa-bed 10 of this embodiment is not uncomfortable unlike the prior art because the backrest and the mattress are different parts.

The movable mechanism 28 coupled to the movable half backrests 20,22 and its operation will be described with reference to FIGS. 3–6.

Figure 3:
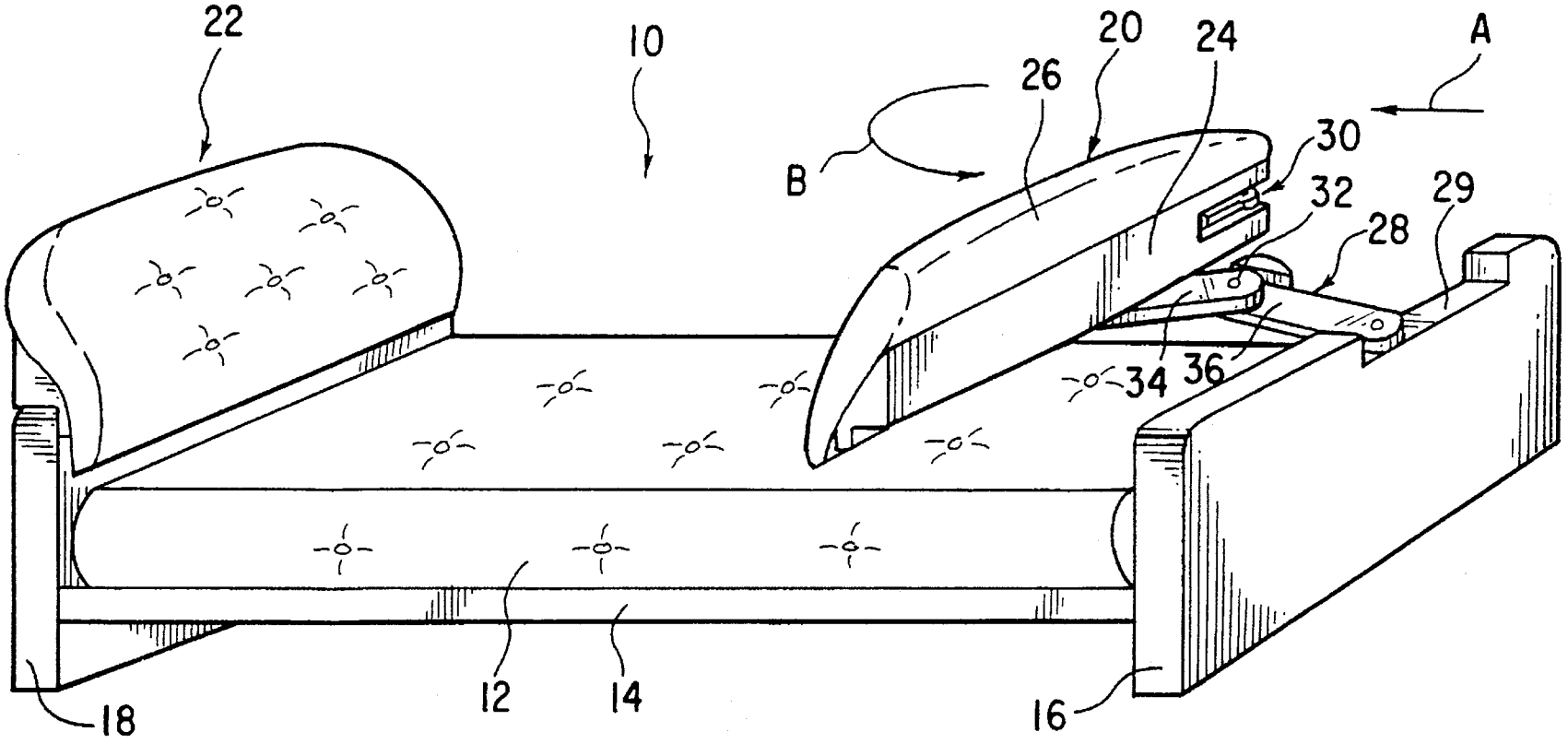
FIG. 3 is a operational diagram illustrating a movable half backrest of the first embodiment in an intermediate state between a bed mode and a sofa mode.
Figure 4:
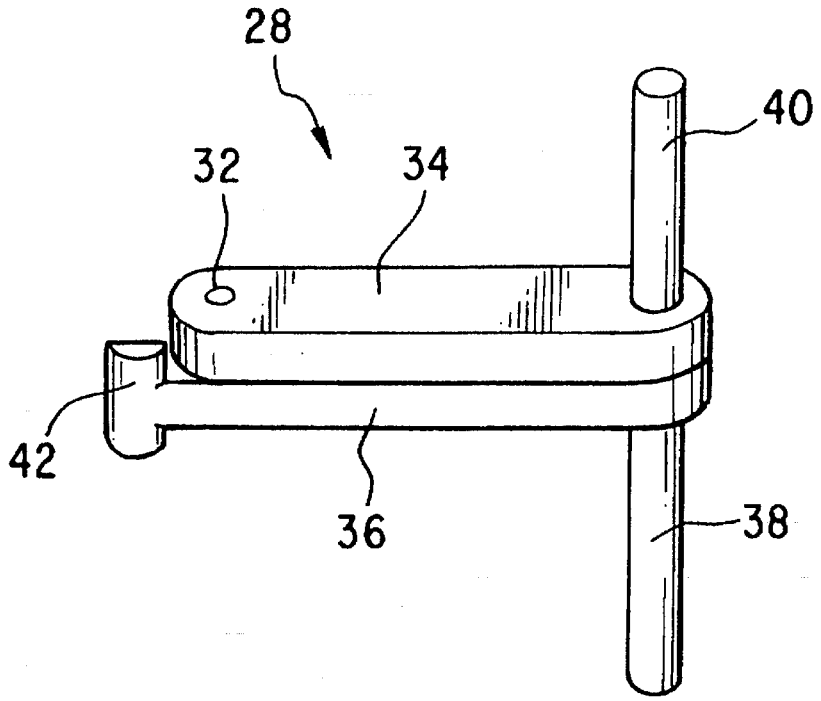
FIG. 4 is a perspective view illustrating the movement of a mechanism attached to the movable half backrest of the first embodiment, seeing from the rear side of the backrest in a sofa mode.
Figure 5:
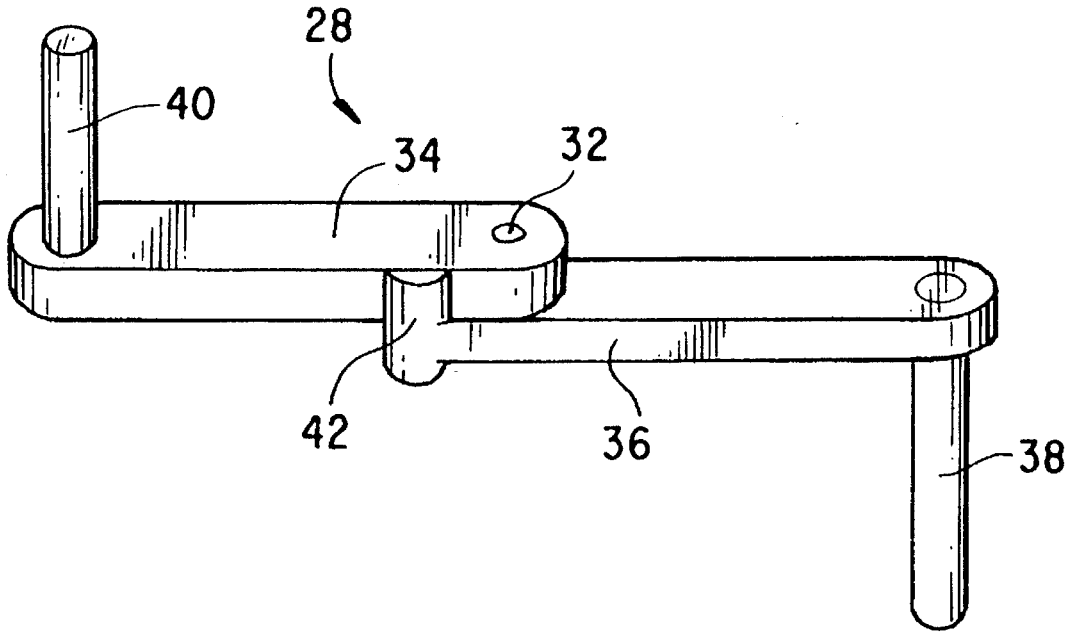
FIG. 5 is a perspective view illustrating the movement of the mechanism attached to the movable half backrest of the first embodiment, seeing from the rear side of the backrest in a sofa mode.
Figure 6:
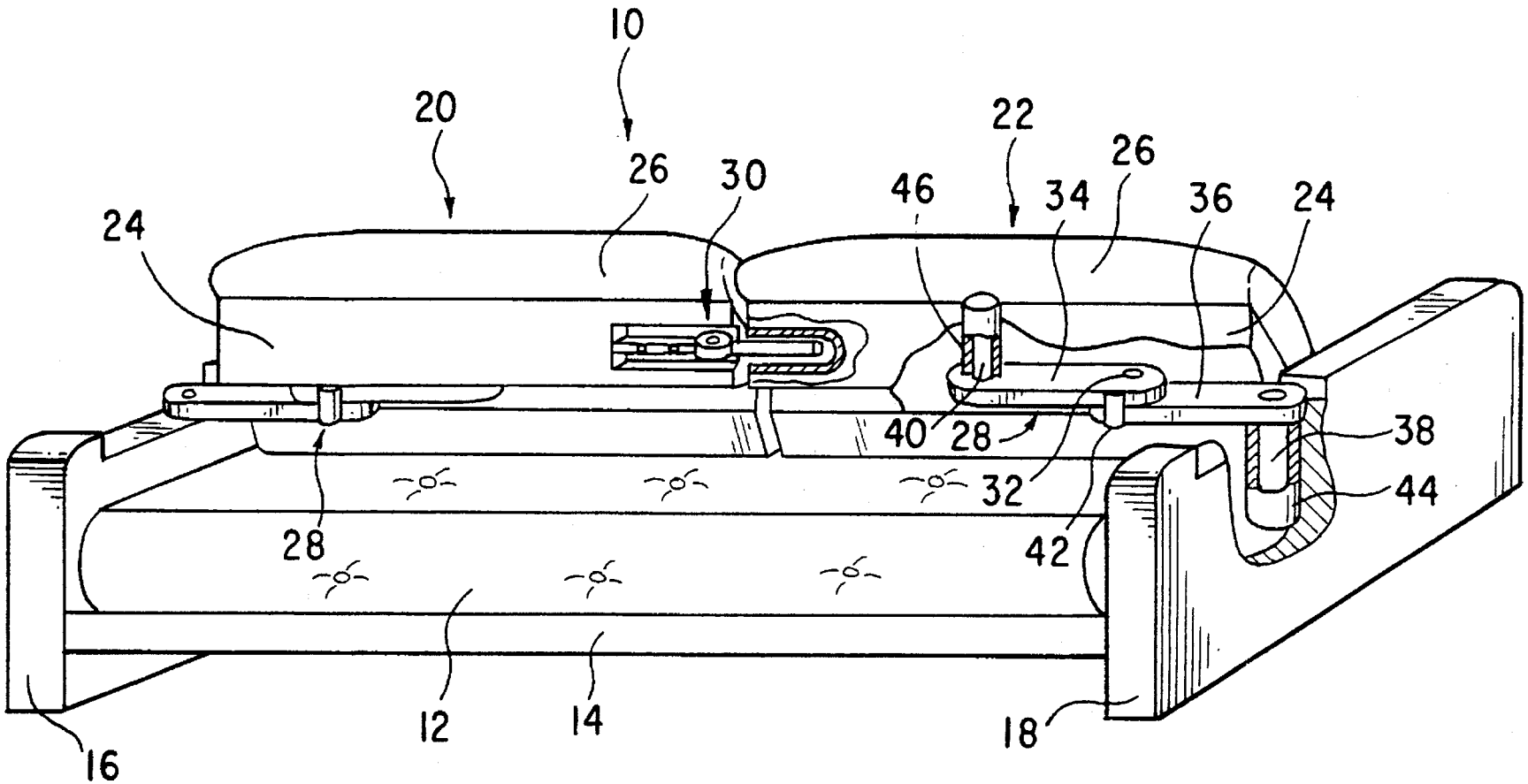
FIG. 6 is a partially cutaway perspective view illustrating the first embodiment of the sofa-bed of the present invention, seeing from the rear side of the sofa-bed in a sofa mode.

FIG. 3 is a operational diagram illustrating a movable half backrest 20 in an intermediate state between a bed mode and a sofa mode, FIGS. 4 and 5 are perspective views illustrating the movement of the movable mechanism 28 attached to the movable backrest, seeing from the rear side of the backrest in a sofa mode and FIG. 6 is a partially cutaway perspective view illustrating the sofa-bed 10, seeing from its rear side in a sofa mode.

As shown in FIGS. 4 and 5 the movable mechanism 28 comprises two metal arms 34,36 coupled together through a pivot 32 so as to be pivotable in two parallel planes and two shafts 38,40 respectively mounted approximately perpendicular to the end side portions of said two arms 34,36. Said arm 36 is formed with a stopper 42 to stop the arm 34 at the fixed position. As shown in FIG. 5, the stopper 42 of the arm 36 prevents the arm 34 from turning more than a prescribed angle.

A shaft 38 is supported pivotably with bearing 44 formed at the position slightly back from the center of the foot board 18 (see FIG. 6), while shaft 40 is pivotably inserted in a bearing 46 formed in the base 24 (see FIG. 6).

In order to move the movable half backrest 20 from the put away position on the head board 16 in a bed mode to the position in a sofa mode, as shown in the intermediate state in FIG. 3, the user need only to push the movable half backrest 20 in the direction indicated by an arrow A and turn it in the direction indicated by an arrow B until the two arms 34 and 36 are approximately straight.

Thus in the sofa-bed of this embodiment, the movable half backrest 20 and one arm 54 of movable mechanism 28 are pivotably coupled together, and furthermore the arm 34 and the other arm 36 pivotably coupled with the head board 16 (or foot board 18) are coupled together through the pivot 32 so as to be pivotable in two parallel plan and therefore the user can easily change the sofa-bed from a bed mode to a sofa mode (or reverse) only by moving said movable half backrest 20 by hands.

Since the arm 34 is stopped at the prescribed position with the stopper 42 formed in the other arm 36, the movable half backrest 20 could be set in the prescribed position. In a bed mode the movable mechanism 28 is not to be a nuisance and unsightly because it is put away in the cut away portion formed in the head board 16 (and the foot board 18), while in a sofa mode said movable mechanism 28 is not also to be a nuisance and unsightly similar to the case in a bed mode because it is put away behind the backrest, and it supports the movable half backrest 20 and the weight of a sitting user.

Figure 7:
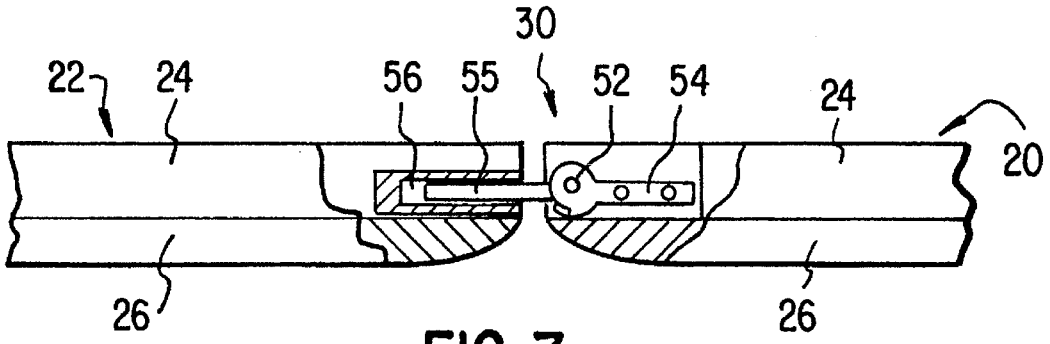
FIG. 7 is a partially cutaway horizontal sectional view illustrating a final state of coupled two movable half backrests of the first embodiment in a sofa mode.
Figure 8:
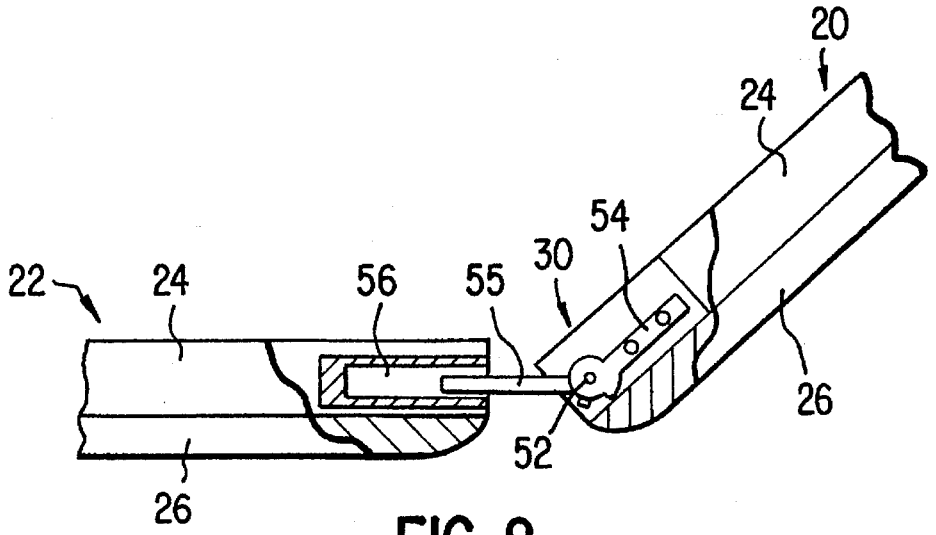
FIG. 8 is a partially cutaway horizontal sectional view illustrating an intermediate state of coupled two movable half backrests of the first embodiment in a sofa mode.
Figure 9:
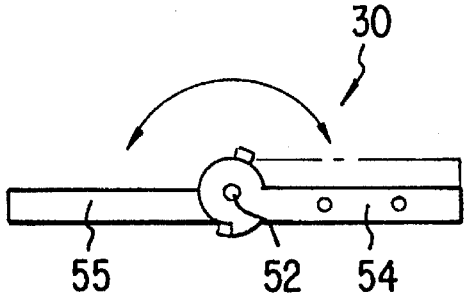
FIG. 9 is a horizontal sectional view illustrating a coupling mechanism for coupling two movable half backrests of the first embodiment in a sofa mode.

The coupling mechanism 30 for coupling the movable half backrests 20,22 together in a sofa mode will be described with reference to FIGS. 7–9.

Said coupling mechanism 30 couples two movable half backrests 20,22 together and prevents said half backrests 20,22 from being deformed by the weight of the sitting user. Two arms 54,55, which can be folded freely at a central pivot 52, are put away in one of the movable half backrests (In this embodiment,it is movable half backrest 20.)(see FIG. 9). To couple two movable half backrests 20,22 an arm 55 put away in one movable half backrest 20 is inserted into a coupling hole 56, formed in the other movable half backrest 22, at an angle formed between said two movable half backrests 20 and 22 (see FIG. 7 and FIG. 8).

Thus in a bed mode, two movable half backrests 20,22 of the sofa-bed of this embodiment are coupled securely with each other so that said movable half backrests 20,22 are prevented from being deformed by the weight of a sitting user and so on.

Referring to FIGS. 10–16, there is shown a second embodiment of a sofa-bed 68 of the present invention.

Both in a bed mode and a sofa mode, although an outward appearance of the second embodiment of the sofa-bed is almost similar to the one of the first embodiment (see FIG. 1 and FIG. 2), the characteristic of this embodiment of the sofa-bed 68 is of the electric sofa-bed being able to change easily from a bed mode to a sofa mode (or in reverse) only by operating a switches 75 positioned on a head board and foot board. To make such an electric sofa-bed 68, a part of electric apparatus 60 with D C motor, ect. is put in a head board 72 and a foot board 73 of the sofa-bed 68 of the embodiment, but a large-scale apparatus is not employed.

Figure 10:
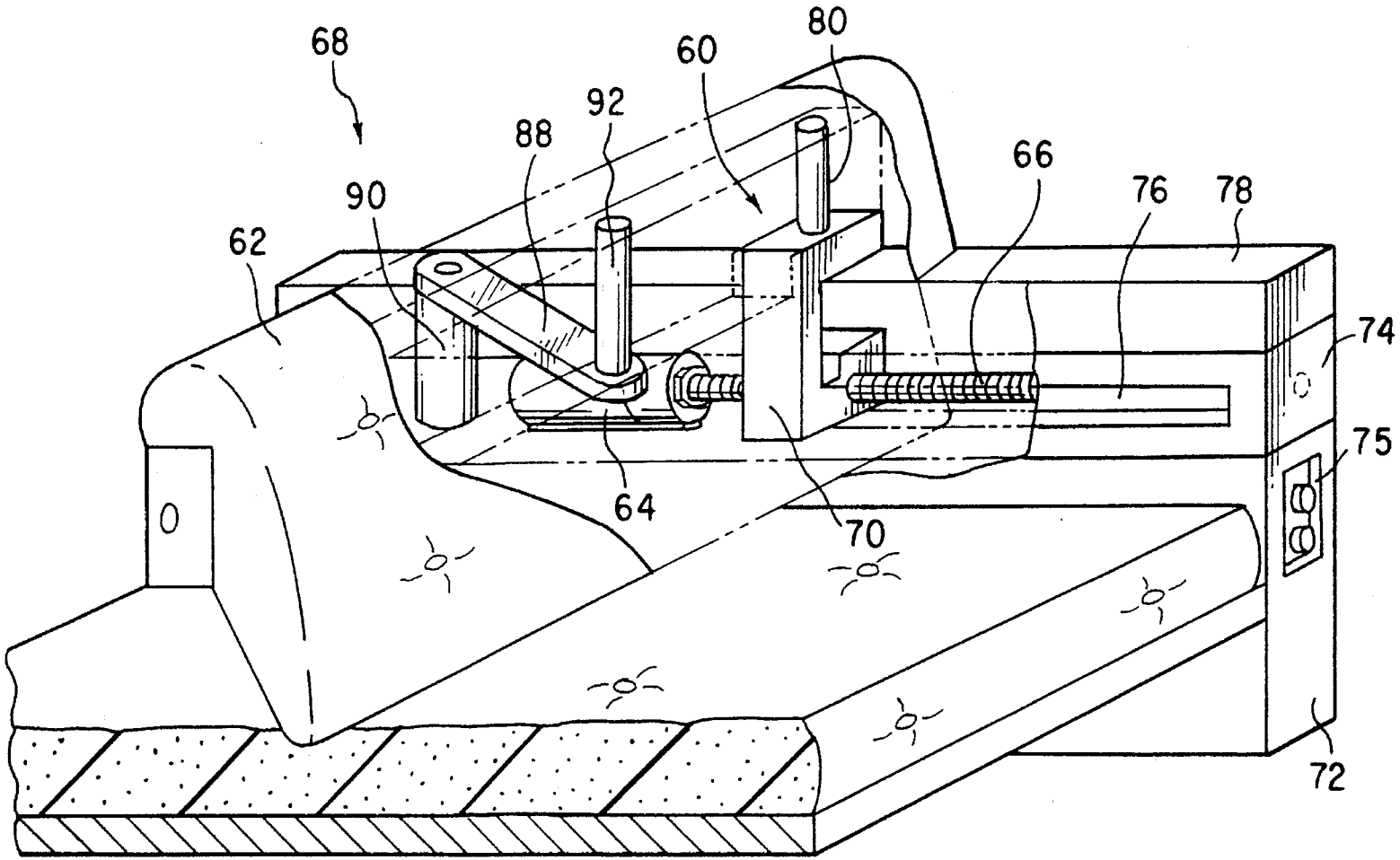
FIG. 10 is a perspective view showing a schematic electric apparatus, having a D C motor etc., of the second embodiment of the sofa-bed of the present invention seeing from the front side of the sofa-bed in a sofa mode, a part of the movable backrest and head board being broken away for clearness.
Figure 11:
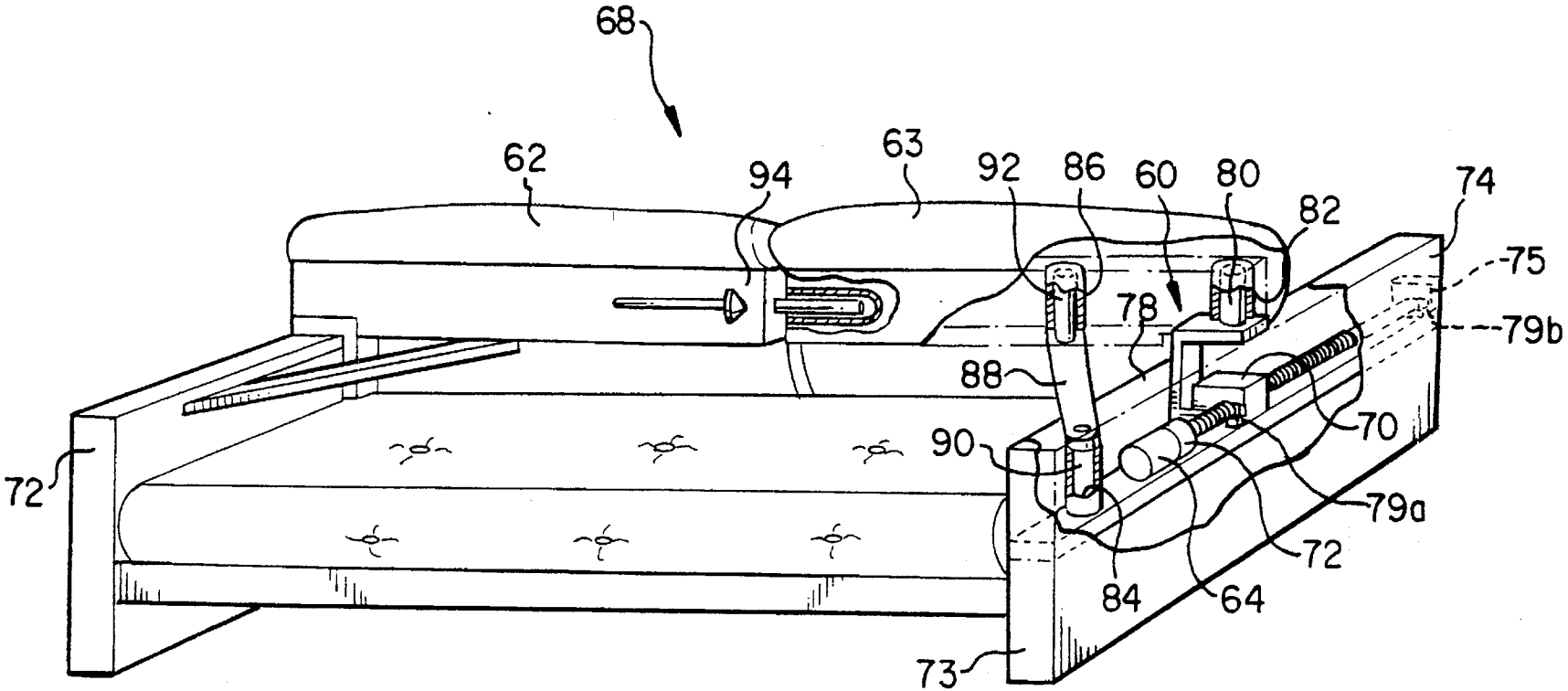
FIG. 11 is a partially cutaway perspective view, similar to FIG. 10, illustrating the sofa-bed of the second embodiment seeing from the rear side of the sofa-bed in a sofa mode.
Figure 12:
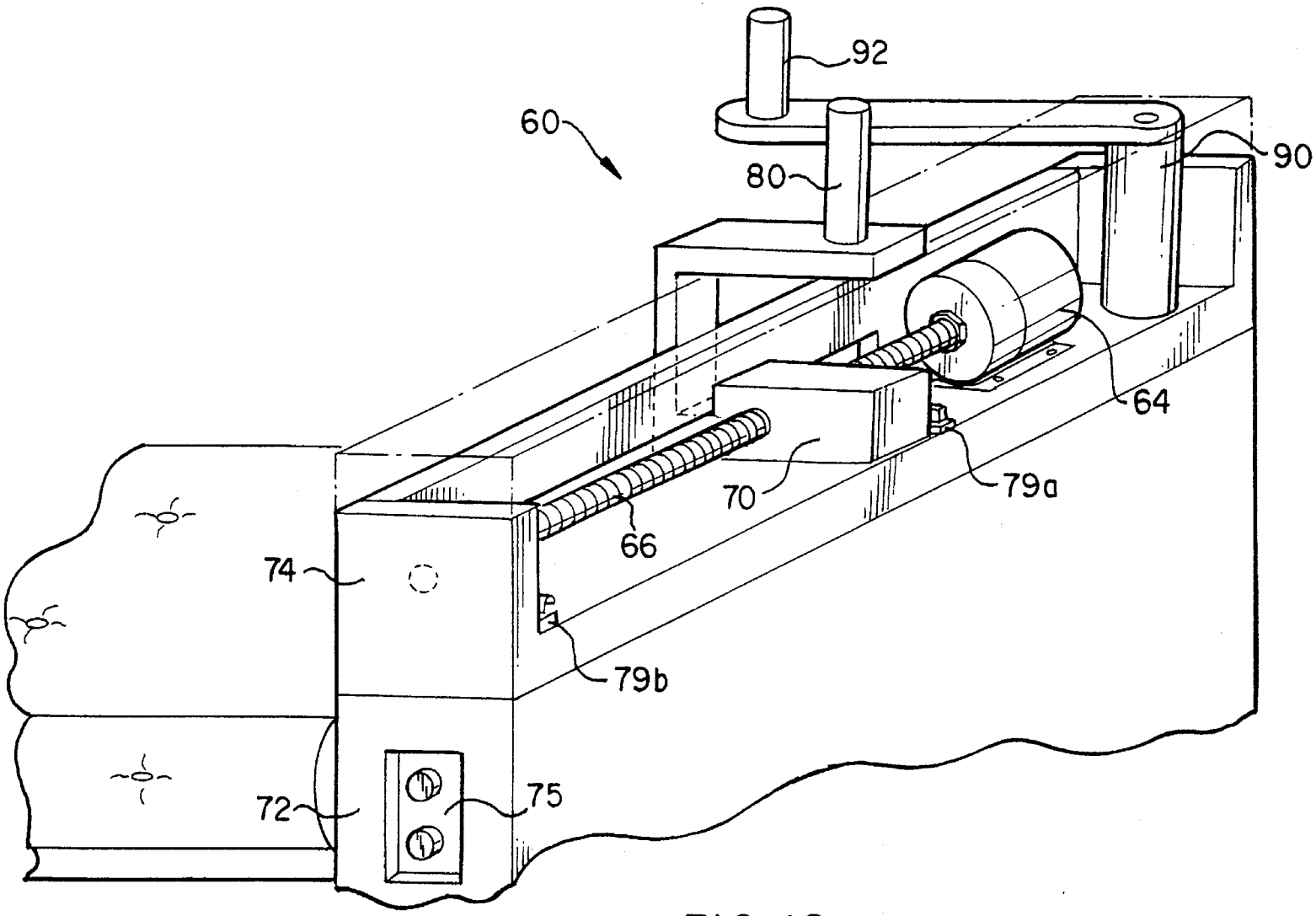
FIG. 12 is a perspective view of details of electric apparatus employed in the sofa-bed of the second embodiment.
Figure 13:
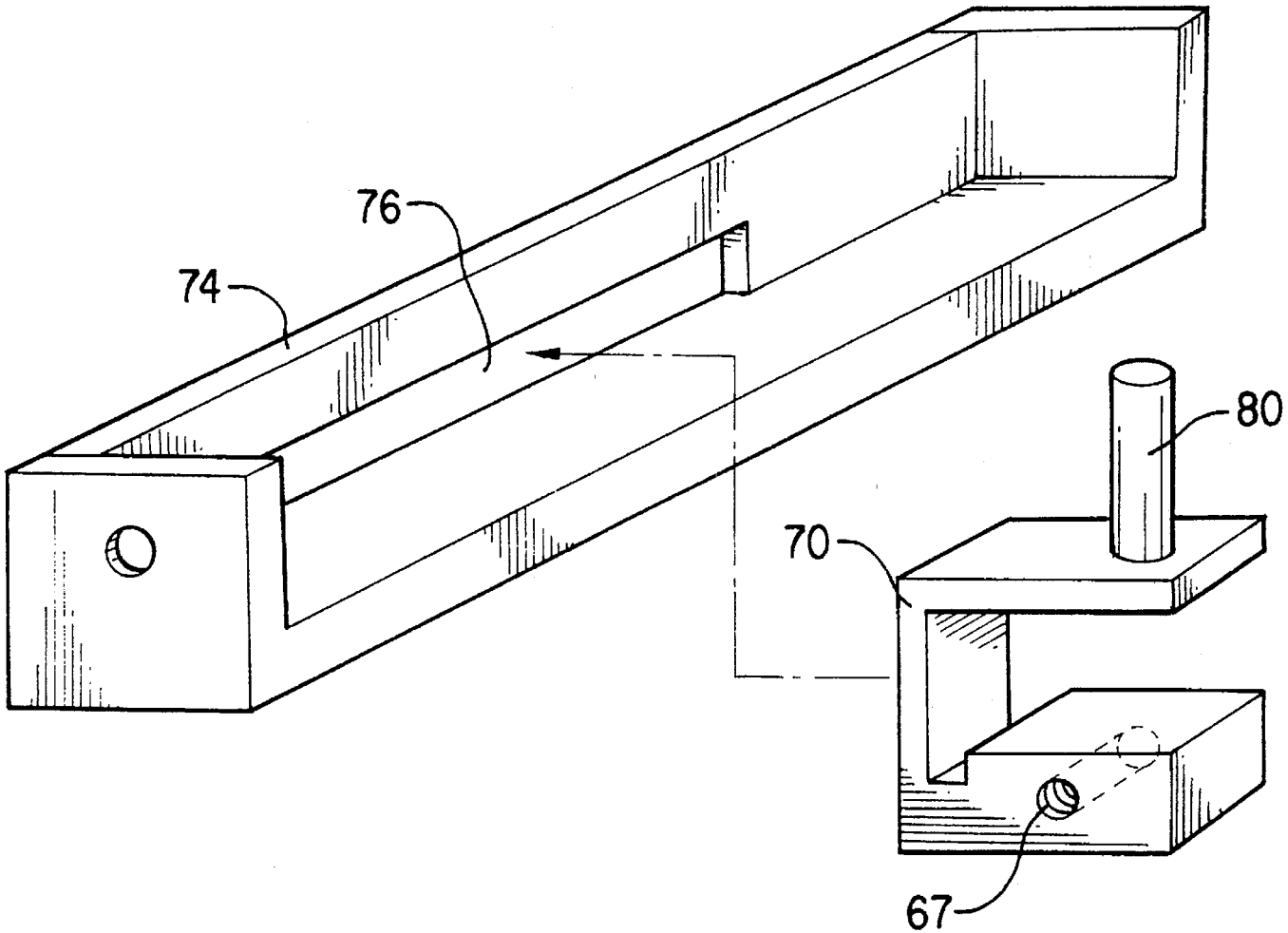
FIG. 13 is a perspective view illustrating the base of the second embodiment, the base with a built-in DC motor, etc.

FIG. 10 is a perspective view which shows a schematic electric apparatus 60, having a D C motor, etc. of the second embodiment of the sofa-bed of the present invention seeing from the front side of the sofa-bed in a sofa mode, a part of the movable backrest and head board 72 being broken away for clearness. FIG. 11 is a partially cut away perspective view, similar to FIG. 10, seeing from the rear side of the sofa-bed in a sofa mode. FIG. 12 is a perspective view of details of electric apparatus 60. FIG. 10, however, illustrates the case that a foot board 73 is cut away and FIG. 11 illustrates the case that a head board 72 is cut away, and for the same member of two pairs of the electric apparatus 60,60 the same number is used.

The electric apparatus 60 is equipped with a D C motor 64 generating the power for moving a movable half backrest 62 (and movable half backrest 63), a lead screw 66 connected to a reduction gear (not shown) built in said D C motor 64 and a slide block 70 having inner screw 67 engaged with said lead screw 67 for sliding from one side to the other side of the sofa-bed by the revolution of said lead screw 66, said D C motor 64 and lead screw 66 are placed in a base 74 built in head board 72 (and foot board 73). Said D C motor 64 is connected to a control circuit and a power supply circuit and it can be revolved in reverse direction with the operation of said switch 75.

The slide block 70, having a concave vertical cross section as shown in FIG. 10, etc., is inserted into the guide slot 76 formed in the base 74 (see FIG. 13) and an inner surface of its upper portion is slidable on an armrest surface 78. The sliding amount of said slide block is controlled by operating two limit switches 79*a*,79*b*. A shaft 80 is mounted on an outer surface of the upper portion of said slide block 70. Said shaft 80 is inserted into a bearing 82 formed in the end portion of the movable half backrest 63 and supports said movable half backrest 63.

Figure 15:
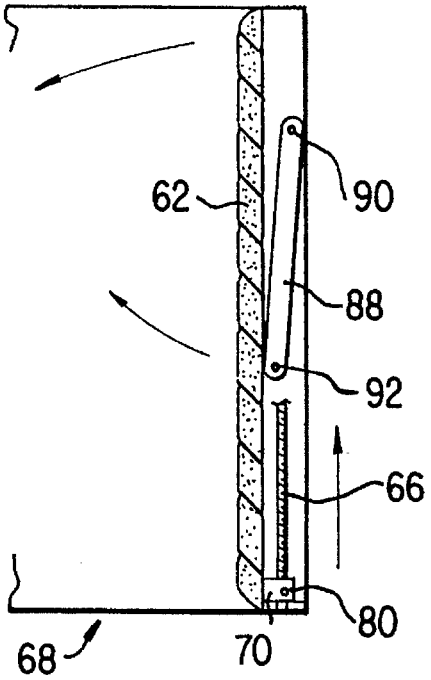
FIG. 15 is a horizontal sectional view illustrating a position of the movable half backrest of the second embodiment in a bed mode.
Figure 16:
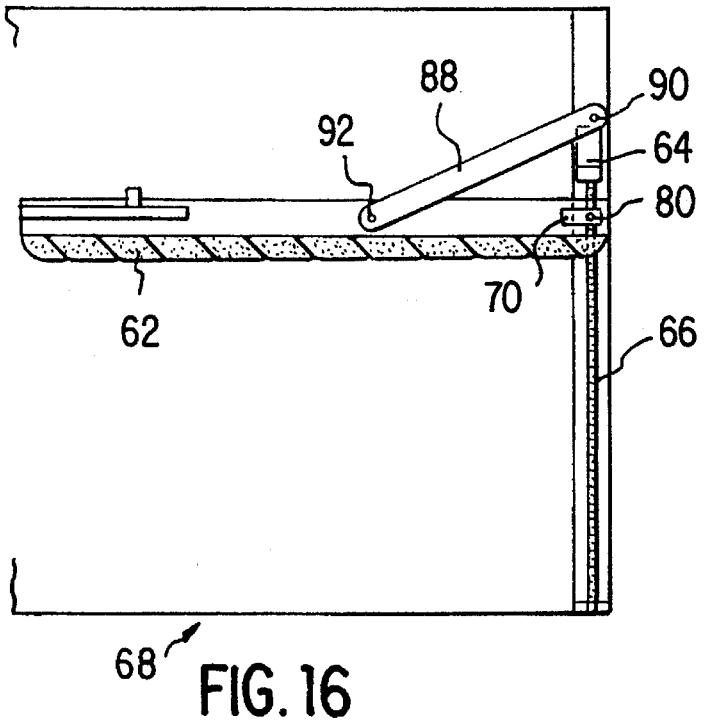
FIG. 16 is a horizontal sectional view illustrating a position of the movable half backrest of the second embodiment in a sofa mode.

Bearings 84,86 are formed in a back side end of the base 74 and a central portion of the movable half backrest 63 respectively formed, and shafts 90,92 attached on an arm 88 are respectively inserted into said two bearings 84,86 pivotably and supports the central portion of said movable half backrest 53. This arm 88 moves from the position in bed mode as shown in FIG. 15 to the position in a sofa mode as shown in FIG. 1 according to the movement of the slide block sliding from one side to the other side of the base 74 by the rotation of said D C motor 64.

Figure 14:
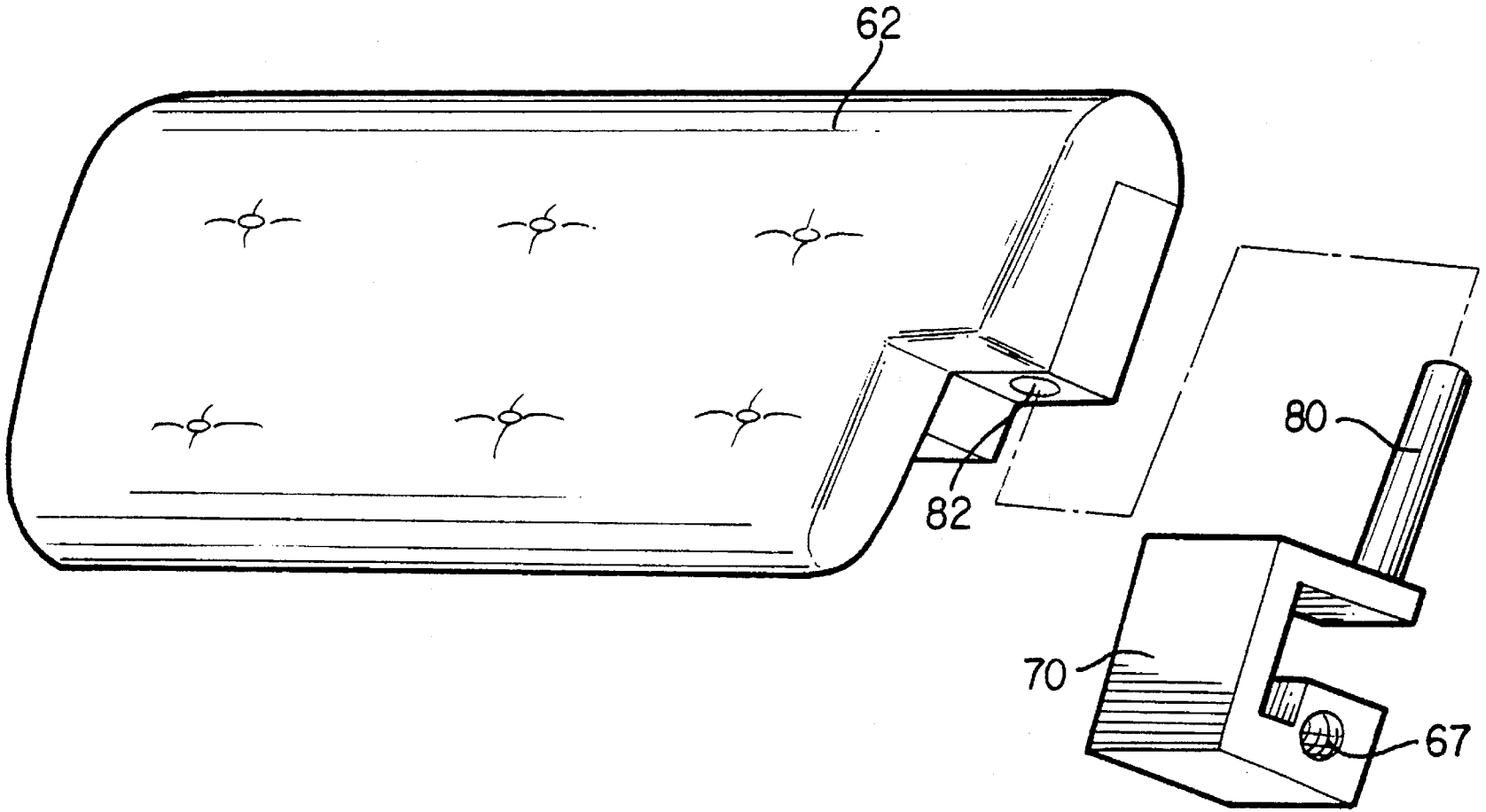
FIG. 14 is a perspective view illustrating the movable half backrest of the second embodiment, the backrest being formed to fit the shape of slide block.

In a sofa mode the two movable half backrests 62,63 coupled by a bolt 94 as illustrated in FIG. 11 support the weight of a sitting user, etc. Said base 74 of the movable half backrest 52,63 is formed to match the shape of said slide block 70 as shown in FIG. 14.

Thus the sofa-bed 68 of this embodiment is equipped with an electric apparatus 60 and the changing of the sofa-bed from a sofa mode to a bed mode (or reverse change) is possible only by operating said switches 75 positioned on the foot board 73 and head board 72. Since almost all parts of this electric apparatus 60 are in the base built in said head board 73, the sofa-bed of this embodiment does not need a large scale apparatus and as the first embodiment the electric apparatus 60 is put away in the position where it is not a nuisance and is not looking bad both in a bed mode and a sofa mode.

Depending on the situation two movable half backrests 62,63 can be moved by operating one switch via control circuits of said two DC motors 64,64. In this case, the electric apparatus is composed such that the two movable half backrests 62,63 are not collided with each other by moving one movable half backrest after the other is finished.

This electrical sofa-bed may be changed to a manual sofa-bed to change modes manually by removing D C motor from the sofa-bed 68 and exchanging said lead screw 66 for a slide pipe.

Referring to FIGS. 17–23, there is shown a third embodiment of a sofa-bed 100 of the present invention.

Figure 17:
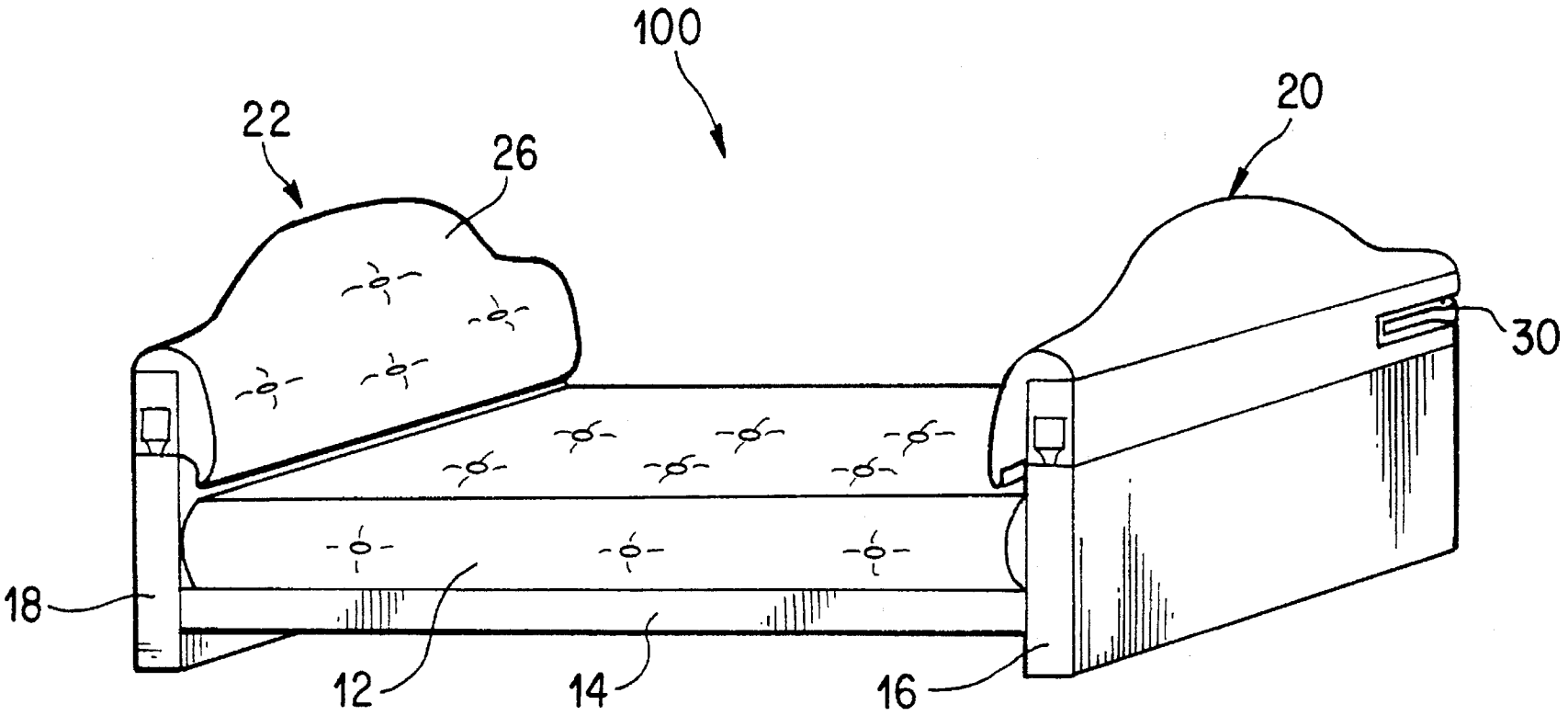
FIG. 17 is a perspective view illustrating a state of a third embodiment of sofa-bed of this invention as it is used in a bed mode.
Figure 18:
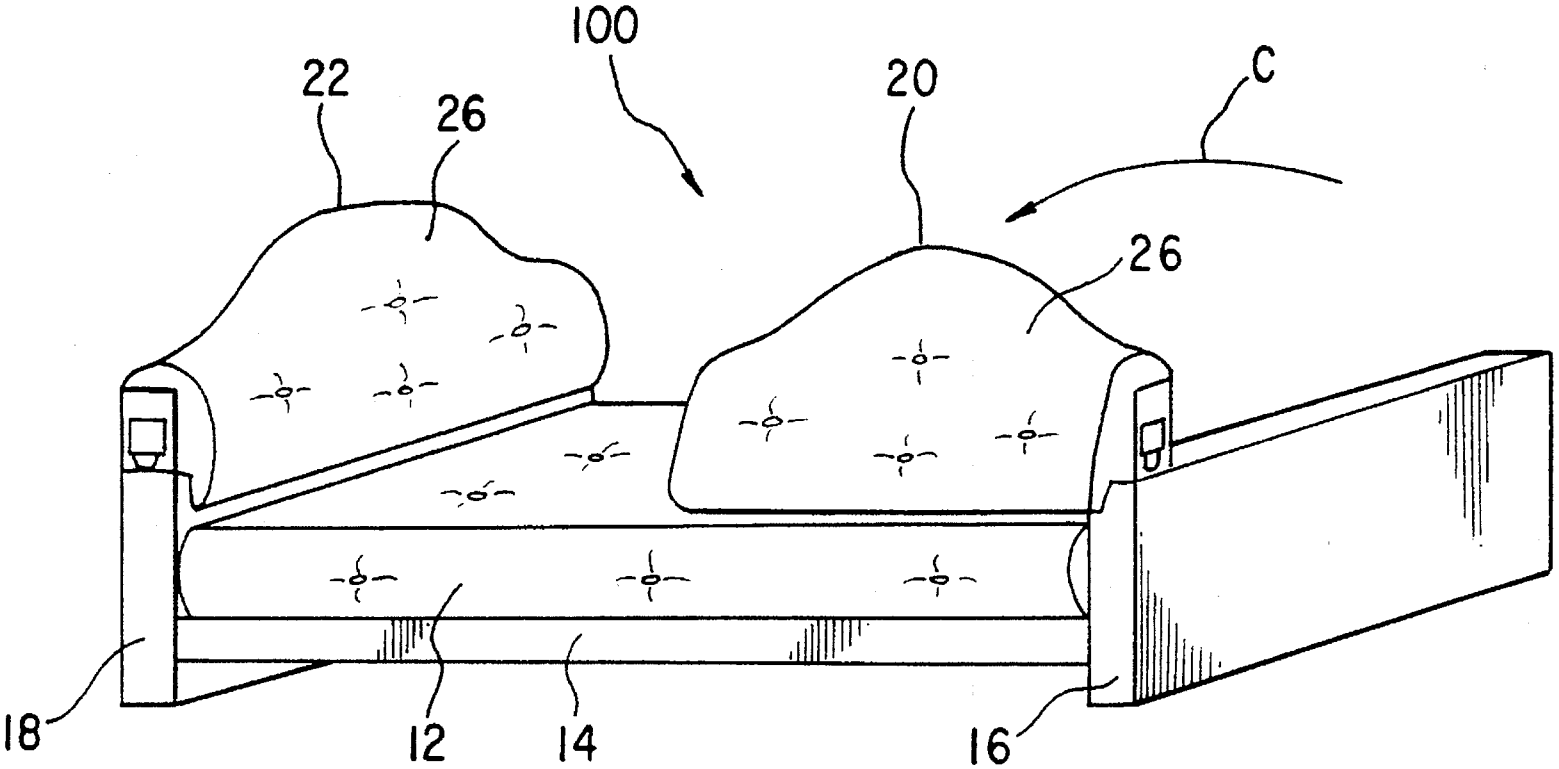
FIG. 18 is a perspective view showing a movement of a movable half backrest of the third embodiment in changing from a bed mode to a sofa mode.
Figure 19:
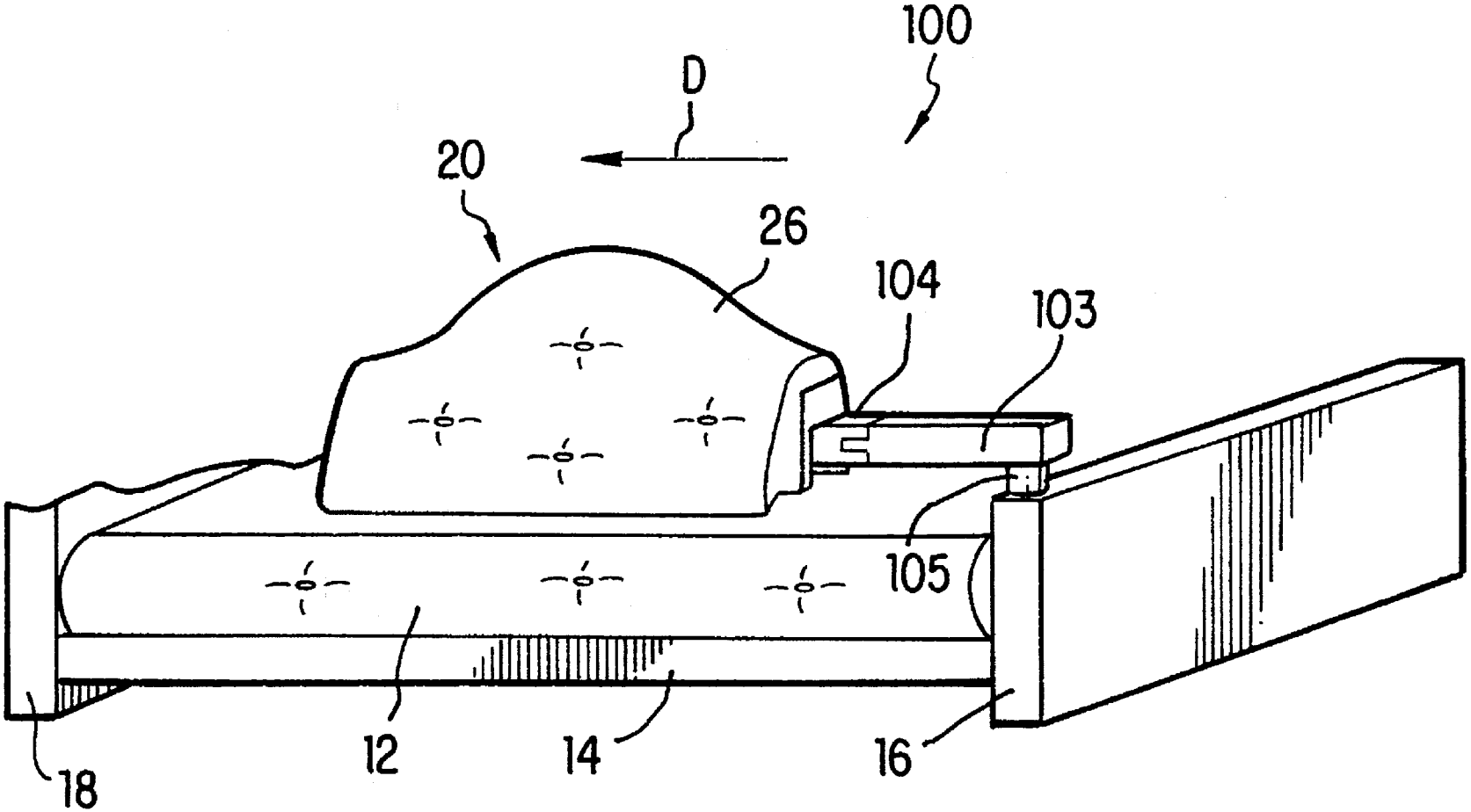
FIG. 19 is a perspective view showing a movement of a movable half backrest of the third embodiment in changing from a bed mode to a sofa mode.
Figure 20:
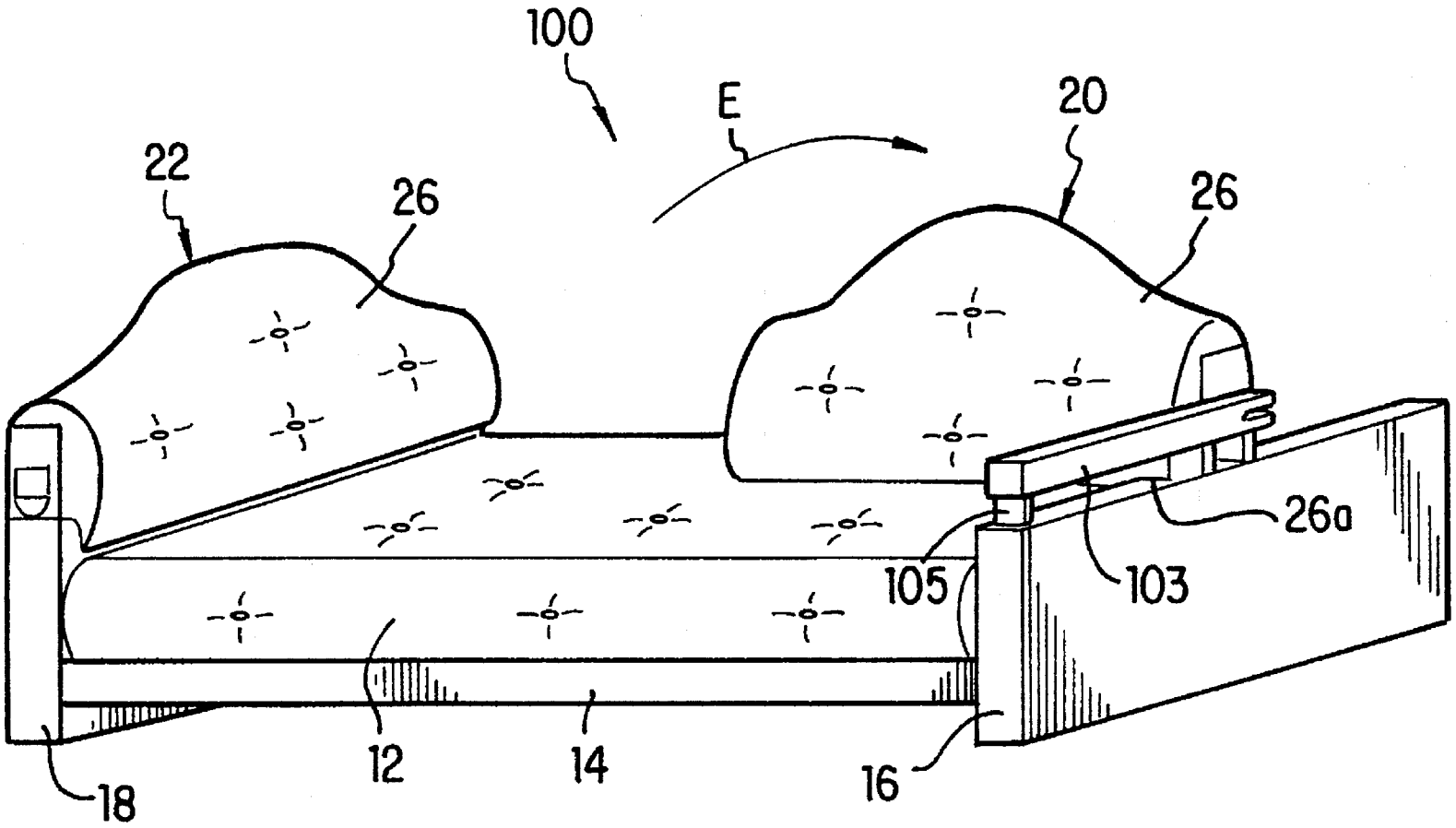
FIG. 20 is a perspective view showing a movement of a movable half backrest of the third embodiment in changing from a bed mode to a sofa mode.
Figure 21:
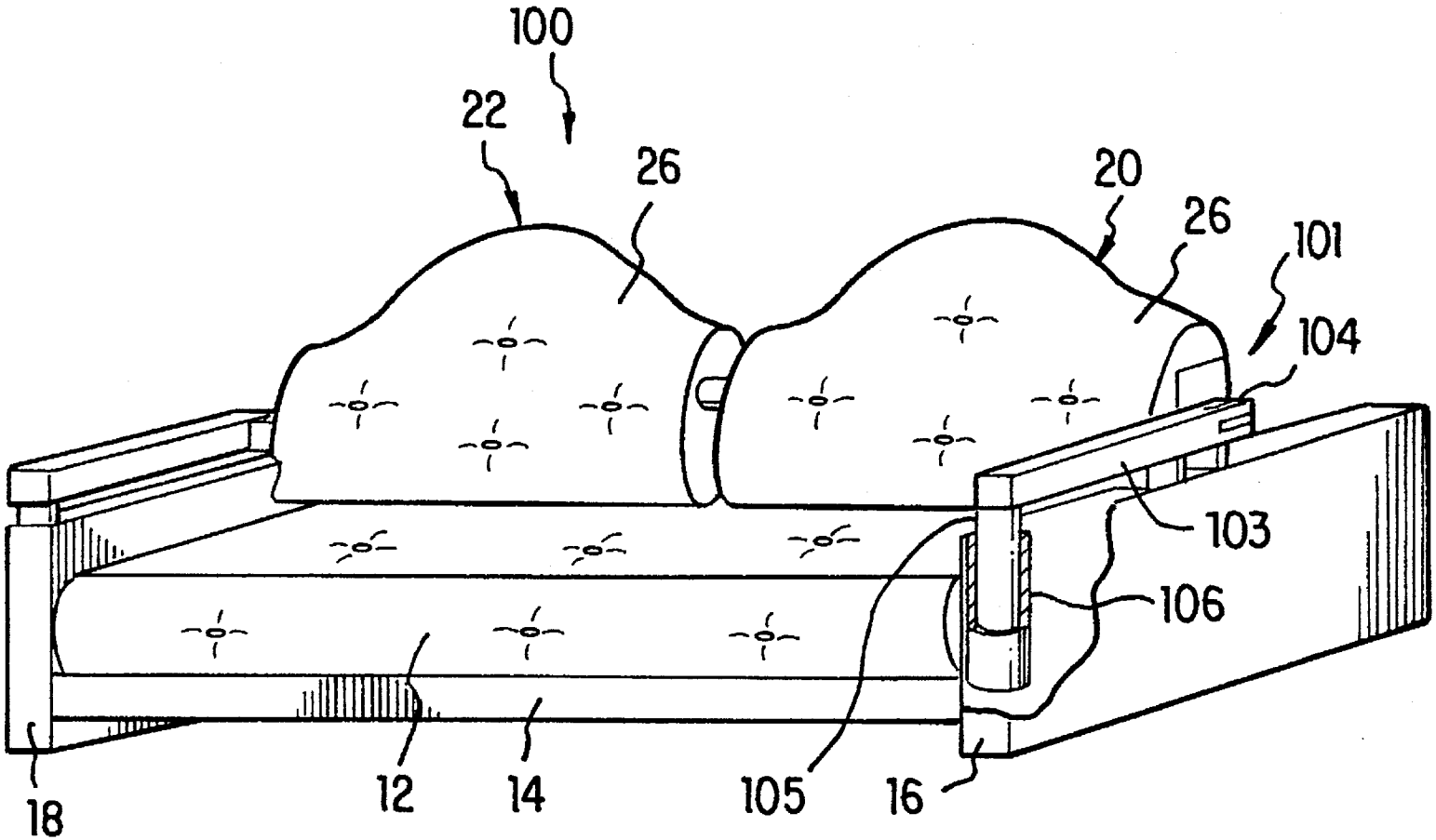
FIG. 21 is a perspective view showing a sofa-bed of the third embodiment in a sofa mode.
Figure 22:
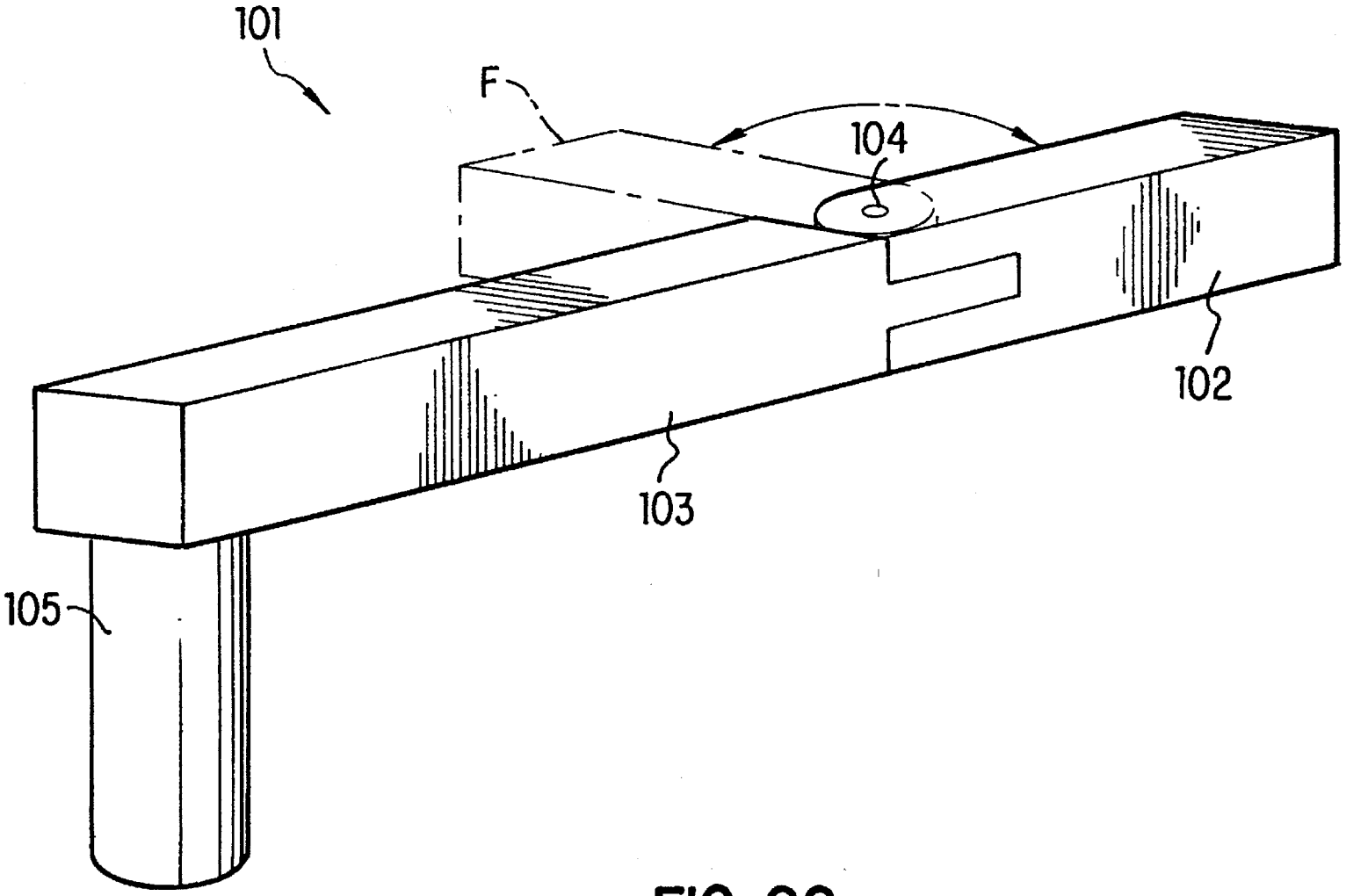
FIG. 22 is a perspective view of details of a movable mechanism for coupling the movable half backrests to a head board (and foot board) of the third embodiment.
Figure 23:
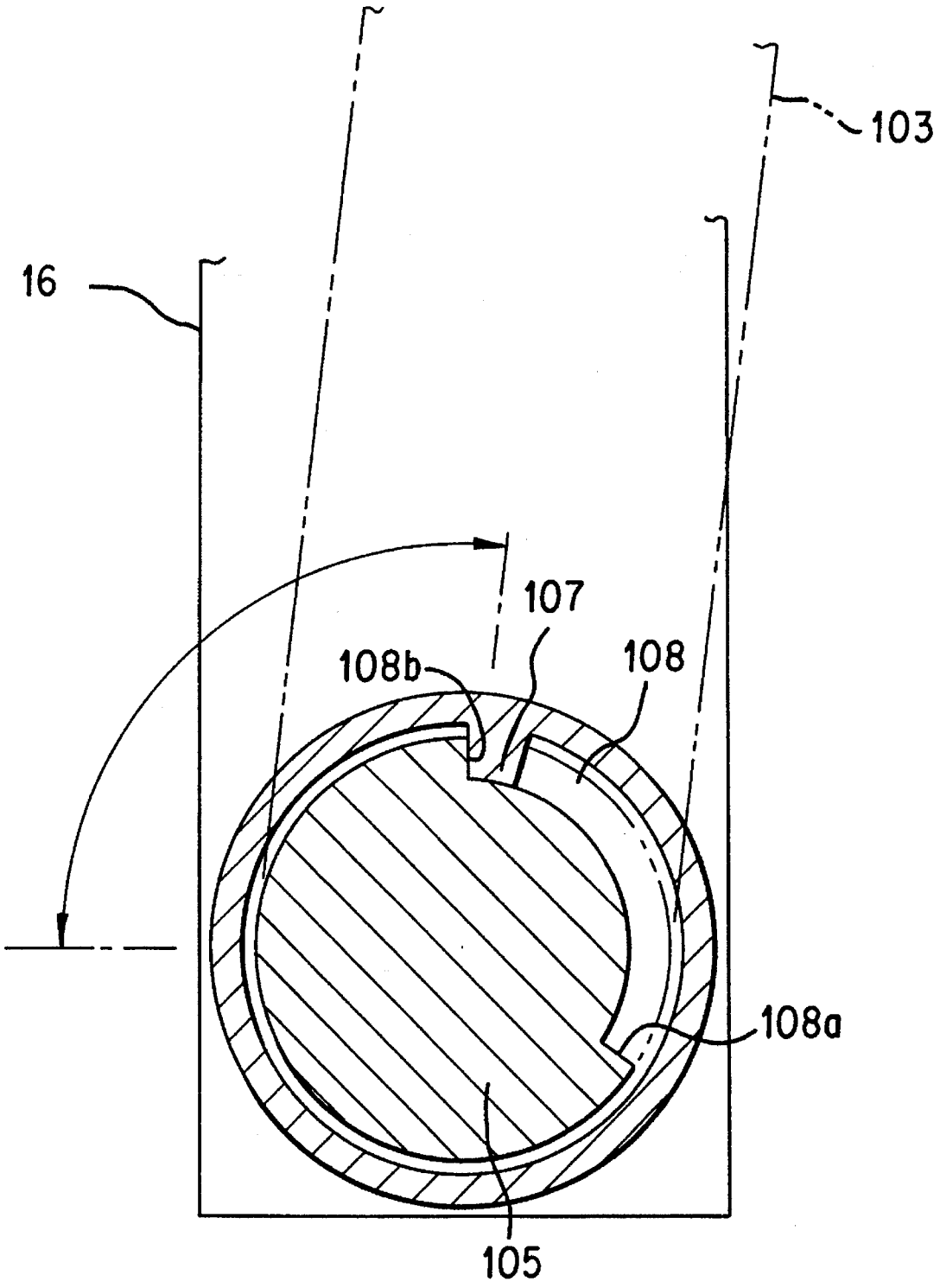
FIG. 23 is a partially cutaway perspective view illustrating a state where a shaft of the movable mechanism of FIG. 22 is inserted into the head board.

FIG. 17 is a perspective view illustrating a state of this embodiment of the sofa-bed of this invention as it is used in a bed mode. FIG. 21 is a perspective view of this embodiment used in a sofa mode. FIGS. 18–20 are perspective views showing the movement of a movable backrest of this embodiment from the bed mode position to the sofa mode position. FIG. 22 is a perspective view of details of a movable mechanism 101 for coupling the backrests with a head board (and foot board) of this embodiment. FIG. 23 is a partially cutaway perspective view illustrating a state that a shaft 105 of the movable mechanism 101 of FIG. 22 is inserted into the head board 16.

Both in the bed mode and the sofa mode, an outward appearance of this embodiment of the sofa-bed is almost similar to the ones of the first embodiment (see FIG. 1 and FIG. 2) and the second embodiment and the mode is changed manually, this embodiment is an alternative model of the first embodiment.

Basic constructions of the sofa-bed 100 of this embodiment in the bed mode and the sofa mode are the same as the first embodiment and therefore the common members are designated by the same characters and their explanation will be omitted. In the sofa-bed 100 of this embodiment, a construction of movable apparatus 101 for moving movable half backrests 20,22 and a method of moving the backrests are different from those of the first embodiment and so these will be described hereinafter with reference to the drawings.

As shown in FIG. 22, the movable mechanism 101 of the sofa-bed 100 of this embodiment comprises first arm 102 and second arm 103, and the ends of these two arms 102,103 are coupled together turnably via a pivot 104 so that they can rotate from a location where they are in straight line to a position where they make an acute angle (shown in FIG. 22 with broken lines). On the under side of the other end of said second arm 103, a shaft 105 is attached.

Above-mentioned two arms 102,103 are put away in the movable half backrest 20 (the movable half backrest 22) in the bed mode (see FIG. 17) and shaft 105 (see FIG. 21) is supported by a bearing 106 formed in the head board 16 (foot board 18), and said shaft 105 supports the movable half backrest 20.

In said bearing 106, as shown in FIG. 23, a projection 107 serving as a stopper is formed and revolution of the shaft 105 is limited in the bearing 106 from one end 108*a* to the other end 108*b* of a cut away portion 108 formed in the shaft 105 so that the second arm 103 can be revolved only within the required amount in the bed mode and the sofa mode.

Above-mentioned first and second arms 102,103 are desired to be a prism having square cross section for steady support of the movable half backrest. The right end of the movable half backrest 20 is located on the head board 16 in the sofa mode so that a cushion of said right end is desired to be thin for easy deformation, and the same is applied to the movable half backrest 22.

Action of the above-mentioned sofa-bed of the third embodiment, in an operation of changing mode, will be described hereinafter.

The user turns said movable half backrest 20 being in the bed mode (see FIG. 17) in the direction indicated by an arrow C around said shaft 105 over the mattress 12 and after the backrest 20 is positioned perpendicular to the end of the head board 16 (see FIG. 18), draws out the second arm 103 and the first arm 102 from the backrest 20 until the pivot 104 which is provided to the coupling portion of said arms is drawn out by pushing the armrest 20 in the direction indicated with an arrow D (see FIG. 19).

Then the user turns the second arm 103 to the head board 16 (the direction indicated by an arrow E) around said shaft 105 and the first arm 102 around said pivot 104 so as to locate the movable half backrest 20 in the position of the sofa mode (see FIG. 20). The right end 26*a* of said movable half backrest 20 located in the position of the sofa mode is adapted to be positioned on the head board 16 and the second arm 103 stops in the position (see FIG. 23) where it is slightly protruded from the head board because said projection 107 contacts with the other end 108*b* of the cut away portion 108.

Although the operation of one of the movable half backrest 20 is described, the sofa-bed of the embodiment will be in the sofa mode by the same operation of the other backrest. The coupling mechanism 30 for supporting the weight of the users in the sofa mode (see FIGS. 6, 7, 8 and 9) is mounted on the back sides of two movable half backrests 20,22 of the present embodiment in a manner similar to the sofa-bed of the first embodiment.

Thus in the sofa-bed 100 of this embodiment the movable half backrest 20 and the head board 16 are coupled together by easy operation of the movable mechanism 101 so that the user can change the sofa-bed from the bed mode to the sofa mode (or reverse) only by moving said movable half backrests with hand by himself.

Referring to FIGS. 24–29, there is shown a fourth embodiment of a sofa-bed 110 of the present invention. The members and portions similar to those of the first embodiment are designated by the same characters and their repeated explanation will be omitted.

Both in the bed mode and the sofa mode, although an outward appearance of this embodiment of the sofa-bed is almost similar to the one of the first embodiment (see FIG. 24 and FIG. 25) and changing of the mode by the hands is also similar, the characteristic of this embodiment is in a movable mechanism 140 for moving a movable half backrest 120,122 having a position control and break prevention mechanism.

Figure 24:
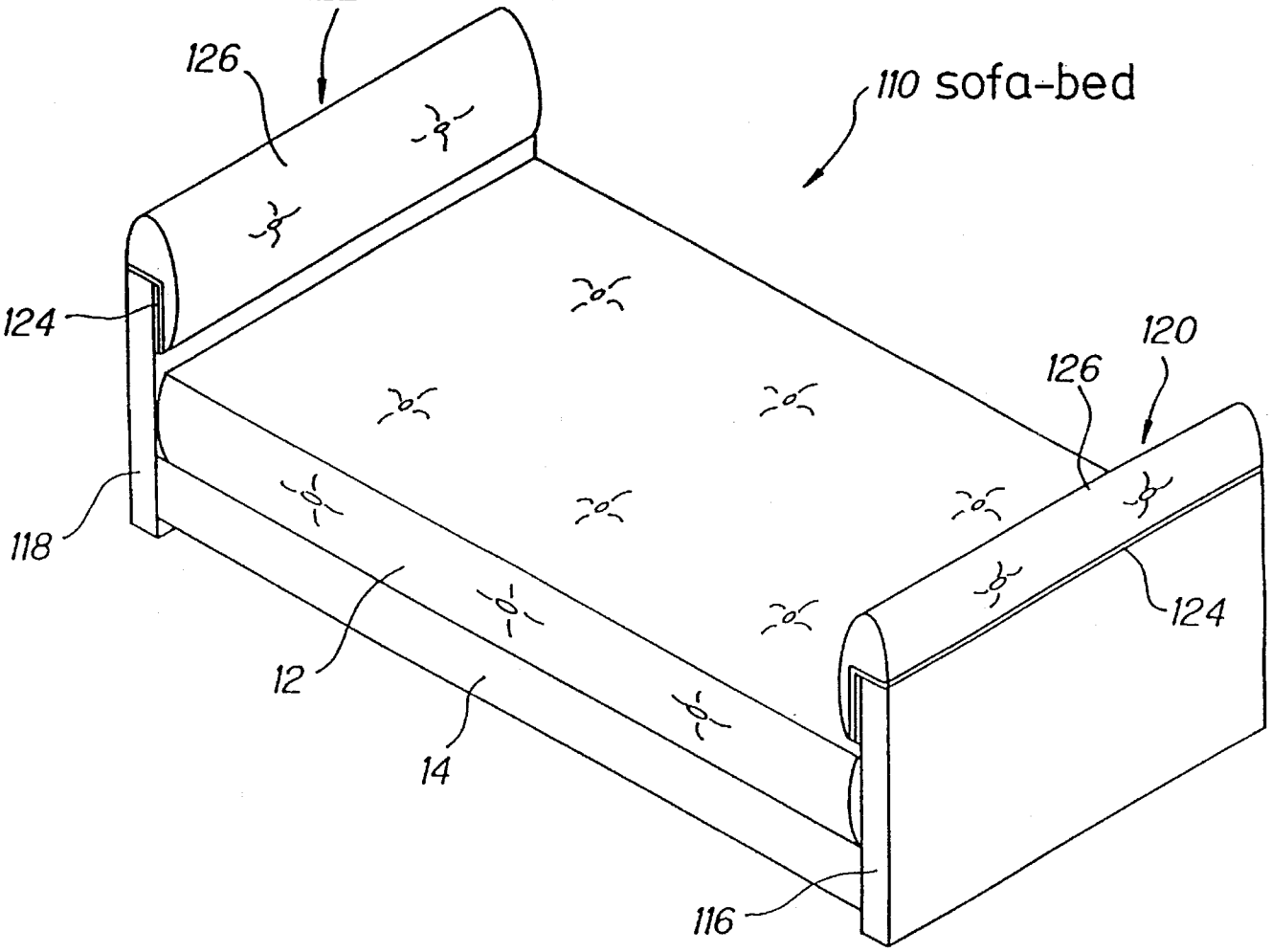
FIG. 24 is a perspective view illustrating a state of the fourth embodiment of the sofa-bed of this invention as it is used in a bed mode.
Figure 25:
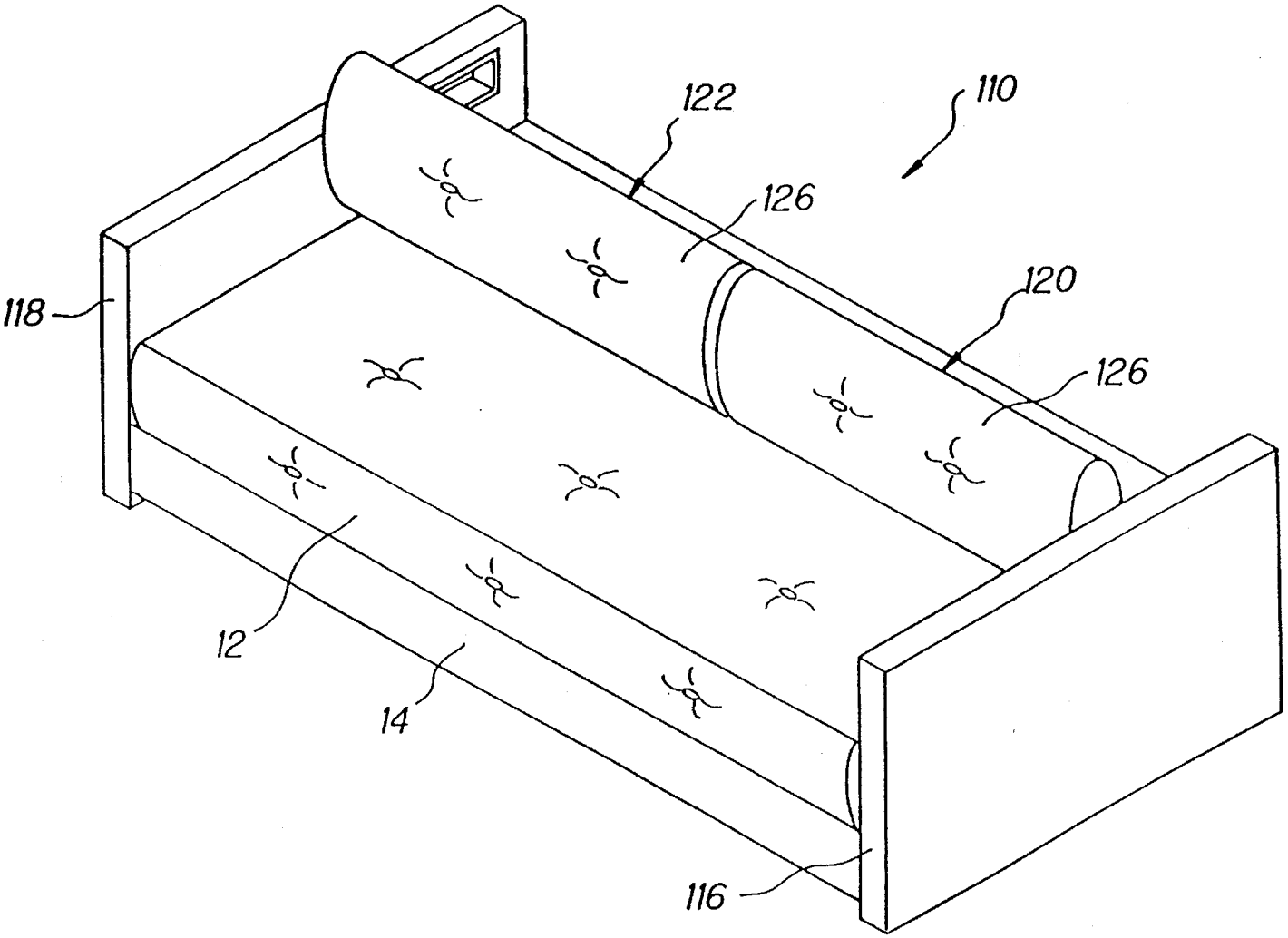
FIG. 25 is a perspective view illustrating a state of the fourth embodiment of the sofa-bed of this invention as it is used in a sofa mode.

Similarly the first embodiment, as shown in the FIGS. 24 and 25, the basic structure of the sofa-bed of the present embodiment includes a panel 14 and a head board 116 and a foot board 118 which also serve as armrests and support both ends of panel 14. This sofa-bed 110 is equipped with two movable half backrests 120,122 which are held on said head board 116 (and foot board 118) in a bed mode (see FIG. 24) and moved to the position where they serve as backrests in a sofa mode (see FIG. 25).

The movable half backrests 120,122 are formed by adhering a cushion portion 126 comprised of an outer cover, cushion, ect. to the backrest side of the frame member 124 respectively. These movable half backrests 120,122 are moveably supported on said head board 116 or foot board 118 via a movable mechanism 140 described herein after. In the case of the sofa mode, said two movable half backrests 120,122 are coupled together by a support bar 131 which is an element of coupling mechanism shown in FIG. 26, and support the weight of the users, etc.

The movable half backrests 120,122 supported in the second position (see FIG. 25) can be adjusted slightly in vertical direction and in the front and back by the movable mechanism 140, and said mechanism 140 is comprised of the position control and break prevention mechanism for preventing said backrests from been broken by supporting the weight when excessive weight is loaded on them.

Figure 26:
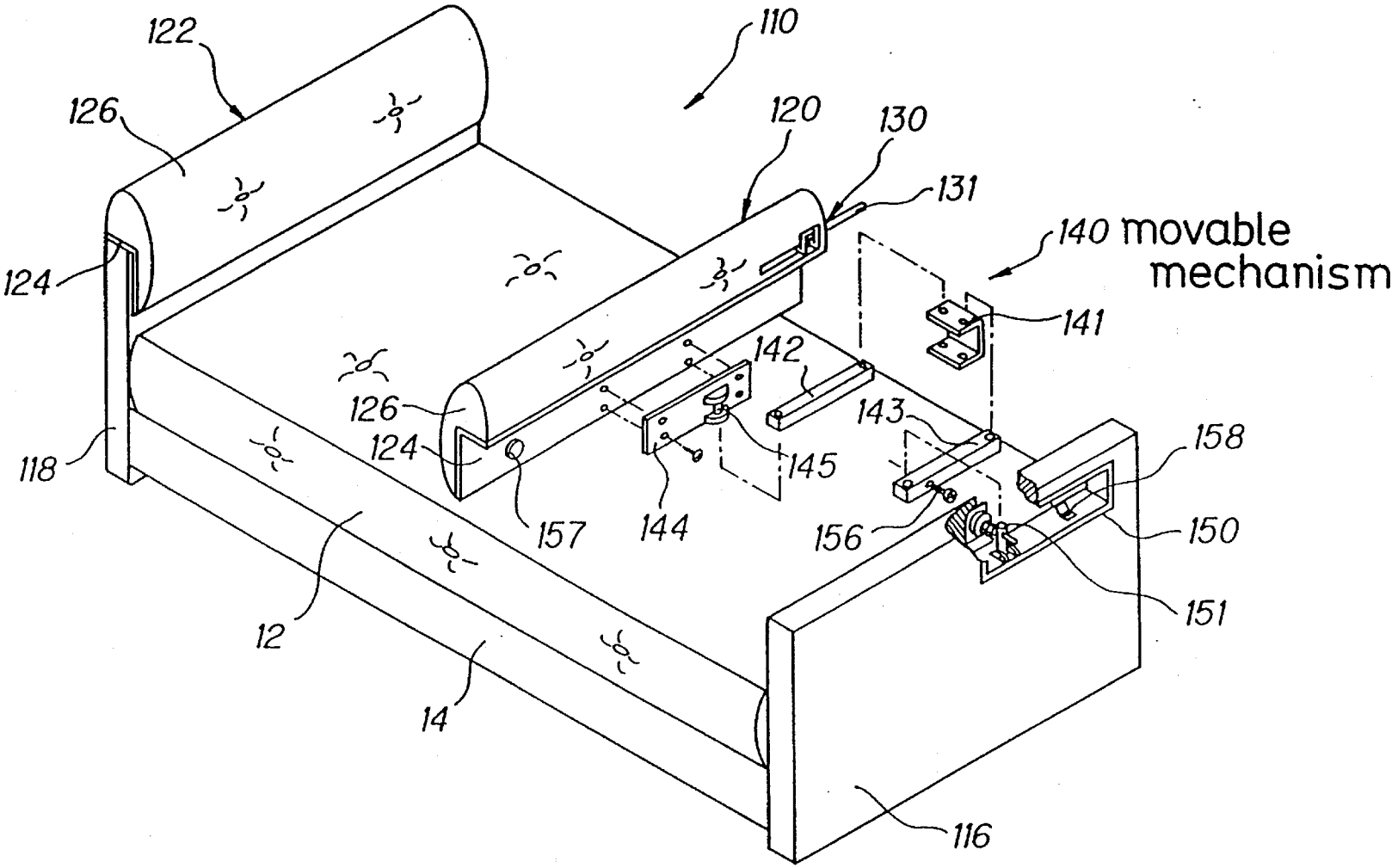
FIG. 26 is an exploded view in perspective of a movable mechanism of the fourth embodiment of this invention.
Figure 2:
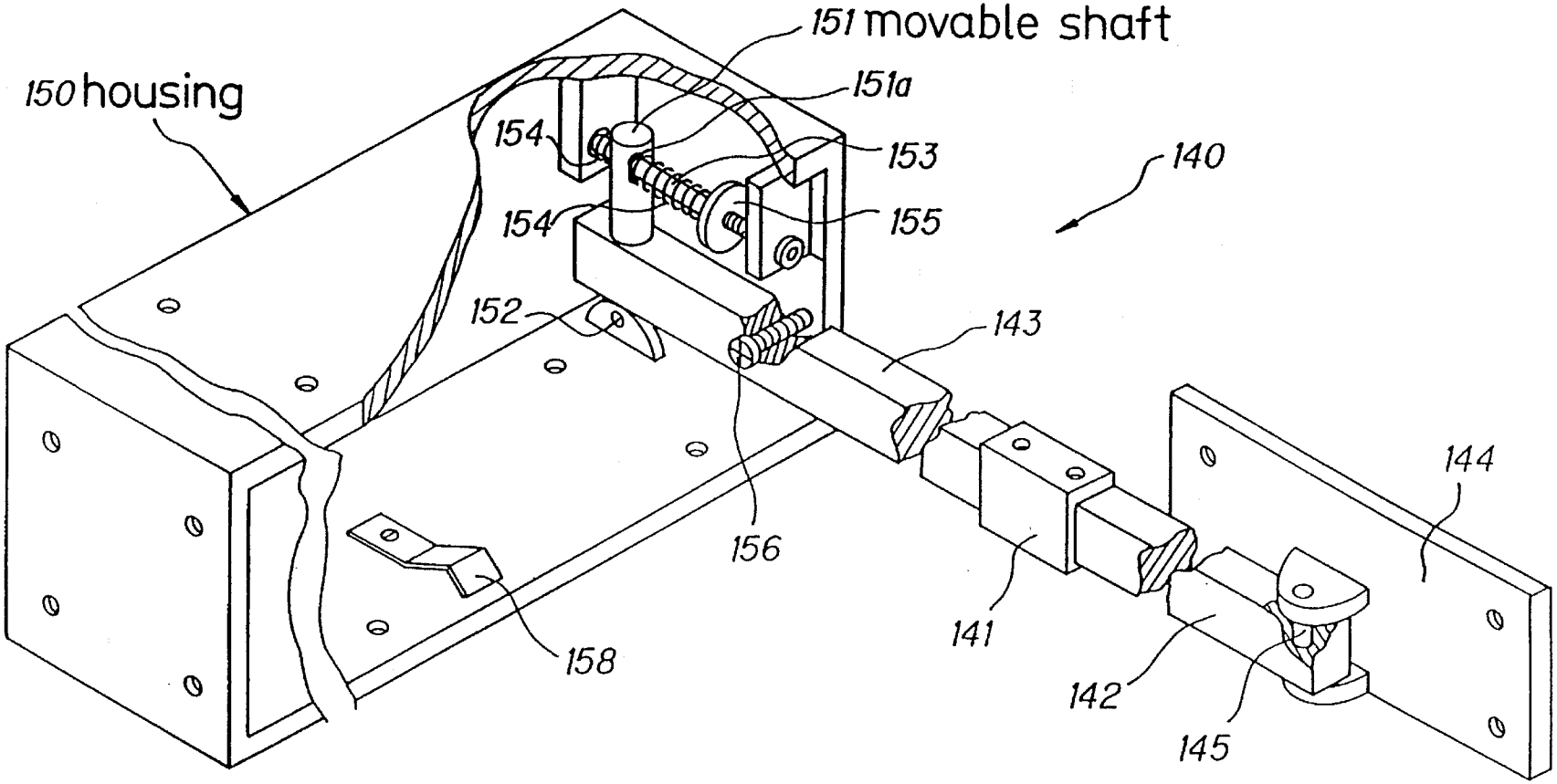

As shown in FIGS. 26 and 27, said movable mechanism 140 includes two metal arms 142,143 coupled together via a hinge bracket 141 turnably in a horizontal plane. Said hinge bracket 141 serves as a stopper which holds one arm 142 not to turn more than a prescribed angle to the arm 143 as shown in FIG. 27.

As shown in FIG. 27, the end of said arm 143 is coupled turnably in a horizontal plane to a movable shaft 151 built in a housing 150 mounted in an upper portion of head board 116. And shown in FIG. 29, said arm 142 is coupled turnably via a mount bracket 144 to a shaft 145 mounted almost perpendicularly on said frame member 124 being in the back side of the movable half backrest 120.

Figure 28:
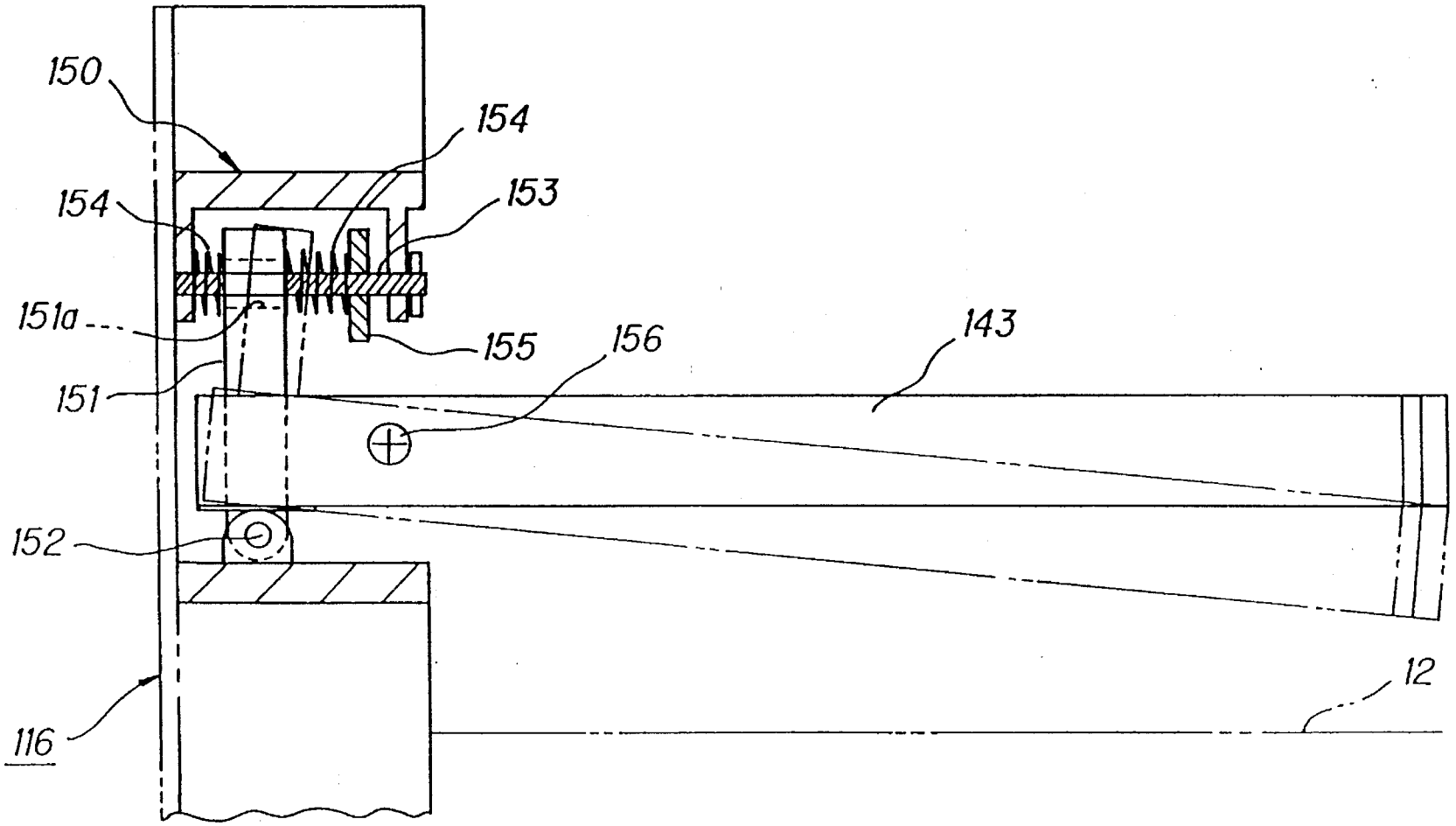
FIG. 28 is an operational diagram illustrating a moving arm supported with the movable mechanism of the fourth embodiment.
Figure 29:
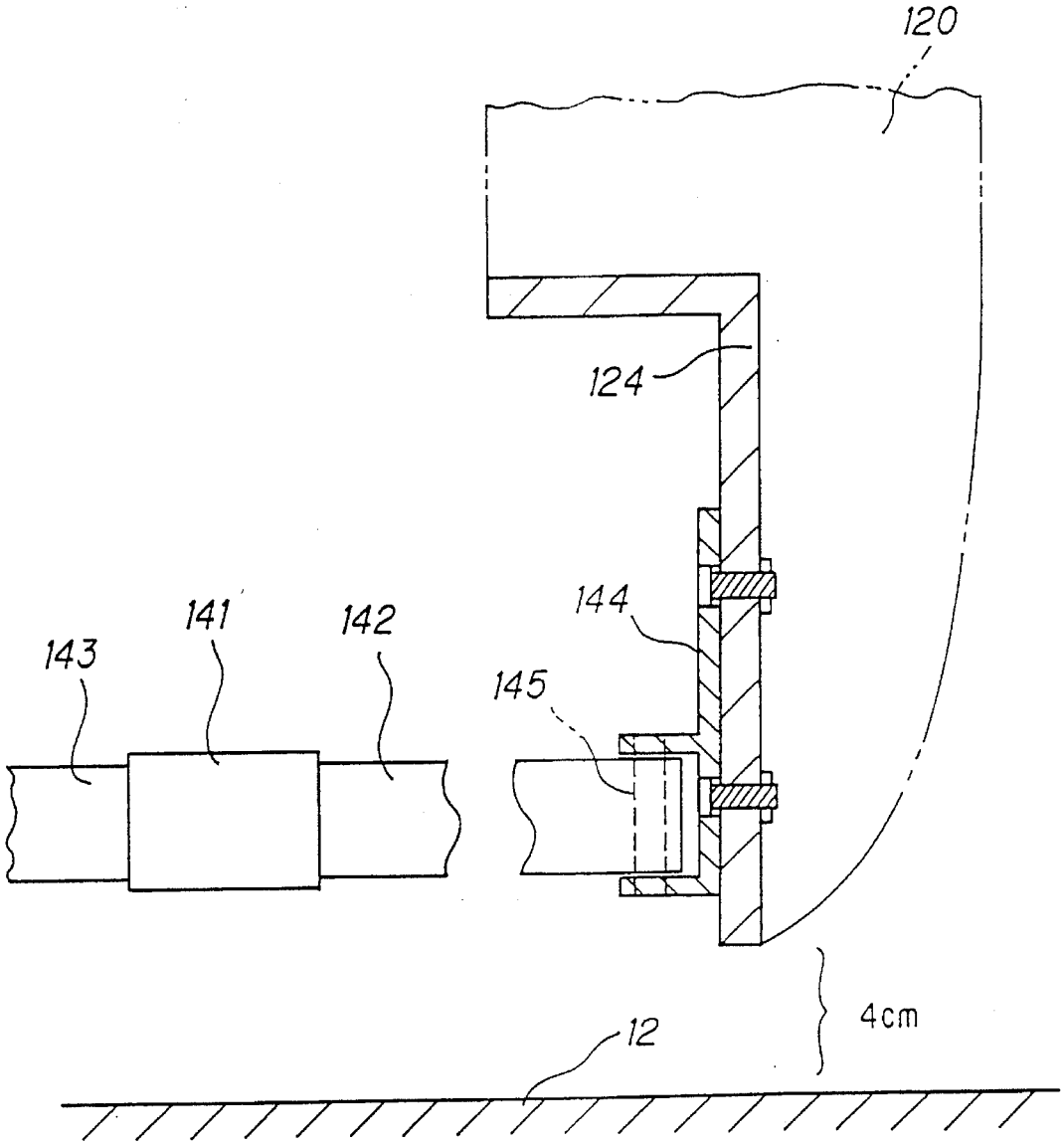
FIG. 29 is a sectional view illustrating the arm coupled to a movable half backrest of the fourth embodiment.

As shown in FIG. 28, said movable shaft 151 are supported on its low end by a rocker shaft 152 fixed in the bottom of said housing 150 so that the upper end of said shaft 151 may rock in the longitudinal direction of the sofa bed. An aperture 151*a* is formed in the upper end of the movable shaft 151 and a guide rod 153 fixed on the side wall of housing 150 is inserted into the aperture 151*a*. Springs 154,154 are provided in both ends of said guide rod 153 so as to sandwich the upper end portion of the movable shaft 151 between the springs.

In one end of the guide rod 153, an adjust nut 155 is provided for adjusting an angle of arm 143 by restoring forces of spring 154. Springs 154,154 also serve as the shock absorbers for preventing the movable half backrest 120 from breaking when the backrest is loaded excessive weight.

As shown in FIG. 27, a screw stopper 156, touching to the side wall of housing 150 when the movable half backrest 120 is in the second position (see FIG. 25), is provided on one side of said arm 143. Said stopper 156 sets a final position of each straight extending arm 142,143 in turning in a horizontal plane about the movable shaft 151 by appropriately adjusting a tip projection of the stopper 156 with screwdriver, as to adjust a position of movable half backrest 120 on the second location in the front and back direction.

As described above, the position controlling and break preventing mechanism of movable mechanism 140 comprises a movable shaft 151, a pivot axis 152, a guide rod 153, a spring 154, an adjust nut 155 and stopper 156, they support an arm 143 or movable half backrest 120 so as to adjust the angle of backrest 120 in vertical direction and in the front and backward direction. Said position controlling and break preventing mechanism is built in the housing 150 previously and they form a unit.

As shown in FIG. 26, a magnet 157 is attached to one side of flame member 124 being in the rear side of the movable half backrest 120, and furthermore a leaf spring 158 is provided on the bottom of housing 150. Said leaf spring 158 is the member that supports the movable half backrest 120 when it is put away in the first position therein (see FIG. 24), while said magnet 157 is the member that stabilizes the movable half backrest 120 and the arm 143, located in the second position, by magnetic force.

Action of the above-mentioned sofa-bed 110 of the fourth embodiment will described hereinafter.

As shown in FIG. 24, if a user want to move the movable half backrests 120,122 from the first positions on the head board 116 and foot board 118 wherein said backrests are put away in the bed mode to the second positions in the sofa mode, he may move them with ease from the first position to the second (or reverse) manually in a manner similar to the operation of the sofa-bed of first embodiment.

As shown in FIG. 25, when each movable half backrest 120,122 moves in the second position as shown in FIG. 25, two arms 142,143 are approximately in straight as shown in FIG. 27, however in the case that the each movable half backrest 120,122 is not in desired position on account of unevenness of accuracy of woodwork, the position of each backrest 120,122 can be adjusted continuously by exactly adjusting the position (angle) of arm 143 at least either in the vertical direction (indicated by phantom line in FIG. 28) or in the front and back direction by means of an adjusting nut and a stopper which are forming the position controlling and break preventing mechanism of the movable mechanism 140.

In the sofa mode shown in FIG. 25, even if each movable half backrest 120,122 is loaded with excessive weight, they are prevented from been broken because the spring 154 of the position controlling and break preventing mechanism absorbs said excessive weight. The position controlling and break preventing mechanism is built in the housing 150 previously and they form a unit and can be assembled easily with head board 116.

Referring to FIGS. 30–33, there is shown a fifth embodiment of a sofa-bed 210 of the present invention. The members and portions similar to those of the fourth embodiment are designated by the same characters and their repeated explanation will be omitted.

Both in a bed mode and a sofa mode, although an outward appearance of this embodiment of the sofa-bed 210 is almost similar to the one of the fourth embodiment and the movable mechanism 240 has also the position controlling and break preventing mechanism, the construction of said movable mechanism 240 and its position controlling and break preventing mechanism of this embodiment are different from those of the fourth embodiment. One set of the movable half backrest 120 and the movable mechanism 240 will be explained in the following description, and the explanation of the other set will be omitted because said two sets have similar construction.

Figure 30:
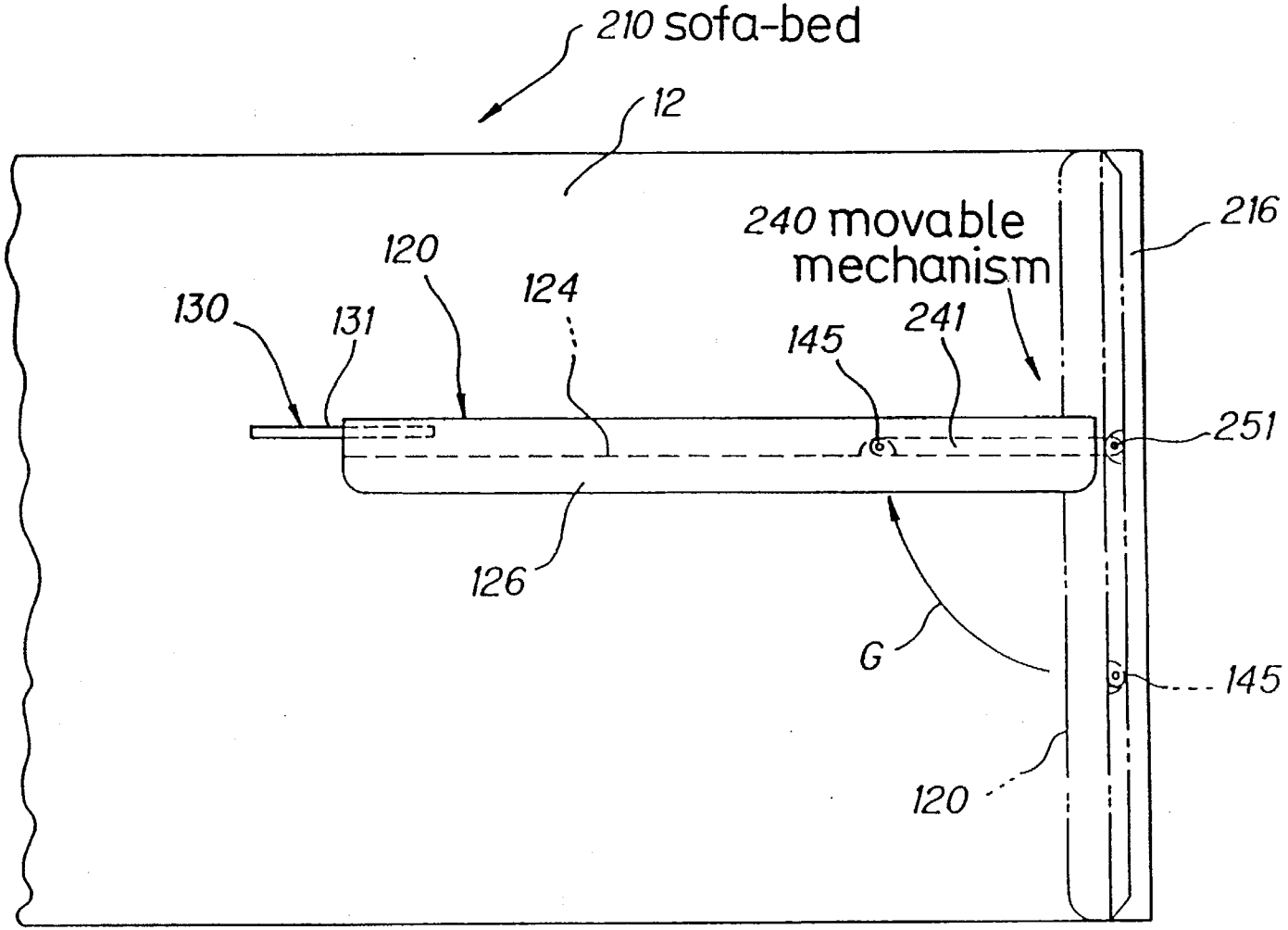
FIG. 30 is a plan view showing a movable half backrest of a fifth embodiment of this invention moving from the first position to the second.
Figure 3:
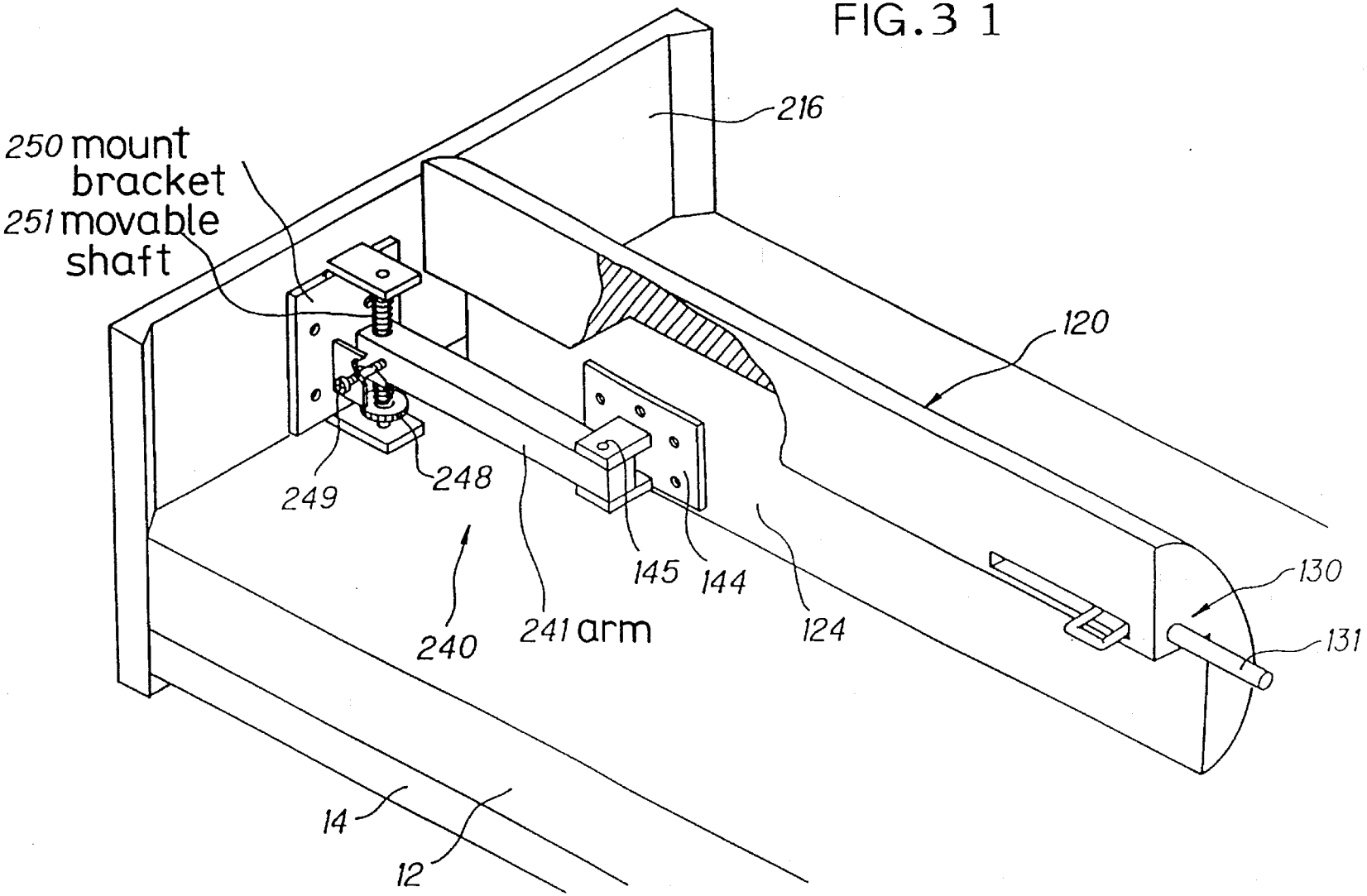

Referring to FIG. 30, said movable half backrest 120, through the following movable mechanism, is supported on a head board 216 moveably from the first position (indicated by phantom lines) to the second position (indicated by solid lines). In the case of the sofa mode, said two movable half backrests 120 are coupled by a support bar 131 which is an element of coupling mechanism 130, and support the weight of the user.

Referring to FIG. 31, said movable mechanism 240 have a metal arm 241. A tip of said arm 241 is coupled turnably with a shaft 145 to mount bracket 144 which is mounted almost perpendicularly on said frame member 124 on the back side of the movable half backrest 120. Base end portion of the arm 241 is coupled to a supporting shaft 251, which is pivotably and almost vertically supported on a bracket 250 of said head board 216 moveably in horizontal plane.

Figure 32:
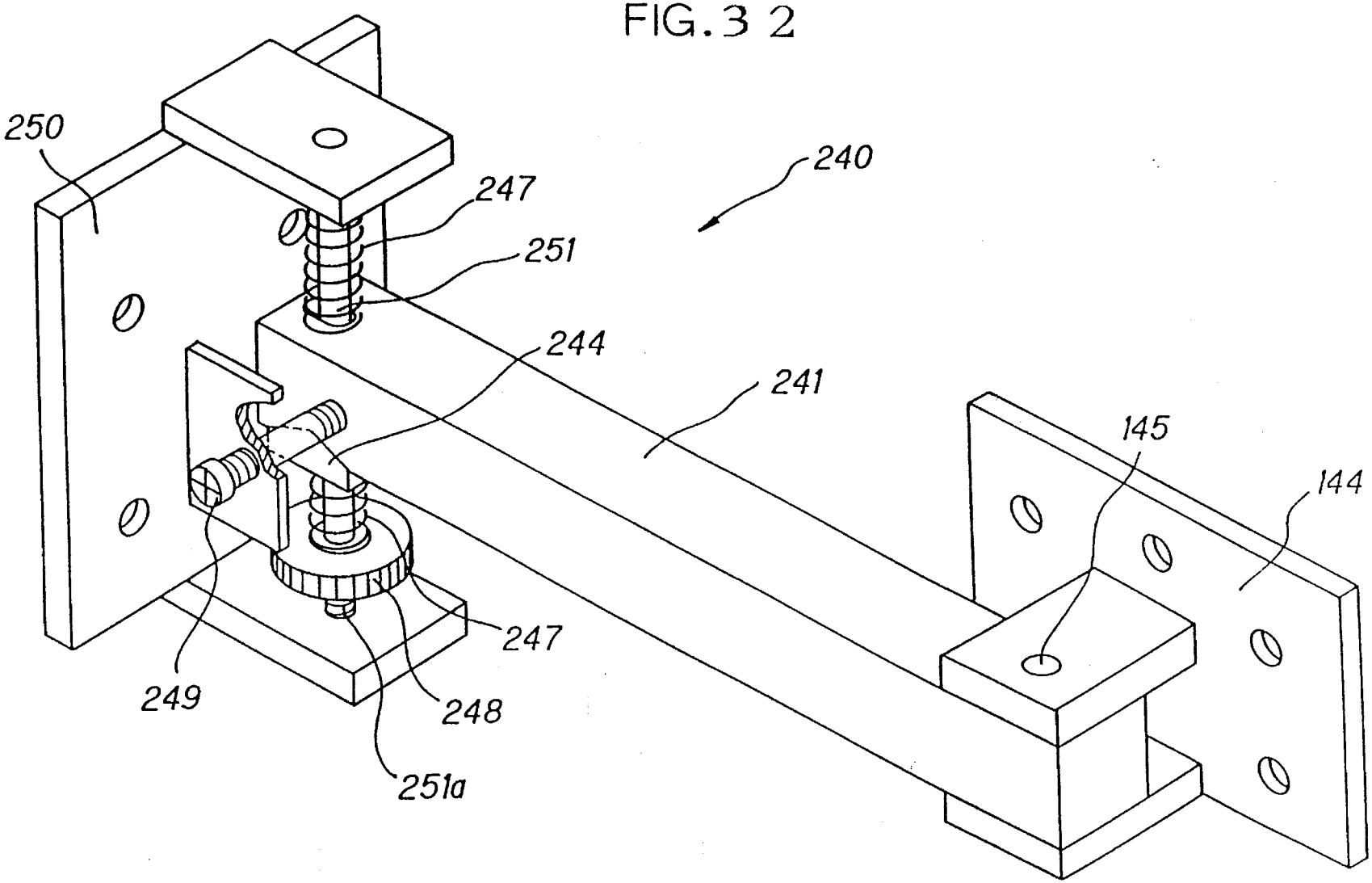
FIG. 32 is an enlarged perspective view illustrating the movable mechanism of the fifth embodiment.
Figure 33:
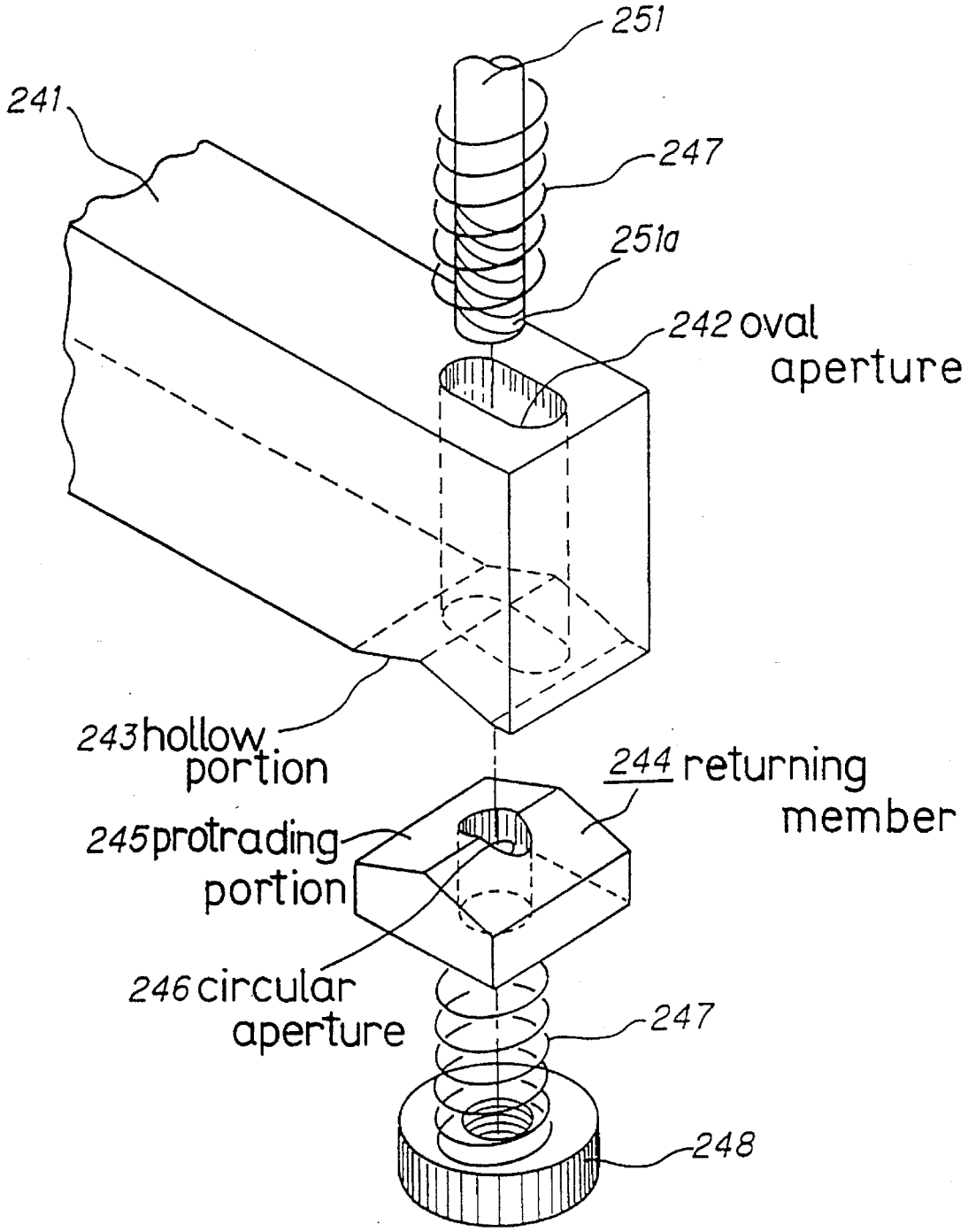
FIG. 33 is an exploded view in perspective of a position adjustment and break preventing mechanism employed in the movable mechanism of the fifth embodiment of this invention.

More specifically as shown in FIG. 32 and FIG. 33, an oval aperture 242 is formed in the base end portion of arm 241, and the supporting shaft 251 is inserted thereinto. Thus the arm 241 can rock vertically to some extent about the shaft 251 inserted into the aperture. Springs 247,247 are provided in both upper side and lower side of said supporting shaft 251 so as to sandwich the base end portion between the springs. A position returning member 244 is provided between said base end portion of the arm 241 and said lower spring 247.

As shown in FIG. 33, a circular aperture 246, having a diameter approximately equal to the outside diameter of the supporting shaft 251, is formed in said position returning member 244 and said shaft 251 is inserted into said circular aperture. Said position returning member 244 has a protruding portion 245 fit to a hollow portion 243, whose shape is an inverted character "V", formed on the under side of base end portion of arm 241 and usually said protruding portion 245 is pressed to said hollow portion 243 by means of the restoring force of said spring 247. Therefore said arm 241 is remained horizontally.

Thus said position returning member 244 returns to said arm 241, which rocks about said shaft 251 by excessive load on the movable half backrest 120, to the horizontal position. Thread 251*a* is formed on a lower side of the supporting shaft 251 and an adjusting nut 248, which can adjust a height position where the arm 241 is supported by a restoring force of the spring 247, is engaged with said thread 251*a* turnably. Even if each movable half backrest 120,122 is loaded with excessive weight, said movable mechanism 240 is prevented from breaking because the spring 247 absorbs said excessive weight.

As shown in FIGS. 31 and 32, a screw type stopper 249 for adjusting the position in lateral direction of the arm 241 is provided to the bracket 250, said stopper 249 contacts the base end portion of arm 241 when movable half backrest 120 is in the second position (indicated by solid line in FIG. 30). The position of the tip projection of said stopper 249 can be appropriately adjusted by rotating it with the screwdriver.

As described above, the position controlling and break preventing mechanism of the movable mechanism 240 comprises a supporting shaft 251, a position returning member 244, a spring 247,247, an adjusting nut 248, and stopper 249, etc. Said position controlling and break preventing mechanism is built in the bracket 250 which is fastened on the upper portion of head board 216 by screws, and they form a unit.

Action of above-mentioned sofa-bed 210 of the fifth embodiment will described hereinafter.

As shown in FIG. 30, if a user wants to move the movable half backrests 120 from the first positions (indicated by phantom line) on the head board 216 wherein the backrests are put away in the bed mode to the second positions in the sofa mode, he may move the movable half backrest 120 pivotably supported on the top end side of the arm 241 via shaft 145 to the second position (indicated by solid line) extending in the longitudinal direction of the sofa-bed with turning arm 241 at the movable shaft 251 of movable mechanism 240 in the direction shown by arrow "G".

Thus the arm 241 is positioned to be almost perpendicular to the head board 216 as illustrated in FIG. 31. Even if the movable half backrest 120 in the second position is tilted to the vertical direction on account of unevenness of accuracy of woodwork, the inclination can be adjusted because the arm 241 is adapted to be rocked some degree vertically on supporting shaft 251 inserted into the oval aperture 242.

By means of rotating the adjusting nut 248 and/or the stopper 249 in an optional direction, the height and/or the position in lateral direction of the movable half backrest 120 can be adjusted appropriately. Furthermore in the sofa mode indicated by solid line in FIG. 30, even if each movable half backrest 120,122 is loaded with excessive weight, they are prevented from been broken because the springs 247,247 of the position controlling and break preventing mechanism absorbs said excessive weight. Then the arm 241 tilted by excessive load temporarily is returned to the horizontal position immediately by the position returning member 244 whose protruding portion 245 is pressed to its hollow portion 243 by means of the restoring force of said spring 247.

Figure 34:
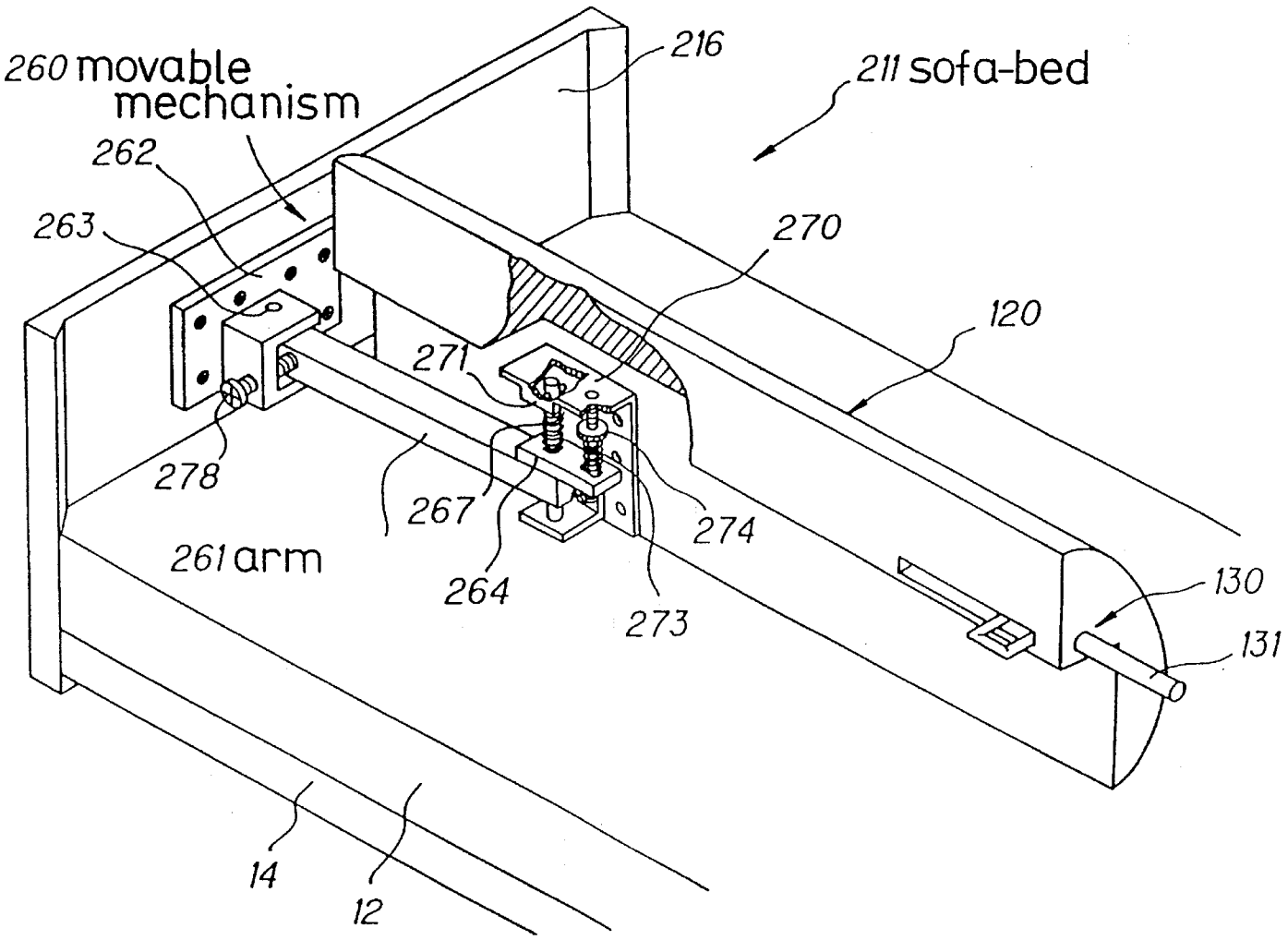
FIG. 34 is a perspective view showing a movable mechanism of the sixth embodiment of the sofa-bed of the present invention seeing from the rear side of the sofa-bed in a sofa mode, a part of the movable half backrest being broken away for clearness.
Figure 35:
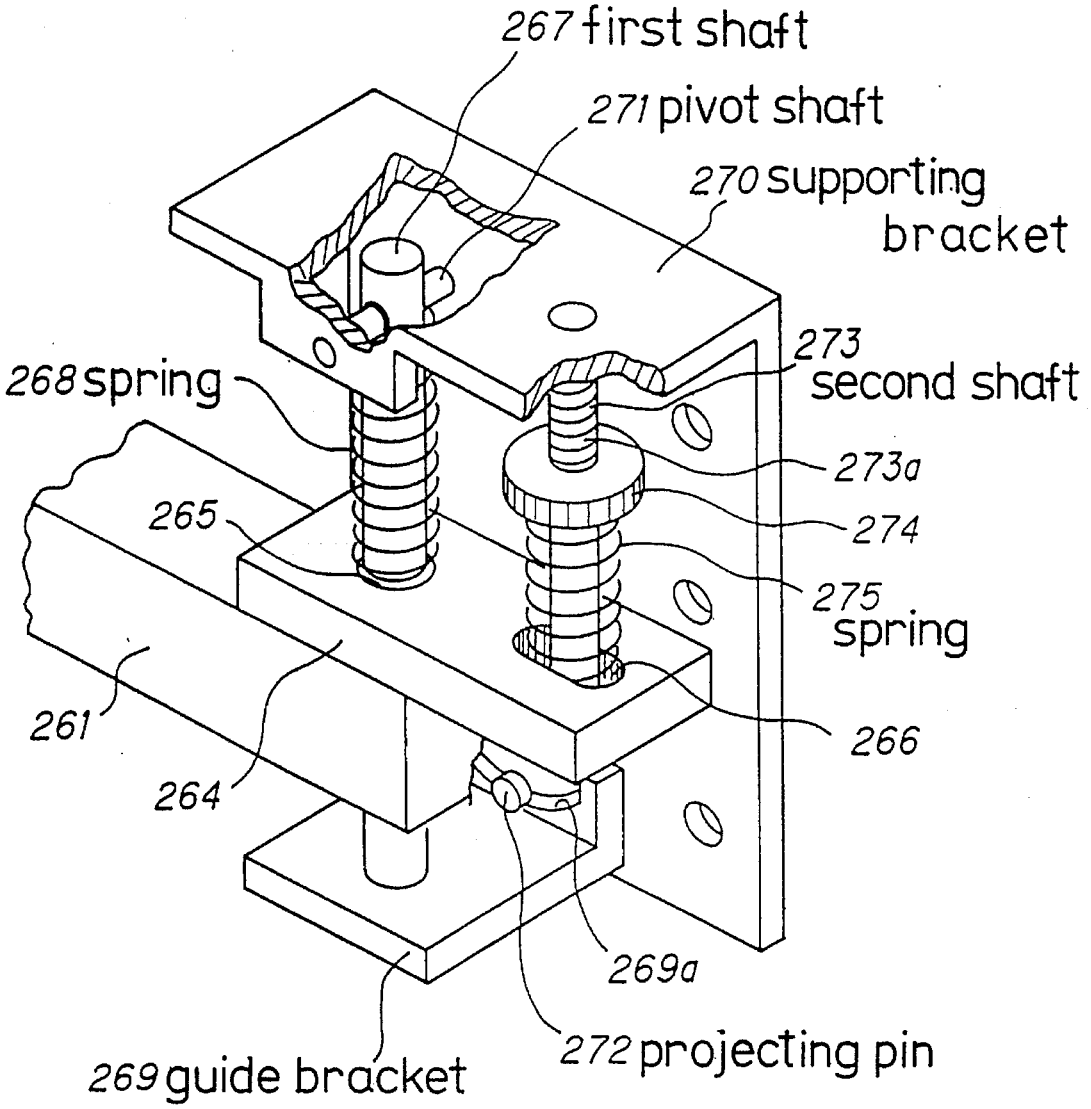
FIG. 35 is an enlarged perspective view illustrating the movable mechanism (particularly position adjustment and break preventing mechanism) of the sixth embodiment.
Figure 36:
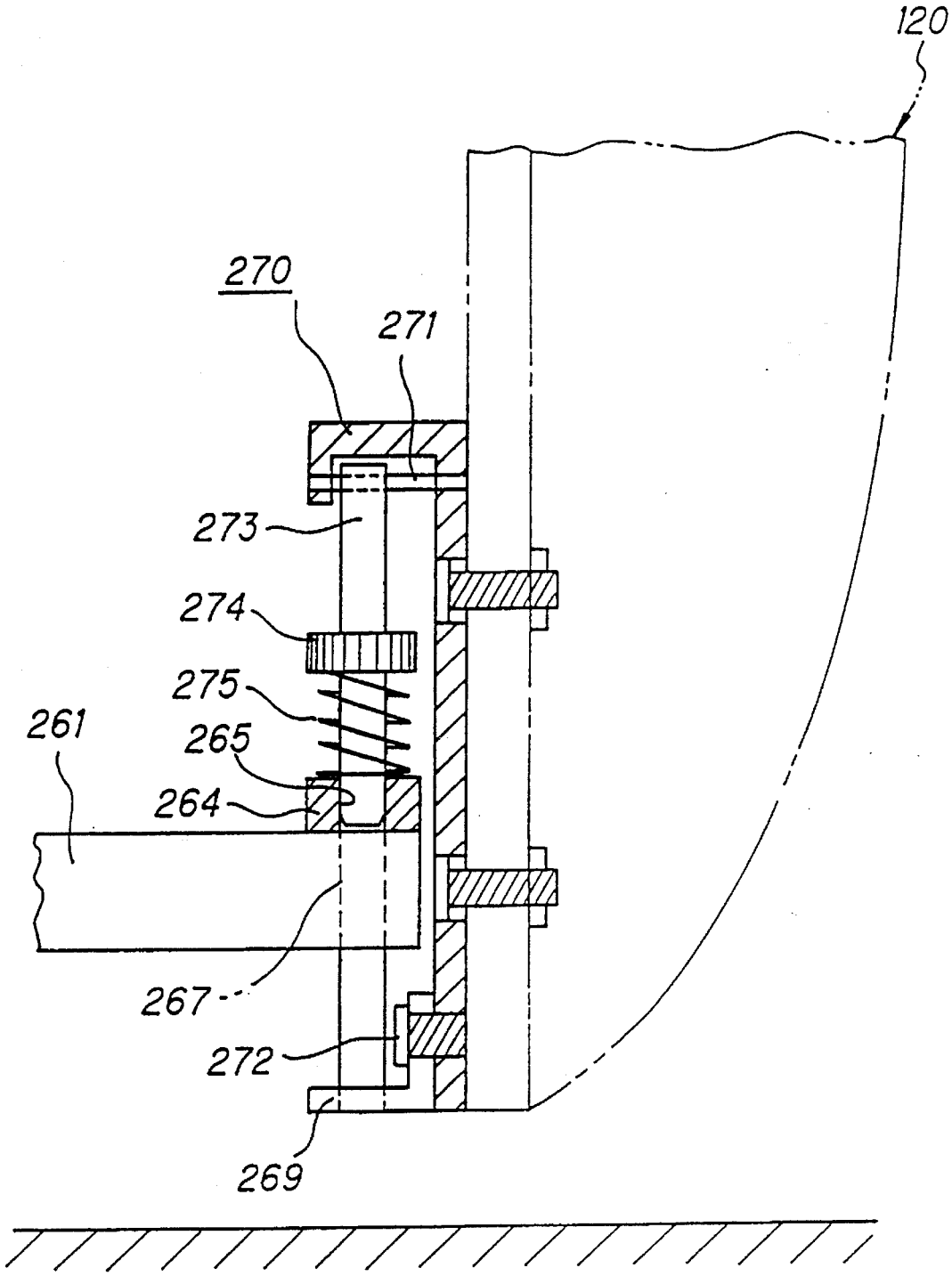
FIG. 36 is a sectional view showing an arm coupled to the movable half backrests of the sixth embodiment.

Referring to FIGS. 34–36, there is shown a sixth embodiment of a sofa-bed 211 of the present invention. The members and portions similar to those of the fifth embodiment are designated by the same characters and their repeated explanation will be omitted.

Both in a bed mode and a sofa mode, although an outward appearance and a construction of this embodiment of the sofa-bed is almost similar to the one of the fifth embodiment, the construction of said movable mechanism 260 and its the position controlling and break preventing mechanism of this embodiment are different from those of the fifth embodiment. One set of the movable half backrest 120 and the movable mechanism 260 will be explained in the following description, and the explanation of the other set will be omitted because said two sets have similar constructions.

As shown in FIG. 34, a movable mechanism 260 which supports a movable half backrest 120 moveably on a head board 216 includes one metal arm 261. The base end portion of said arm 261 are pivoted, turnably in a horizontal plane, with a shaft 263 to a bracket 262 of said head board 216. The movable half backrest 120 is coupled to one end of arm 261 turnably in a horizontal plane via a position controlling and break preventing mechanism.

More specifically as shown in FIGS. 35 and 36, a plate member 264 is put on the upper side of end of said arm 261 moveably, and a round aperture 265 is formed in a base side of plate member 264 and arm 261 just under the member. An oval aperture 266 is formed in the top end side of the plate member 264.

A first supporting shaft 267 is turnably engaged with said round aperture 265 of the arm 261 and the plate member 264, so that the movable half backrest 120 is supported such that the angle of backrest is adjusted by rotating both ends of the backrest on said first supporting shaft 267.

Upper end portion of the first supporting shaft 267 is pivoted with a shaft 271 to a supporting bracket 270 mounted on the back of movable half backrest 120, so that the movable half backrest 120 on which the supporting bracket 270 is mounted is in the state that it is coupled to the top end of the first supporting shaft 267 engaged with the arm 261 turnably in vertical plane. A spring 268 is provided to the upper portion of the first shaft 267.

A guide bracket 269 is fastened to the lower end portion of first supporting shaft 267 and formed with an arc slit **269*a* that the center of the circle of the arc is on said shaft 271. A projecting pin 272 which is mounted on the lower portion of said supporting bracket 270 is engaged with said arc slit 269*a* so that the pin 272 and the guide bracket may move relatively. Therefore, said guide bracket 269 serves as a guide so that supporting bracket 270 or movable half backrest 120 may rock in vertical direction on the shaft 271 supporting the upper end portion of the first supporting shaft 207**.

A second supporting shaft 273 is fastened to the upper surface portion of the supporting bracket 270 and extends downwardly. The lower end portion of the second supporting shaft 273 is inserted into above mentioned oval aperture 266 of the plate member 264 moveably each other so that the rocking of the part of the supporting bracket 270 may not be prevented. On the other hand the upper end of the second supporting shaft 273 is formed with a screw portion **273*a* which is engaged with an adjusting nut 274 turnably. Said adjustable nut 274 adjusts the support angle of the supporting bracket 270 against the arm 261 by the restoring force of spring 275. Even if each movable half backrest 120 is loaded with excessive weight said movable mechanism 260 is prevented from been broken because the springs 268,275** absorb said excessive weight.

As shown in FIG. 34, the screw type stopper 278 which touches the side face of the base end portion when the movable half backrest 120 is in the second position is provided to the bracket 262. Said stopper 278 sets a final position of straight extending arm 261 which is turned in a horizontal plane at the movable shaft 263 by appropriately adjusting the tip projection of the stopper 278 by a screwdriver, thereby adjusting a position of movable half backrest 120 on the second location in the front and back direction.

As described above, the position controlling and break preventing mechanism of movable mechanism 260 comprises a first supporting shaft 267 supporting movable half backrest 120, in vertically and in the front and back direction, through a supporting bracket 270 on the top end of an arm 261, a pivot shaft 271, a guide bracket 269, a second supporting shaft 273 and a stopper 278, etc.

Action of above-mentioned sofa-bed 211 of the sixth embodiment will described hereinafter.

If a user wants to move the movable half backrest 120 from the first position on the head board 116 (see FIG. 24) wherein said backrest is put away in the bed mode to the second position in the sofa mode, he may move it with ease from the first position to the second (or reverse) manually in a manner similar to that of the sofa-bed of fifth embodiment.

Thus the arm 261 is positioned to be almost perpendicular to the head board 216 as illustrated in FIG. 34. Even if the movable half backrest 120 in the second position is tilted to the vertical direction on account of unevenness of accuracy of woodwork, the inclination can be adjusted because the movable half backrest 120 is adapted to be rocked in some degrees vertically against the upper end portion of said arm 261 on the pivot shaft 271 of supporting bracket 270 mounted to the back of the backrest 120. Then the vertical angle adjustment of the movable half backrest 120 can be done easily by turning the adjusting nut in the optional direction. Furthermore the angle adjustment of the backrest 120 in the front and back direction is possible because said backrest 120 is adapted to turn about the first supporting shaft 267 in the front and back direction.

Furthermore in the sofa mode, even if the movable half backrest 120, is loaded with excessive weight, said backrest 120 is prevented from been broken because the springs 268,275 of the position controlling and break preventing mechanism absorb said excessive weight. Then the arm 261 tilted by excessive load temporarily is returned to the horizontal position immediately by the restoring force of said springs 268,275.

Referring to FIGS. 37–42, there is shown a seventh embodiment of a sofa-bed 300 of the present invention. The members and portions similar to those of other embodiments are designated by the same characters and their repeated explanation will be omitted.

Figure 37:
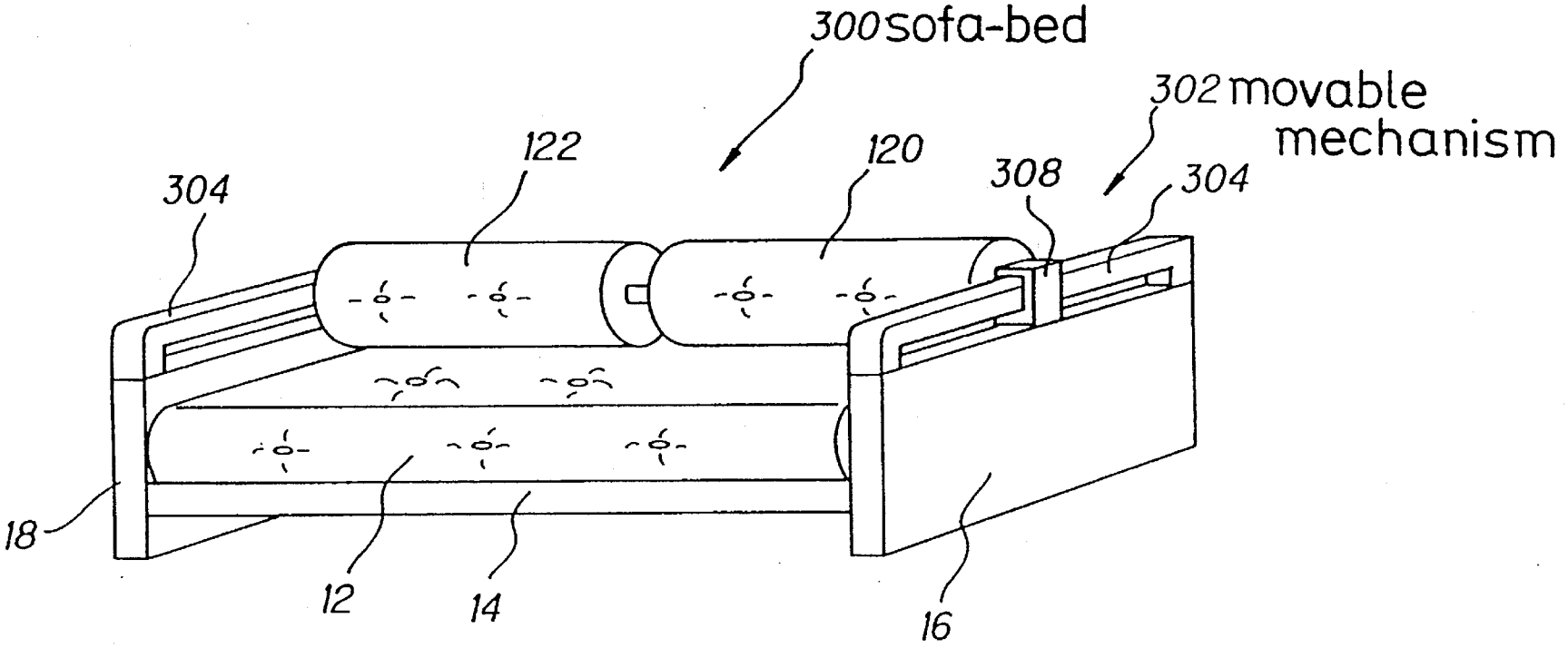
FIG. 37 is a perspective view illustrating a seventh embodiment of the sofa-bed of this invention as it is used in a sofa mode.
Figure 38:
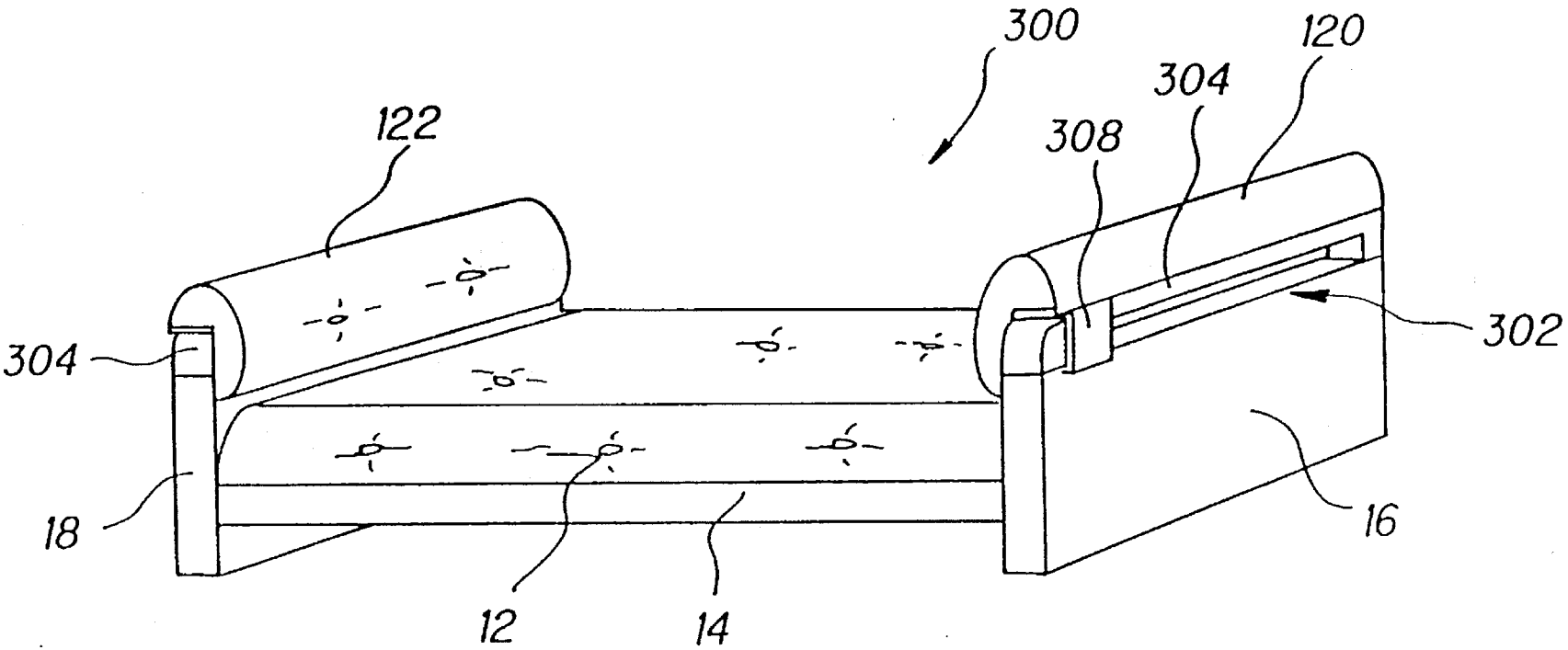
FIG. 38 is a perspective view illustrating the seventh embodiment of the sofa-bed of this invention as it is used in a bed mode.

Although a sofa-bed 300 of this embodiment uses also in a bed mode shown in FIG. 38 and a sofa mode in FIG. 37 and an outward appearance and a construction of this embodiment are almost similar to those of the second embodiment, this embodiment is not an electric type and construction of movable mechanism 302 is different from that of the second embodiment. One set of the movable half backrest 120 and the movable mechanism 302 will be explained in the following description, and the explanation of the other set will be omitted because said two sets have a similar construction.

Figure 39:
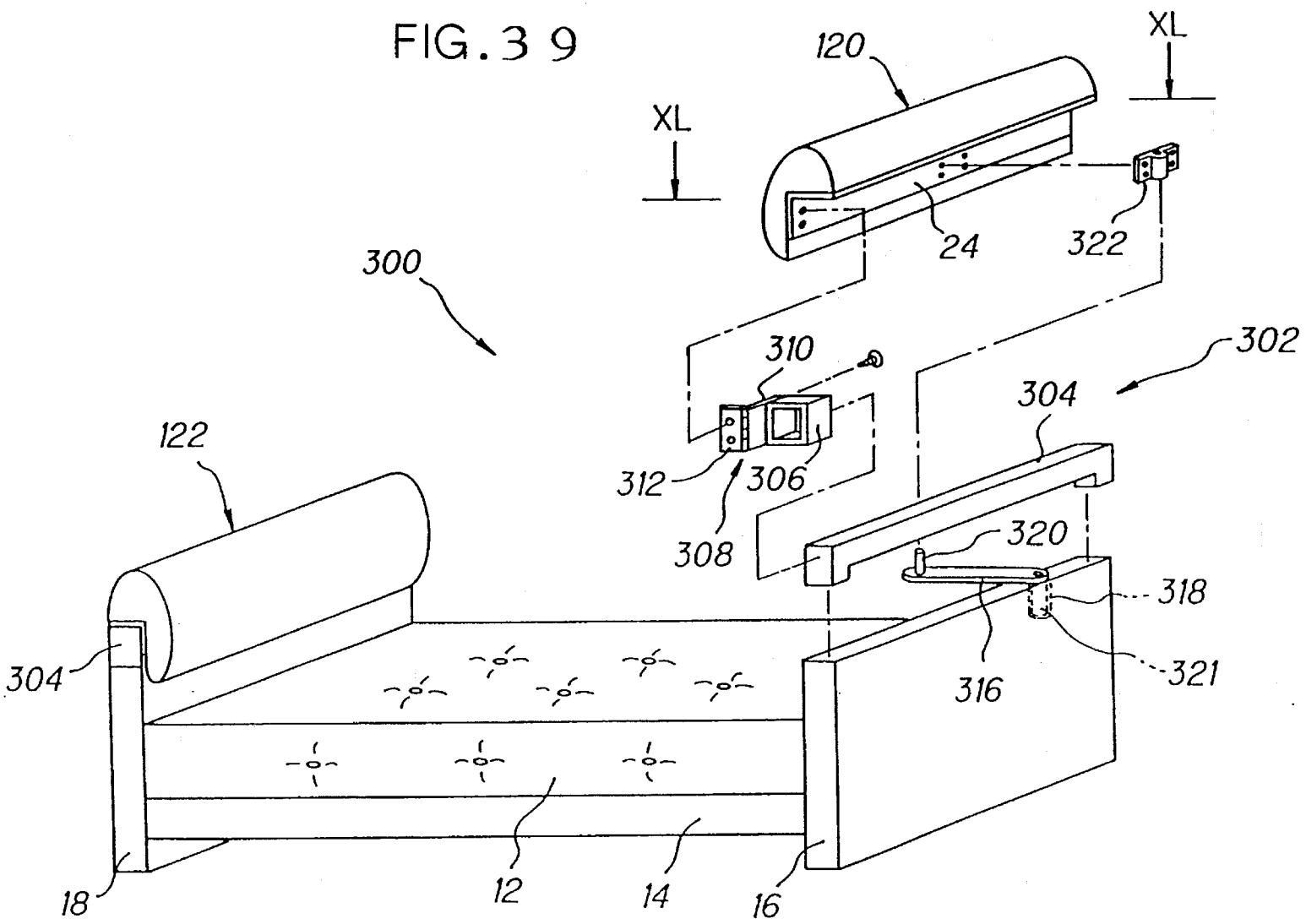
FIG. 39 is an exploded view in perspective of a movable mechanism of the seventh embodiment of this invention.

As illustrated in FIG. 39, a guide rail 304 included in said movable mechanism 302 is mounted on each top end portion of a head board 16 and a foot board 18. A slide block 306 is set on the outside of said guide rail 304 slidably in the lateral direction of the sofa bed.

Vertical section of said slide block 306 is like one of a hollow quadratic prism shown in the figure and a hinge plate 310, one part of hinge 308, is fixed to the side of slide block.

A hinge plate 312, the other part of hinge 308, is fastened to one end portion of base 24 of the movable half backrest 120 by screws and supports the backrest 120.

A bearing bracket 322 is fixed to the center of base 24 of movable half backrest 120 and a bearing aperture 318 is formed on the top end portion of head board 16 (below guide rail 304), and each of shafts 320,321 provided to both ends of crank arm 316 is turnably inserted into said bearing bracket 322 and said bearing aperture 318 and supports the center of movable half backrest 120. This crank arm 316 is adapted to be manually moved, and linked with a movement of said slide block 306 sliding in the lateral direction of the sofa bed, from the position in the bed mode shown in FIG. 40 to the position in the sofa mode shown in FIG. 42.

Action of above-mentioned sofa-bed 300 of the seventh embodiment will described hereinafter.

If the user wants to change the mode of sofa-bed 300 from the bed rood shown in FIG. 38 to the sofa mode in FIG. 37, he may operate as follows.

Figure 40:
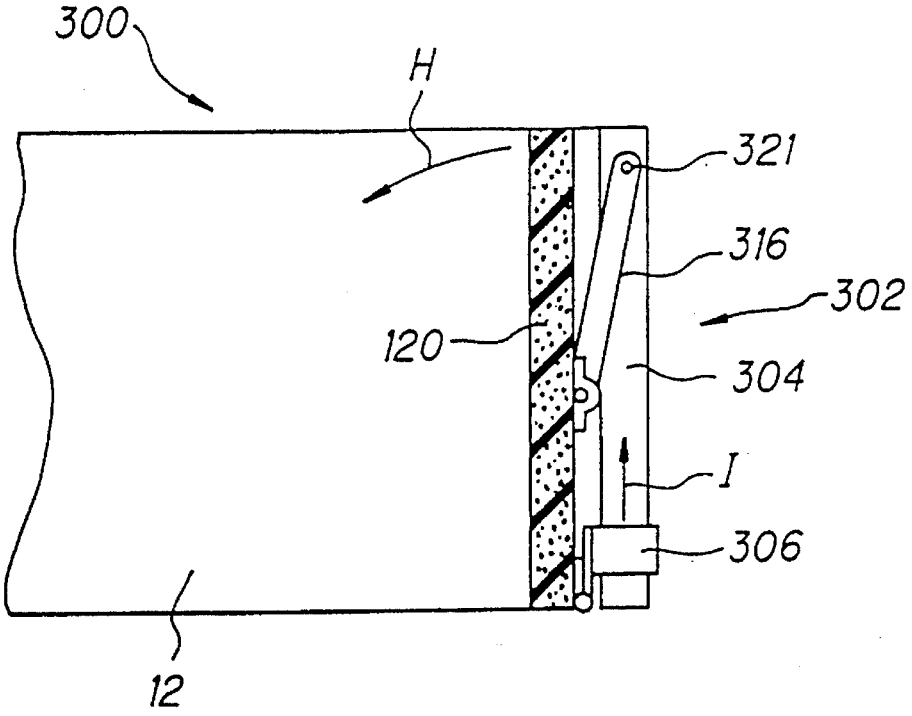
FIG. 40 is a horizontal sectional view illustrating a position of the movable half backrest of the seventh embodiment in a bed mode.
Figure 41:
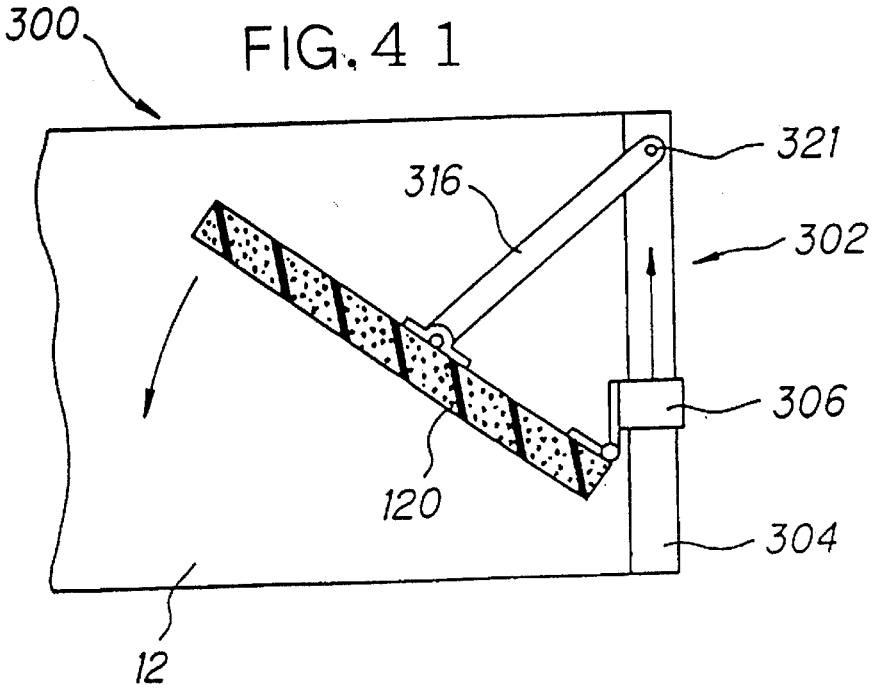
FIG. 41 is a horizontal sectional view illustrating an intermediate state of the movable half backrest of the seventh embodiment of this invention moving from the first position to the second.
Figure 42:
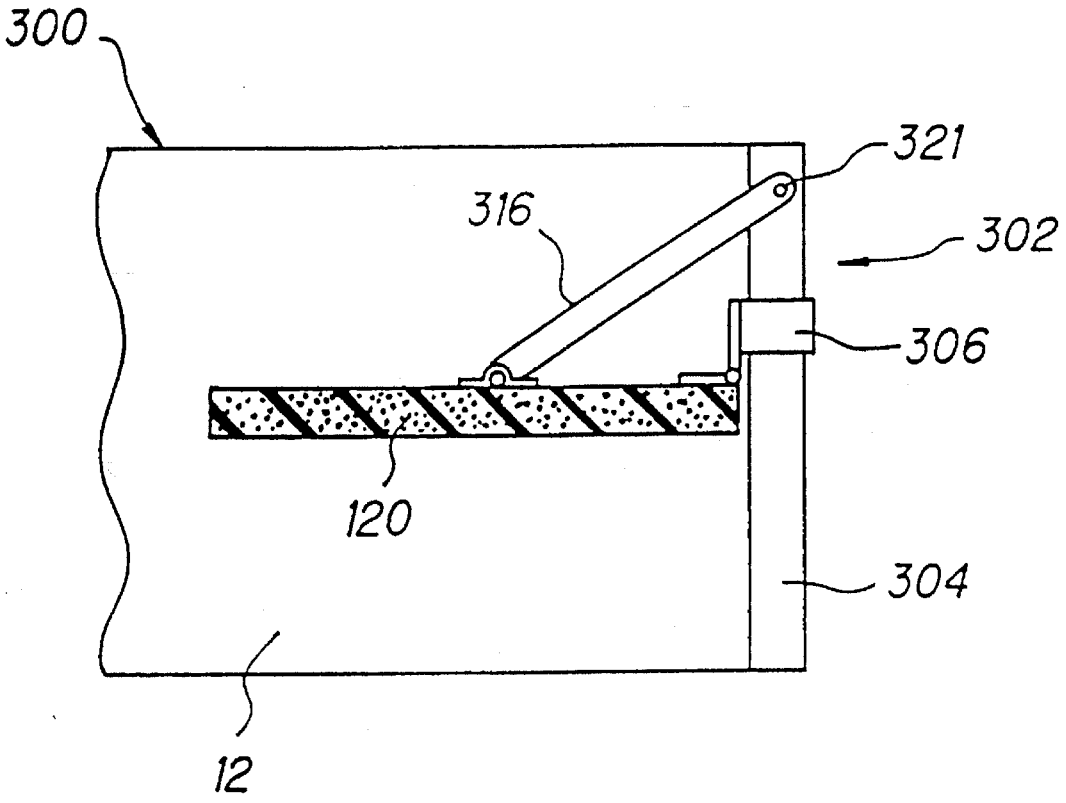
FIG. 42 is a horizontal sectional view illustrating a position of the movable half backrest of the seventh embodiment in a sofa mode.

As shown in FIG. 40, if the user moves the back end side of the movable half backrest 120 drawing it to himself manually along the direction designated by arrow "H", the crank arm 316 supporting the center of movable half backrest 120 moves to the position in the sofa mode illustrated in FIG. 42, through a state shown in FIG. 41, with linkage to the motion of the slide block 306 sliding from forward end side of guide rail 304 along the direction indicated by arrow "I".

If the user wants to change modes from the sofa mode shown in FIG. 37 to the bed mode shown in FIG. 38, he may change by doing the above described operation in reverse order. Thus the sofa-bed 300 of this embodiment can be changed from the sofa mode to the bed mode (or reversely), and so anyone can handle it easily. Both in the bed mode and the sofa mode said movable mechanism 28 is put away in the appropriate position so as not to be a nuisance and unsightly similarly to the above described various embodiments.

Referring to FIGS. 43–47, there is shown a eighth embodiment of a sofa-bed 400 of the present invention. The members and portions similar to those of other embodiments are designated by the same characters and their repeated explanation will be omitted.

Although an outward appearance and a construction of the sofa-bed of this embodiment are almost similar to those of the seventh embodiment, the construction of movable mechanism 402 of this embodiment is different from that of the fifth embodiment. One set of the movable half backrest 120 and the movable mechanism 402 will be explained in the following description, and the explanation of the other set will be omitted because said two sets have a similar construction.

Figure 43:
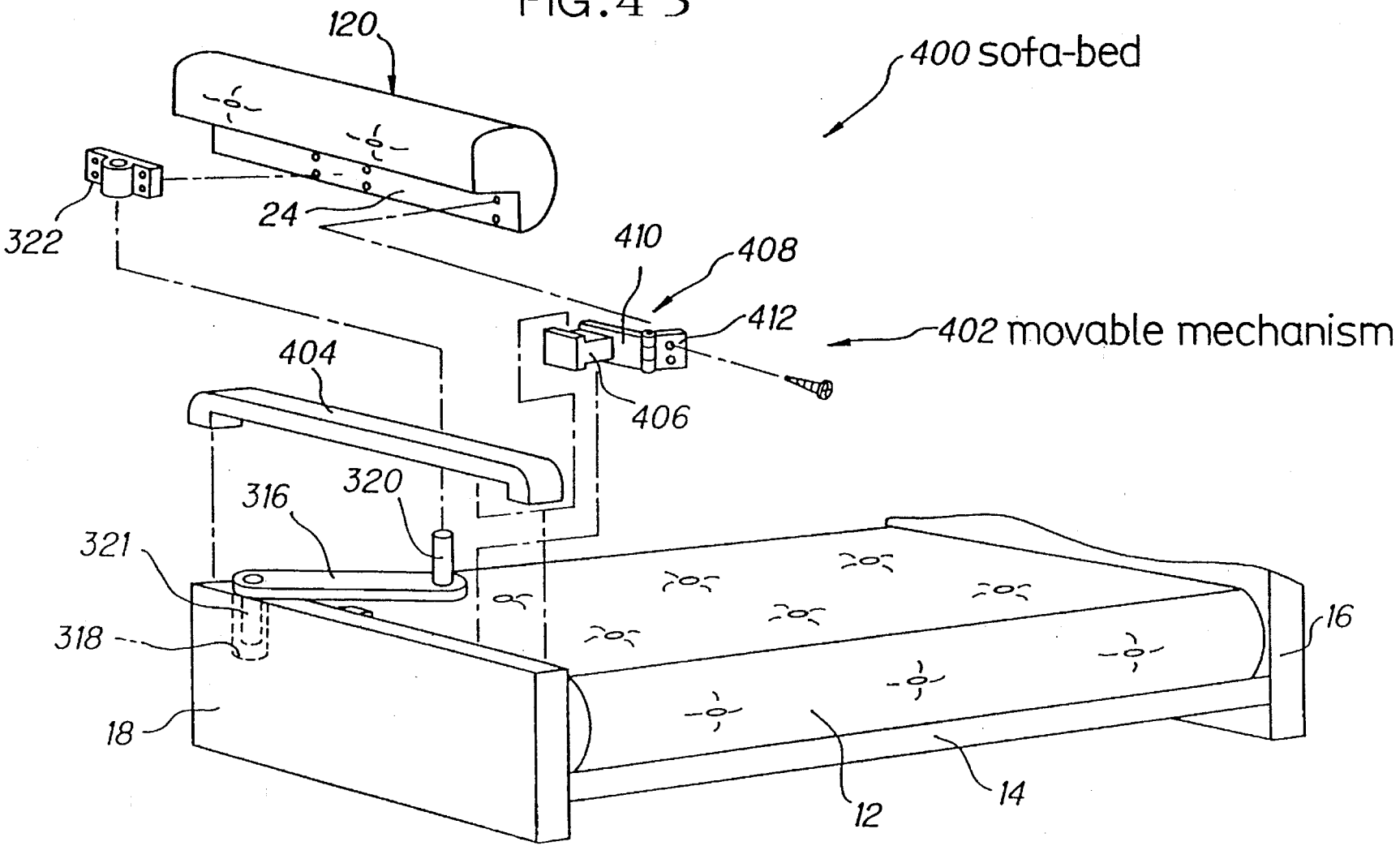
FIG. 43 is an exploded view in perspective of a movable mechanism of the eighth embodiment of this invention.

As illustrated in FIG. 43, a guide rail 404 included in said movable mechanism 402 is mounted on the top end portion of a foot board 18. A slide block 406 is set between a backrest surface of the foot board 18 and a lower end surface of the guide rail 404 slidably in the lateral direction of the sofa bed.

Figure 44:
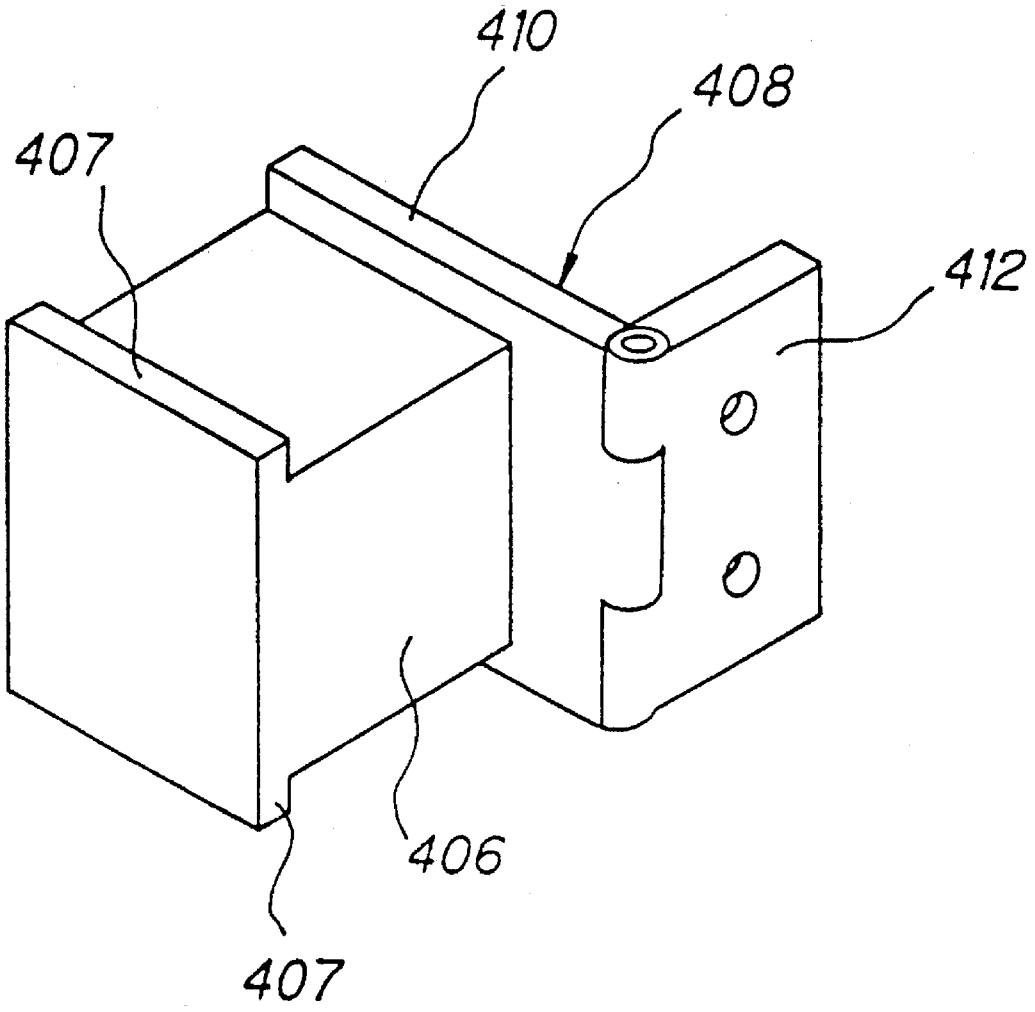
FIG. 44 is a perspective view illustrating a slide brick and a hinge, composition of the movable mechanism of the eighth embodiment.

As shown in FIG. 44, said slide block 406 is shaped as shown in the figure and stoppers 407,407 are formed on its one side portion for preventing itself from coming off from the space between said backrest surface of the foot board 18 and said lower end surface of the guide rail 404. A hinge plate 410, one part of hinge 408, is fixed to another side of slide block 406. A hinge plate 412, the other part of hinge 408, is fastened to one end portion of base 24 of the movable half backrest 120 by screws and supports the backrest 120. The center of movable half backrest 120 is moveably supported by crank arm 316.

Action of above-mentioned sofa-bed 400 of the eighth embodiment of the present invention will described hereinafter.

If the user wants to change the mode of sofa-bed 400 from the bed rood (see FIG. 38) to the sofa mode (see FIG. 37), he may operate as follows.

Figure 45:
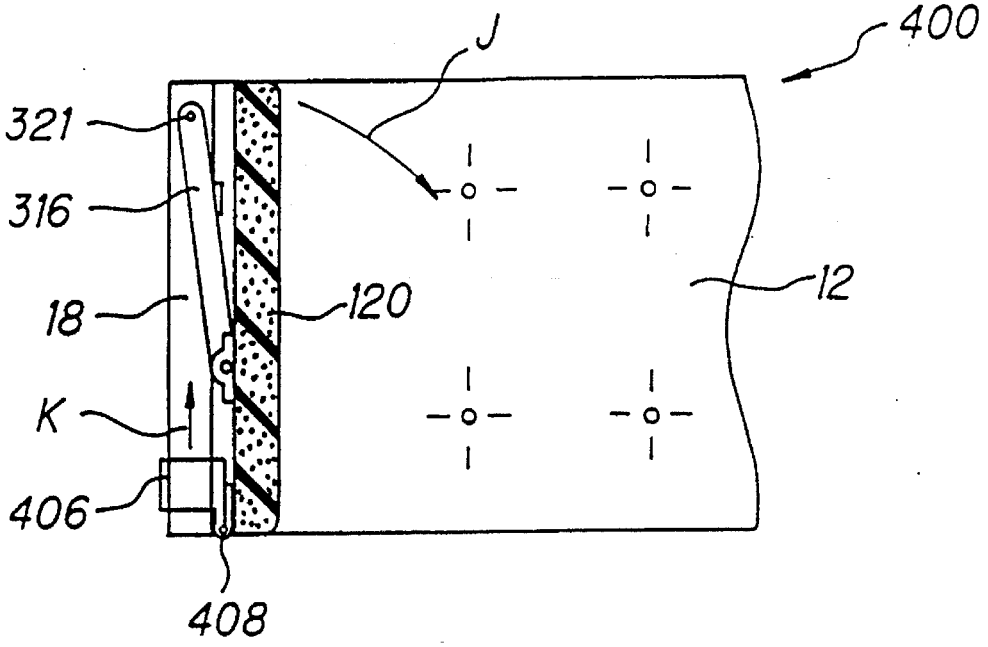
FIG. 45 is a horizontal sectional view illustrating a position of the movable half backrest of the eighth embodiment in a bed mode.
Figure 46:
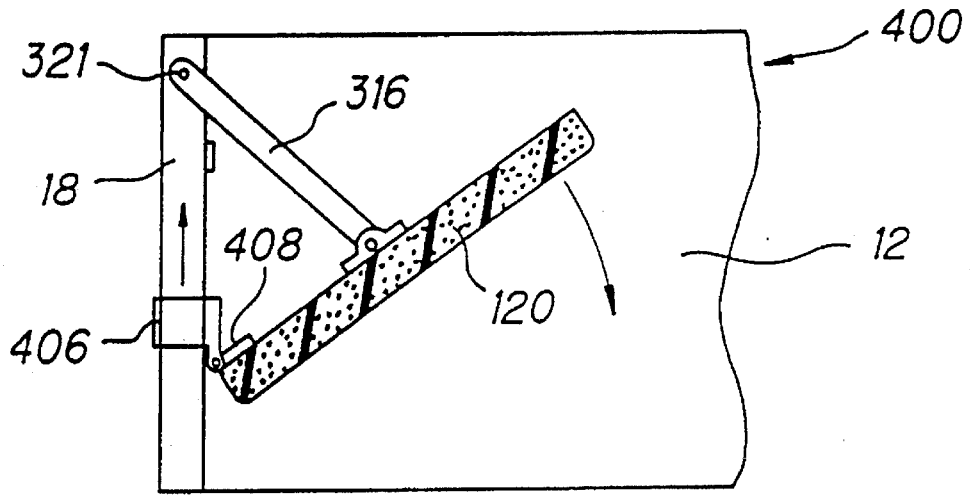
FIG. 46 is a horizontal sectional view illustrating an intermediate state of the movable half backrest of the eighth embodiment of this invention moving from the first position to the second.
Figure 47:
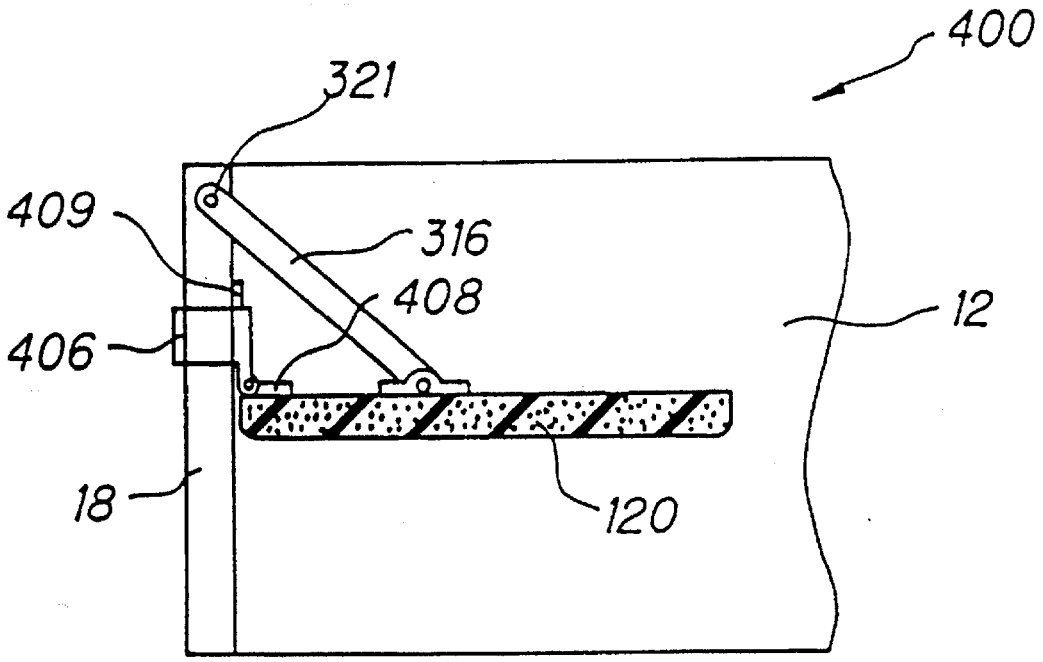
FIG. 47 is a horizontal sectional view illustrating a position of the movable half backrest of the eighth embodiment in a sofa mode.

As shown in FIG. 45, if the user moves back end side of the movable half backrest 120 by drawing it to himself manually along the direction designated by arrow "J", the crank arm 316 supporting the center of movable half backrest 120 moves to the position in the sofa mode illustrated in FIG. 47, through a state shown in FIG. 46, with linkage to the motion of the slide block 406 sliding from forward end side of the guide rail 404 along the direction indicated by arrow "K". If the user wants to change modes from the sofa mode to the bed mode, he may change it by doing the above described operation in reverse order.

Figure 48:
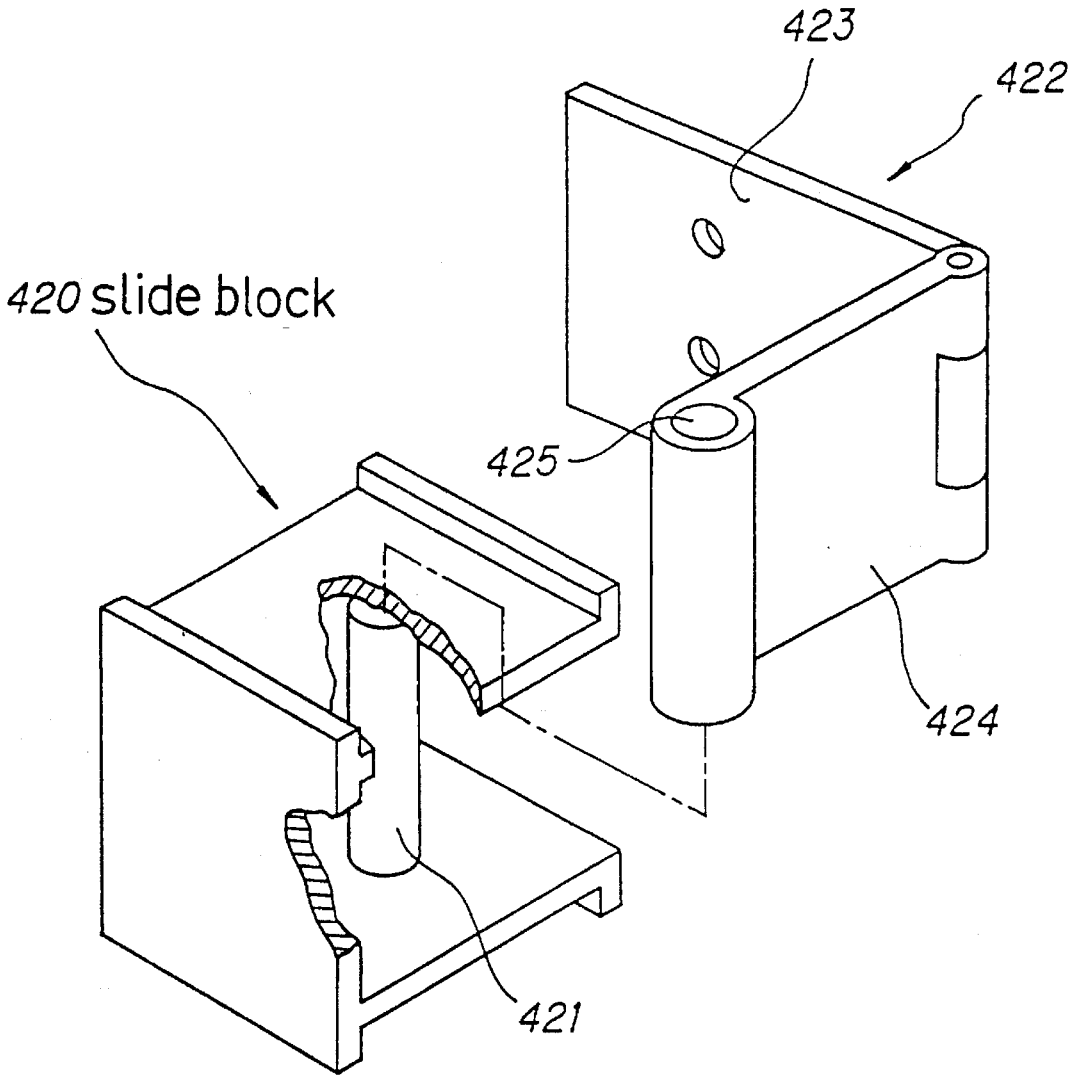
FIG. 48 is a perspective view illustrating a slide brick and link as an alternative embodiment of the eighth embodiment.
Figure 49:
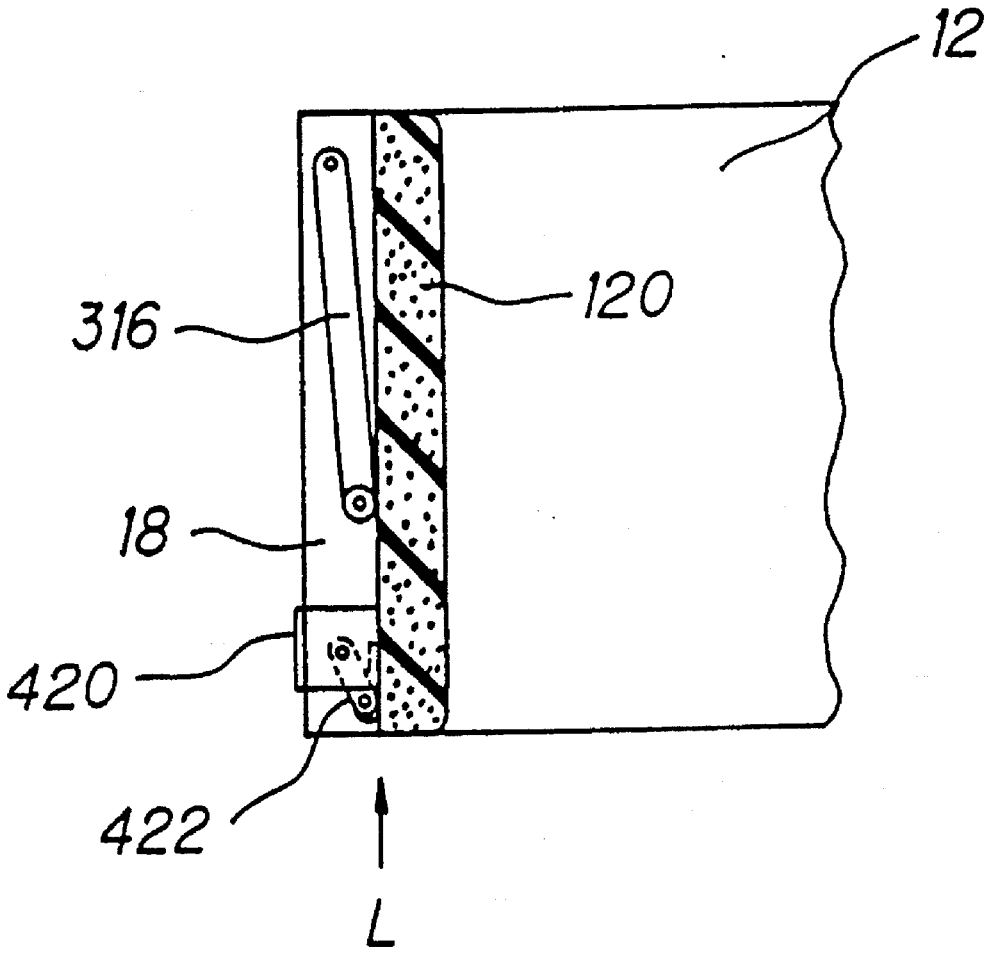
FIG. 49 is a horizontal sectional view illustrating a position of the movable half backrest of the alternative embodiment of the eighth embodiment in a bed mode.

FIGS. 48 and 49 illustrate a modified slide block and a hinge of sofa-bed 400 of the eighth embodiment.

As shown in FIG. 48, a pivot pin 421 is fixed in the inner hollow portion of the slide block 420 and said pivot pin 421 inserted turnably into the bearing 425 of one link plate 424 of the link 422. The other link plate 423 of link 422 is fastened to one end portion of base side of the movable half backrest 120 by screws(not shown).

Even if the user looks into the space between the foot board 18 and the movable half backrest 120 from the direction indicated by arrow "L" when the backrest 120 is in the first position as shown in FIG. 49, the link 422 in said space is completely hidden and so the sofa-bed looks nice.

Figure 50:
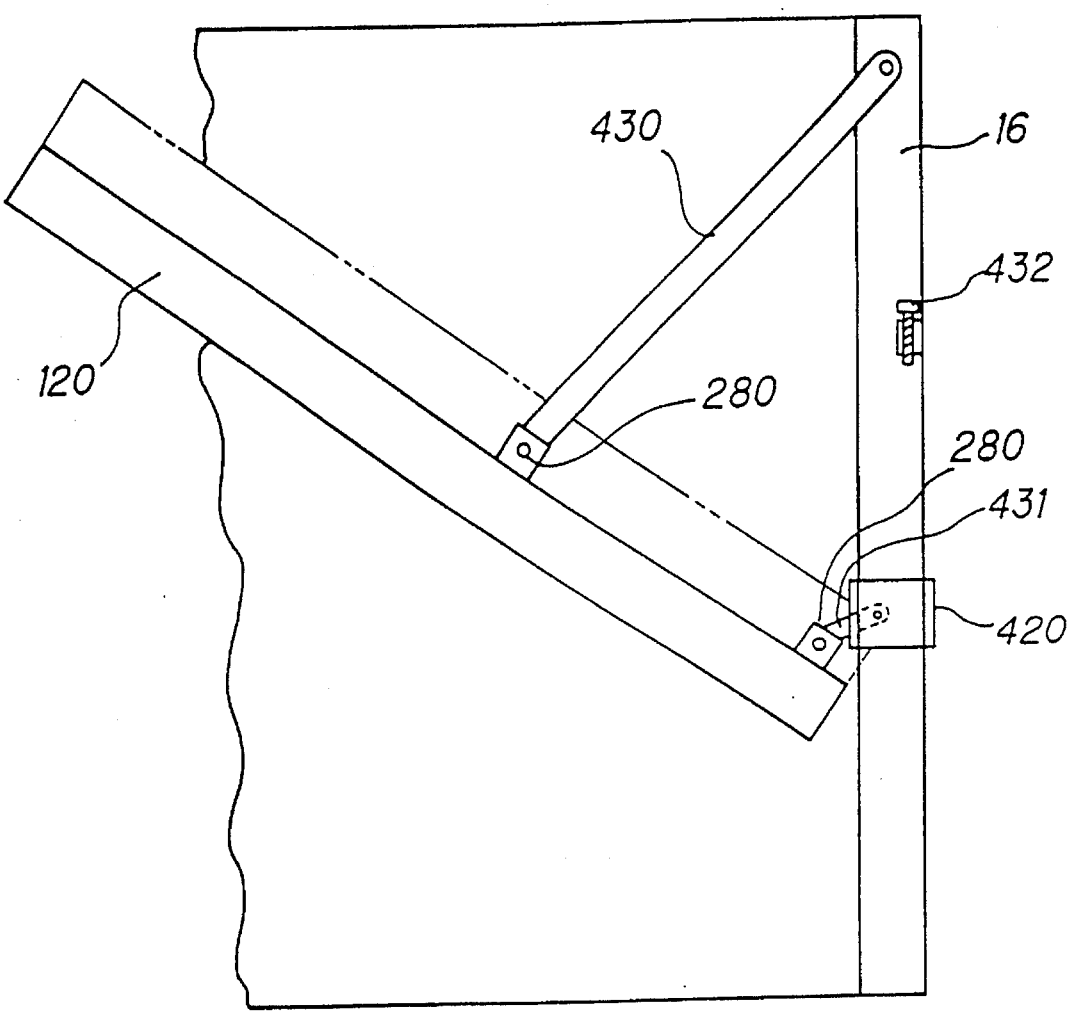
FIG. 50 is an operational diagram showing an intermediate state of the movable half backrest of the ninth embodiment of this invention moving from the first position to the second.
Figure 51:
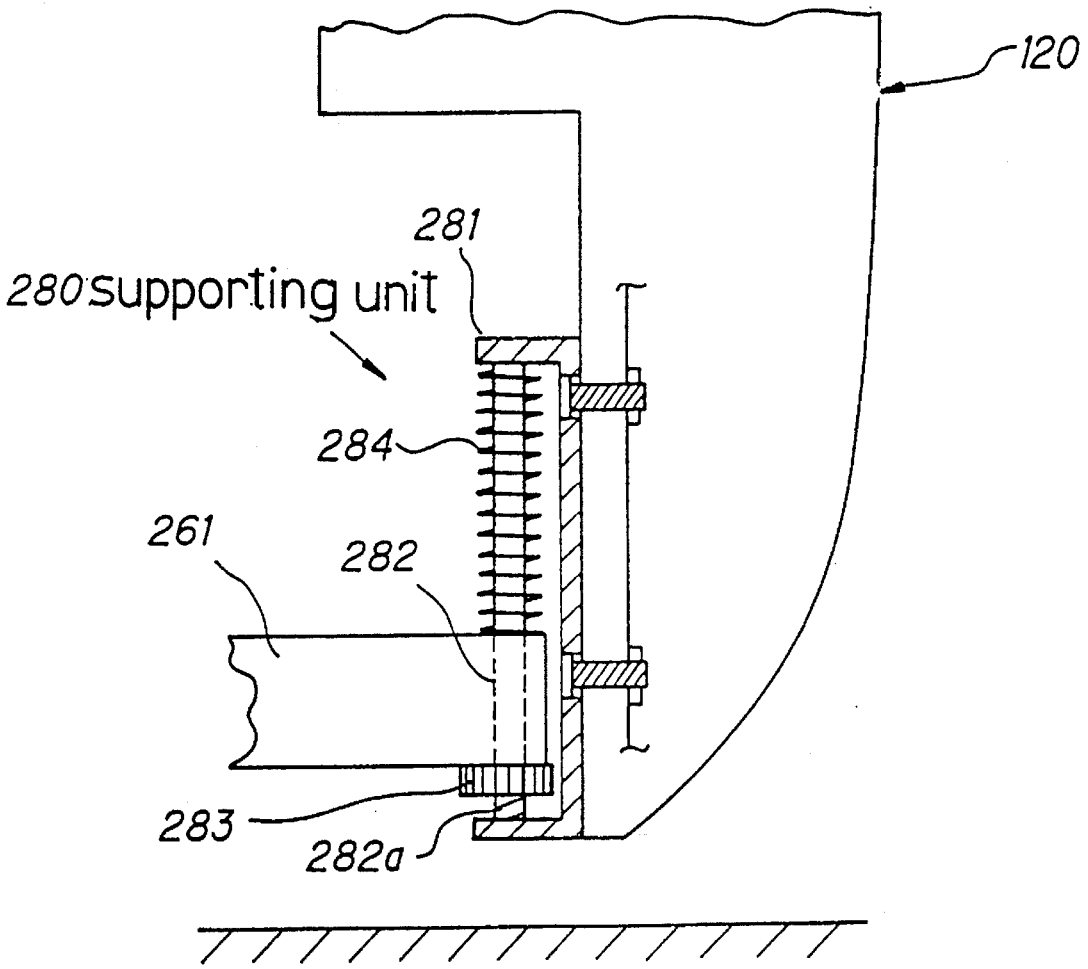
FIG. 51 is a sectional view showing an arm coupled to the movable half backrests of the ninth embodiment through a support unit.
Figure 52:
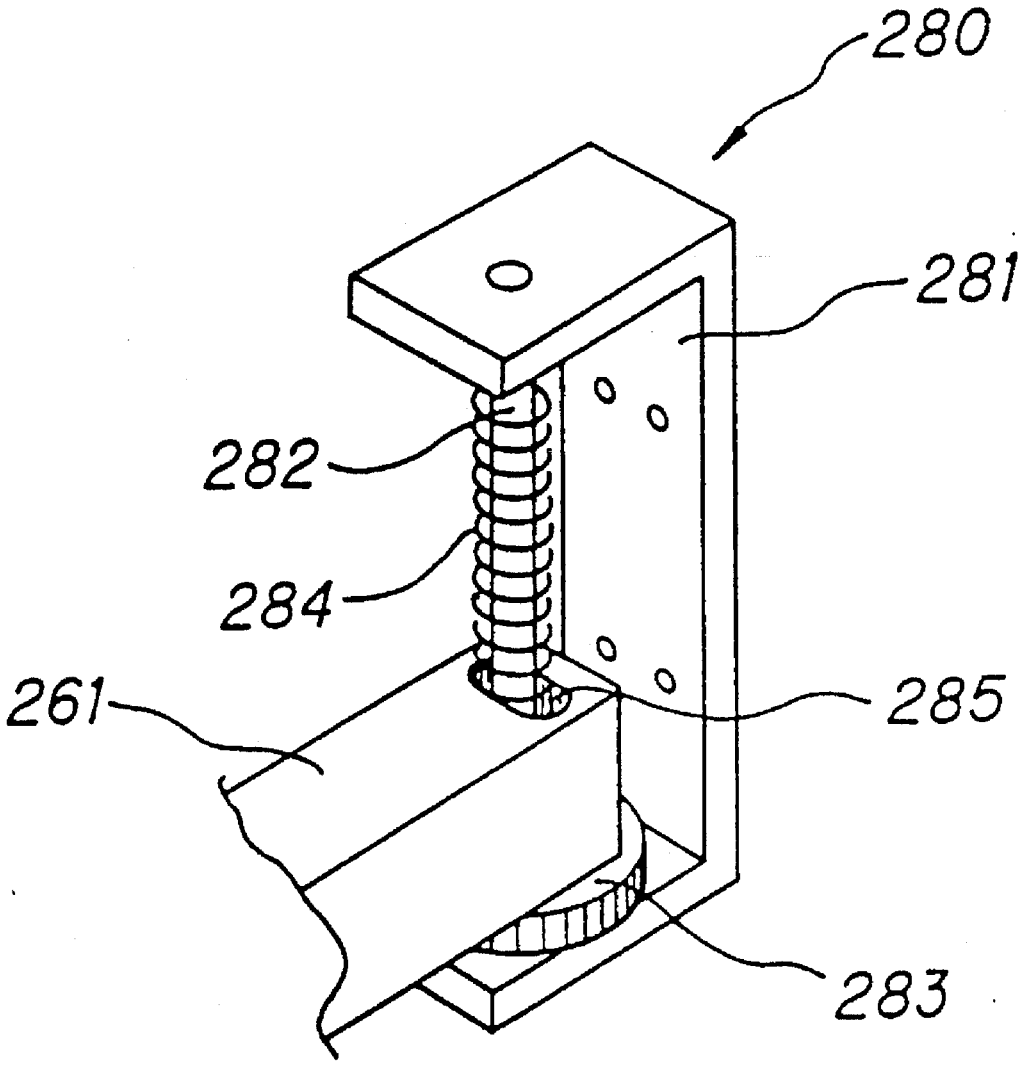
FIG. 52 is a perspective view showing the support unit of the ninth embodiment.

Referring to FIGS. 50–52, there is shown a ninth embodiment of a sofa-bed of the present invention. The members and portions similar to those of other embodiments are designated by the same characters and their repeated explanation will be omitted.

As shown in FIG. 50, an arm 430 is turnably coupled to one end of upper portion of head board 16 and a central portion of backrest 120 is supported at a top end of arm 430 through a supporting unit 280 to be able to rock in the horizontal direction. At the top end portion of link 431 turnably mounted on a slide brick 406, one end portion of the movable half backrest 120 is supported through the supporting unit 280 to be able to rock in the horizontal direction.

As shown in FIGS. 51 and 52, the supporting unit 280 includes a bracket body 281, a shaft 282 supported perpendicularly on said bracket body 281, an adjustable nut 283 turnably provided to the threaded portion 282*a* formed in the lower end side of said shaft 282 and a spring 284 provided to the shaft 282.

Each of the top end portion of the arm 430 and the link 431 is formed from an oval aperture 285, and the arm 430 and the link 431 are supported by the shaft 282 inserted into them so that they may be in the position between the adjustable nut 283 and the spring 284. A screw stopper 432 for adjusting the angle of the movable half backrest 120 in the right and left direction is provided to the head board 16.

Referring to FIGS. 53–57, there is shown a tenth embodiment of a sofa-bed 810 of the present invention. The members and portions similar to those of fifth embodiment is designated by the same characters and their repeated explanation will be omitted. One set of the movable half backrest 120 and the movable mechanism 240 will be explained in the following description, and the explanation of the other set will be omitted because said two sets have a similar construction.

Both in the bed mode and the sofa mode, an outward appearance and a construction of this embodiment of the sofa-bed are almost similar to those of the fifth embodiment and also the movable mechanism 240 is similar to that with the exception that of the embodiment the movable half backrest 120 is moveably coupled to the movable mechanism 240 on a substantially upper position than the first and second position.

Figure 55:
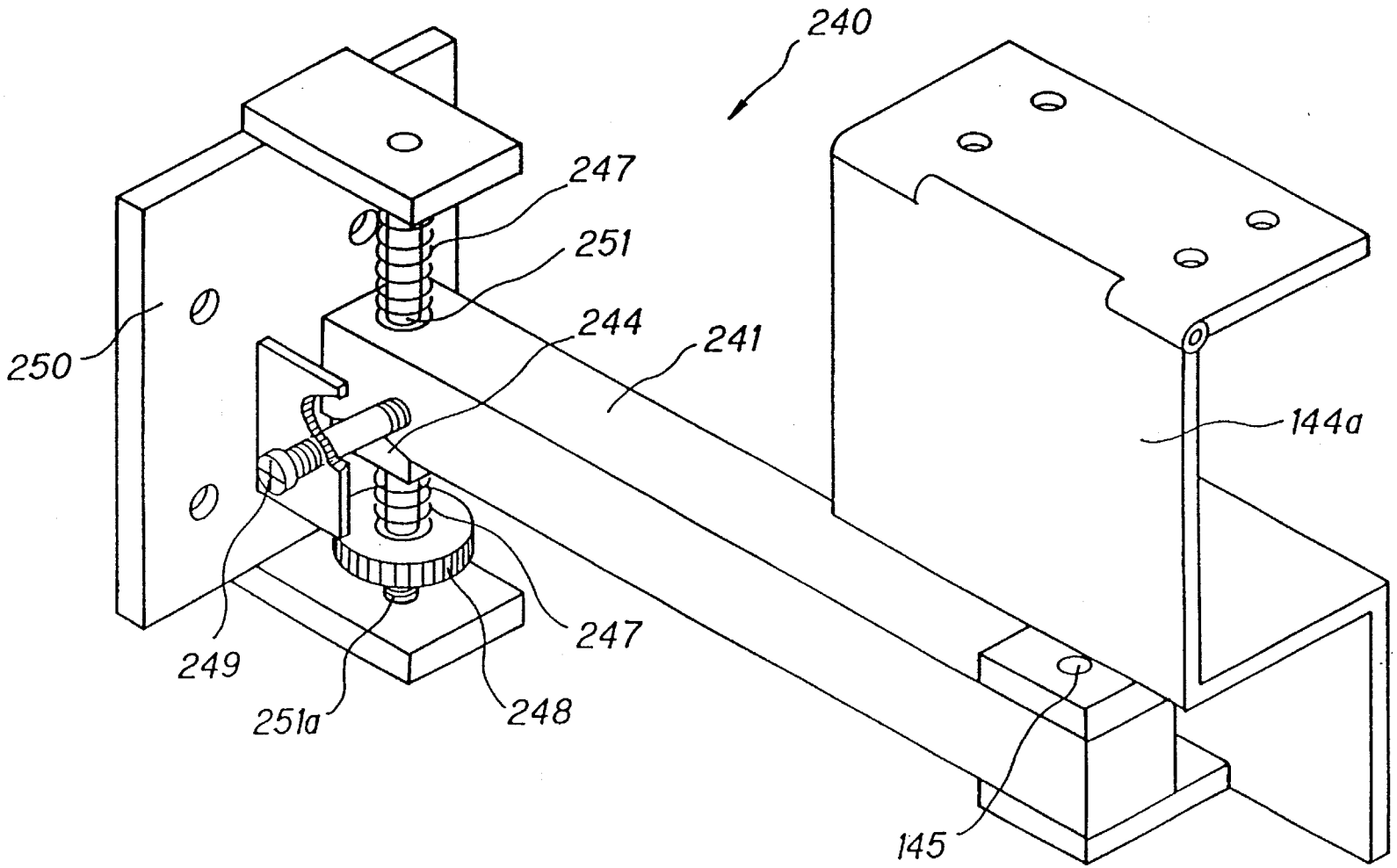
FIG. 55 is an enlarged perspective view illustrating a movable mechanism and a hinge bracket of the tenth embodiment.
Figure 56:
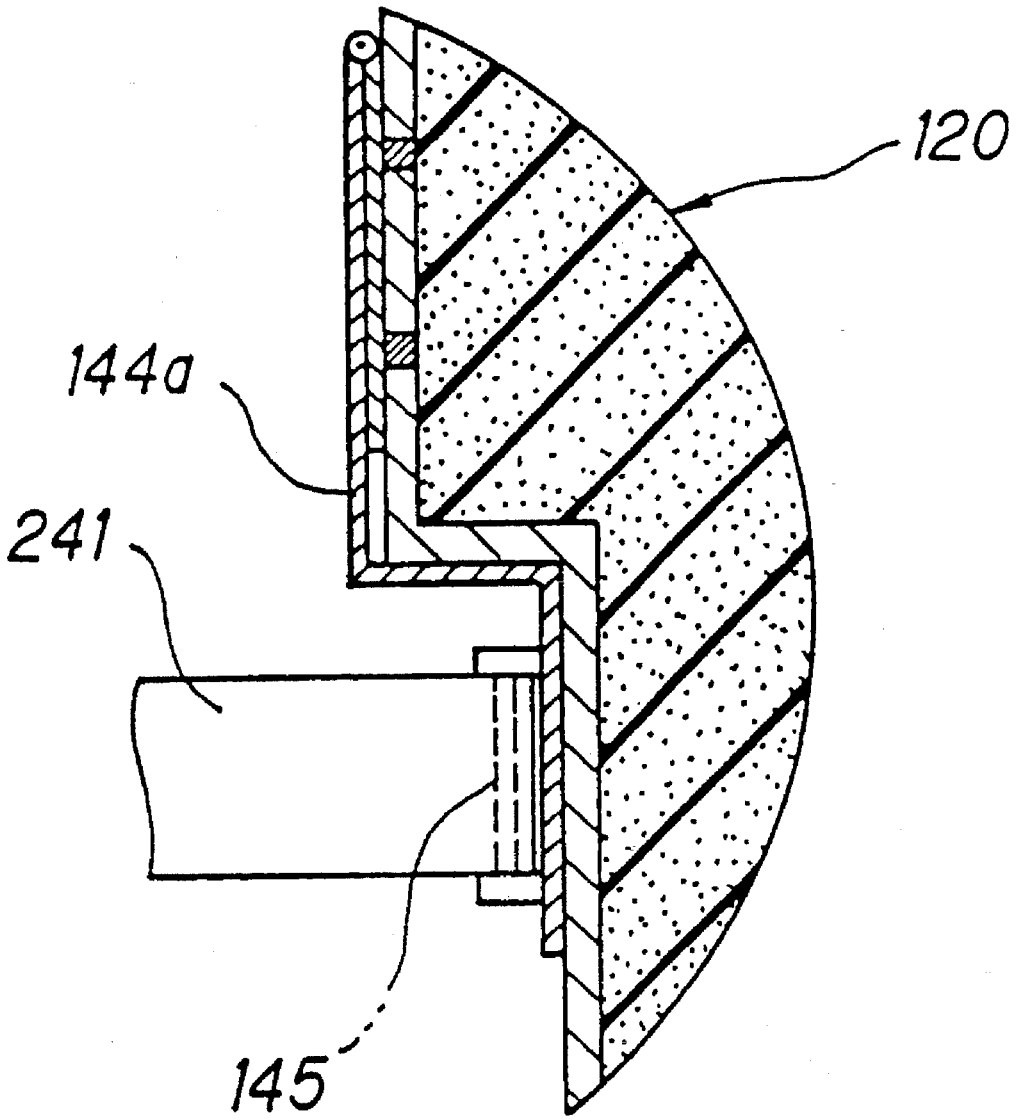
FIG. 56 is a side view illustrating a state of a movable half backrest of the tenth embodiment being positioned in the first position (the second position).
Figure 57:
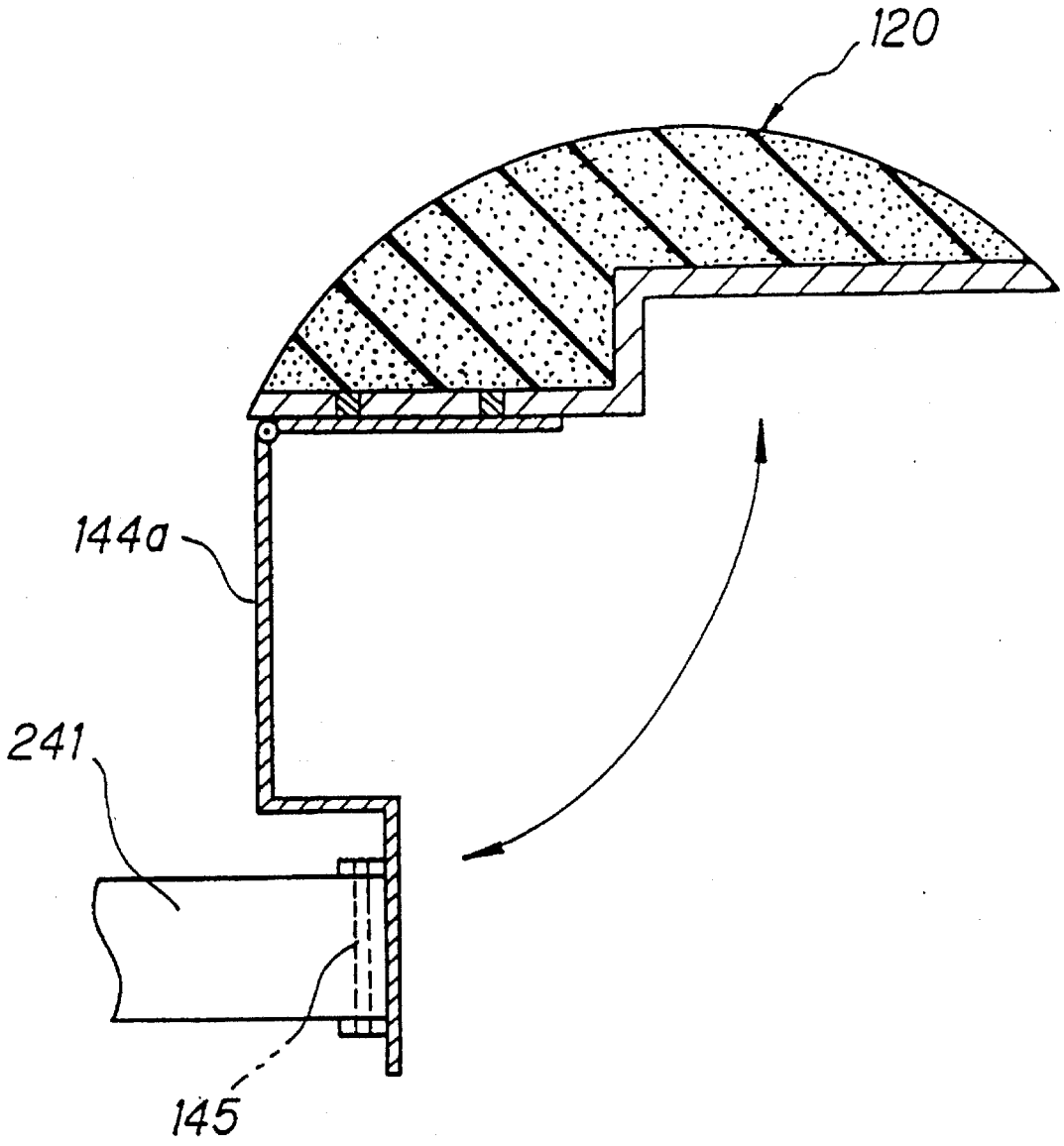
FIG. 57 is a side view illustrating a state of a movable half backrest of the tenth embodiment substantially being positioned above the first position (the second position).

As shown in FIG. 55, a hinge bracket 144*a* mounted to the back of movable half backrest 120 is coupled to the top end portion of an arm 241 of the movable mechanism 240 through the shaft 145 turnably in the horizontal direction. This hinge bracket 144*a* is provided for the movable half backrest 120 to move from the first position (or the second position), as shown in FIG. 56, to a higher position than the first (or the second) position as shown in FIG. 57.

Action of above-mentioned sofa-bed 810 of the tenth embodiment of the present invention will described hereinafter.

Figure 53:
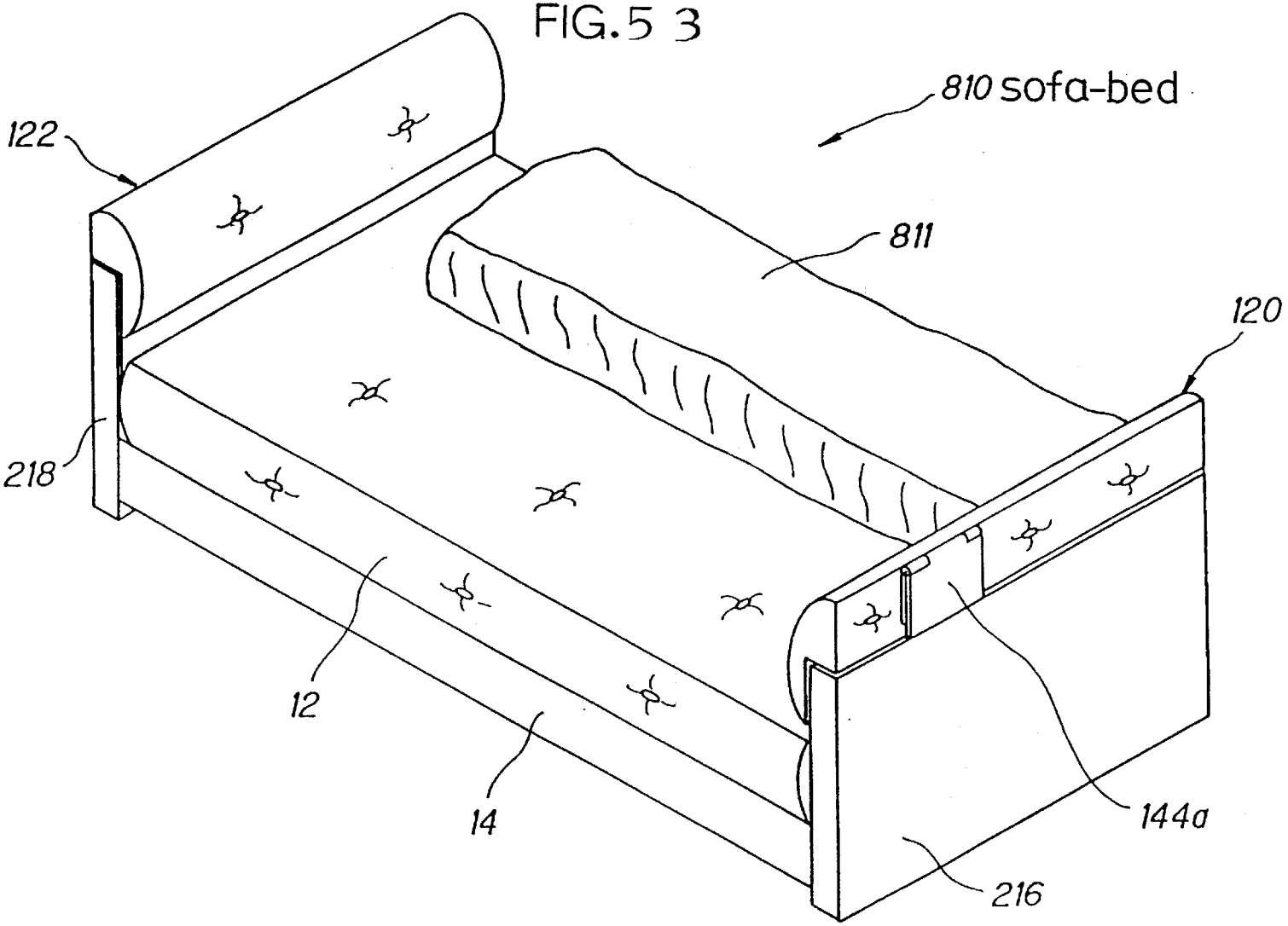
FIG. 53 is a perspective view illustrating a tenth embodiment of the sofa-bed of the present invention being in a bed mode, and a state in which bedding on the mattress is folded in half along its longitudinal direction.
Figure 54:
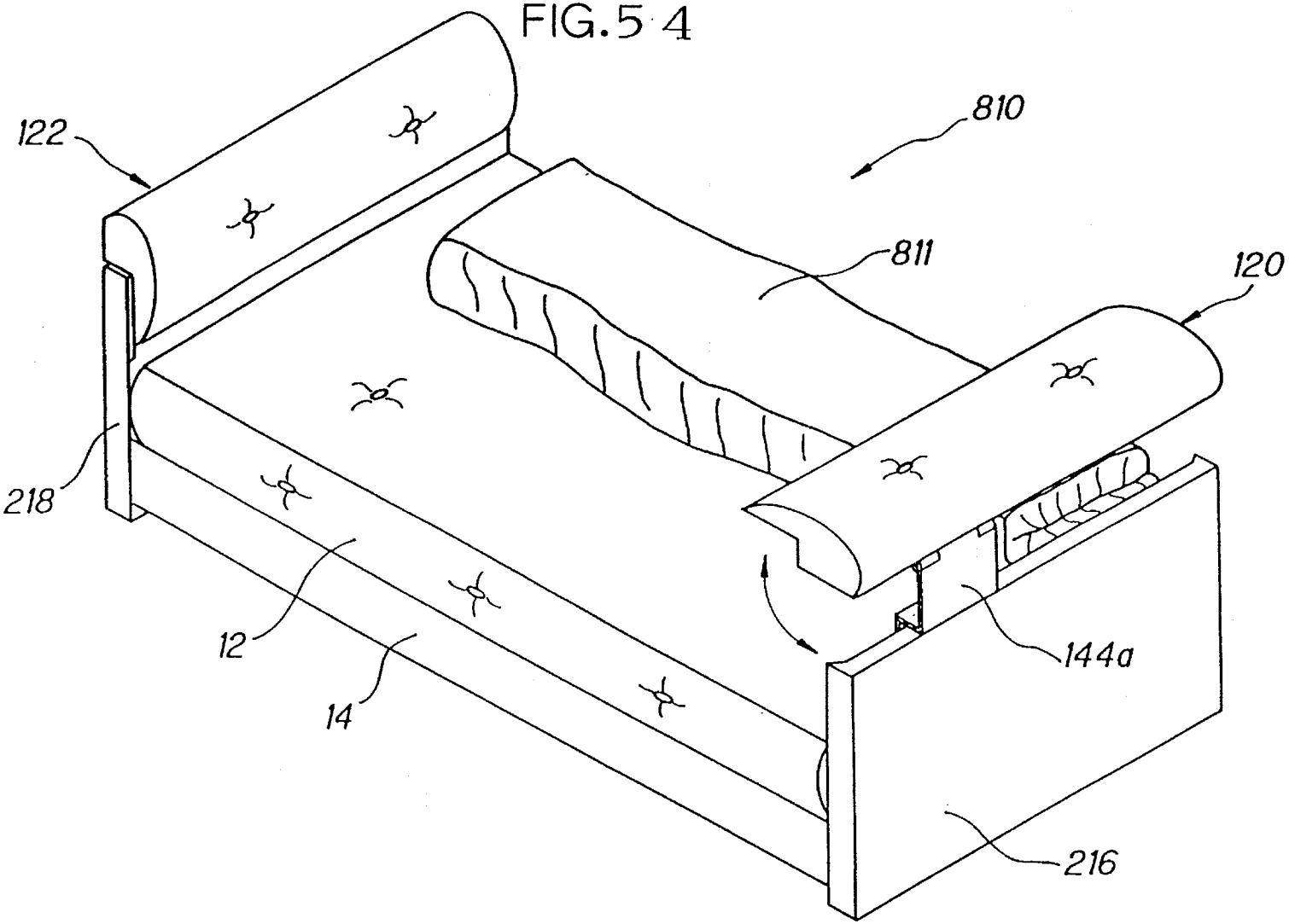
FIG. 54 is a perspective view illustrating a state of a movable half backrest of the tenth embodiment substantially positioned above the first position.

As shown in FIG. 53, if the user wants to change the sofa-bed from the bed mode to the sofa mode, he needs to fold the bedding 811, on the mattress 12, in half along the longitudinal direction of the sofa bed. Then, as shown in FIG. 54, he needs to move the movable half backrest 120 from the first position, to the higher position above the first position with hinge bracket 144*a*.

In this state (see FIG. 57), even if the user moves the movable half backrest 120 from the first position side to the second position side with the movable mechanism 240 in the horizontal direction, the backrest 120 does not touch said folded bedding 811 located under the backrest 120. Therefore when the user moves the sofa-bed 810 from the position of the bed mode to the position of the sofa mode, the bedding 811 on the mattress 12 is not to be an obstacle and he may move the backrest 120 easily from the first position to the second position.

Referring to FIGS. 58–63, there is shown an eleventh embodiment of a sofa-bed 510 of the present invention.

Figure 58:
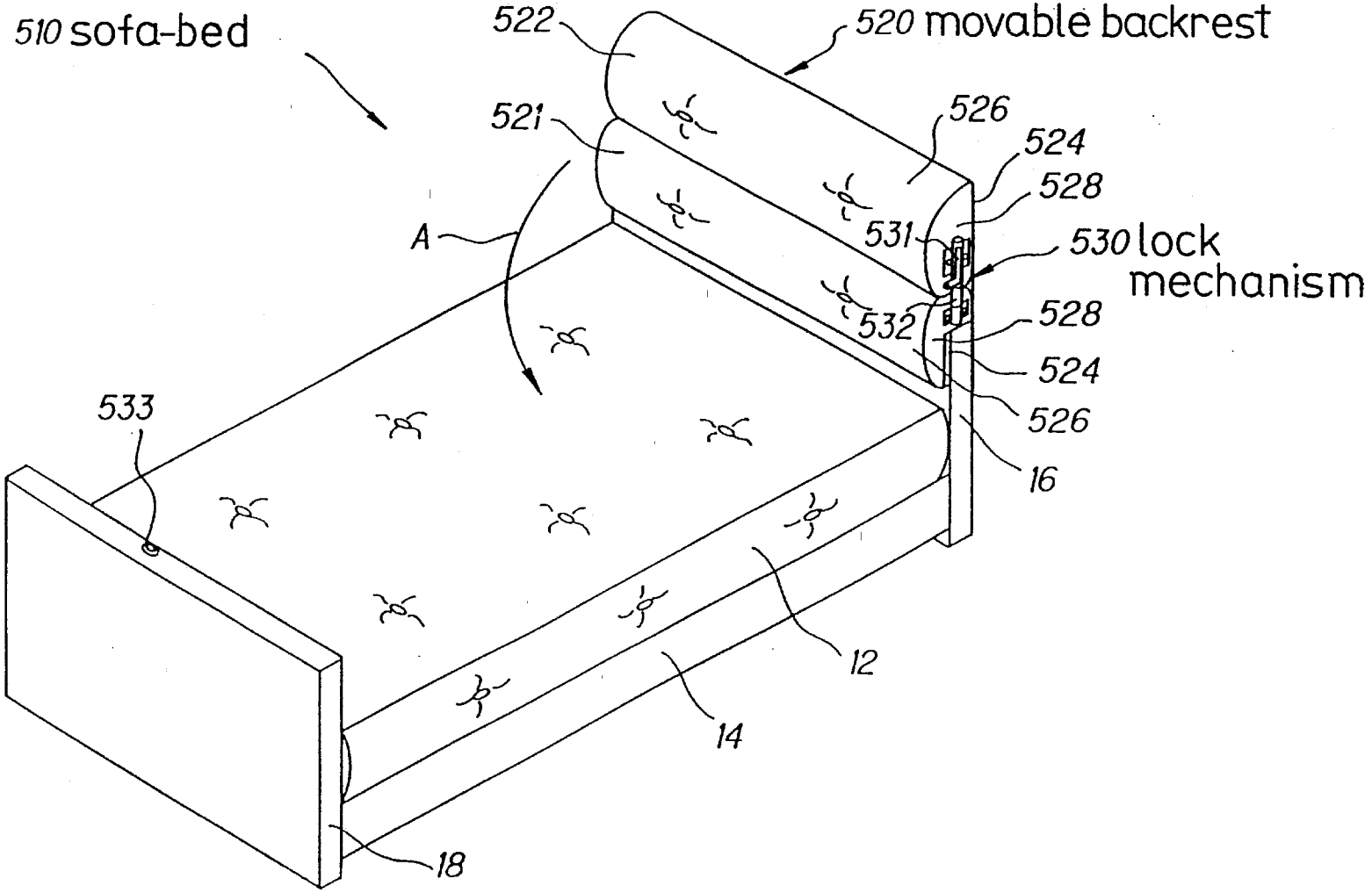
FIG. 58 is a perspective view illustrating a state of an eleventh embodiment of the sofa-bed of this invention as it is used in a bed mode.
Figure 59:
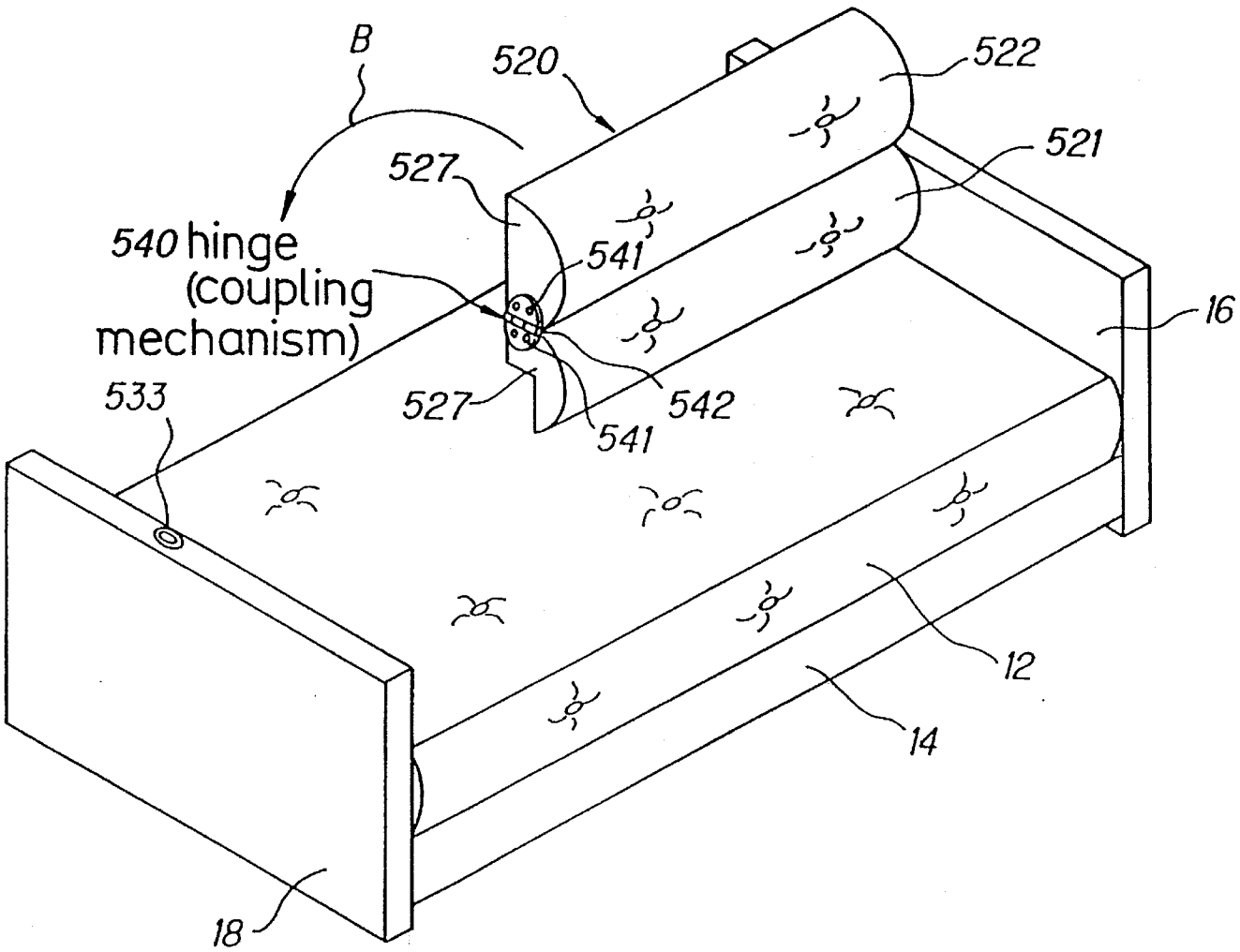
FIG. 59 is a perspective view illustrating a state of a movable backrest of the eleventh embodiment being positioned in the intermediate position.
Figure 65:
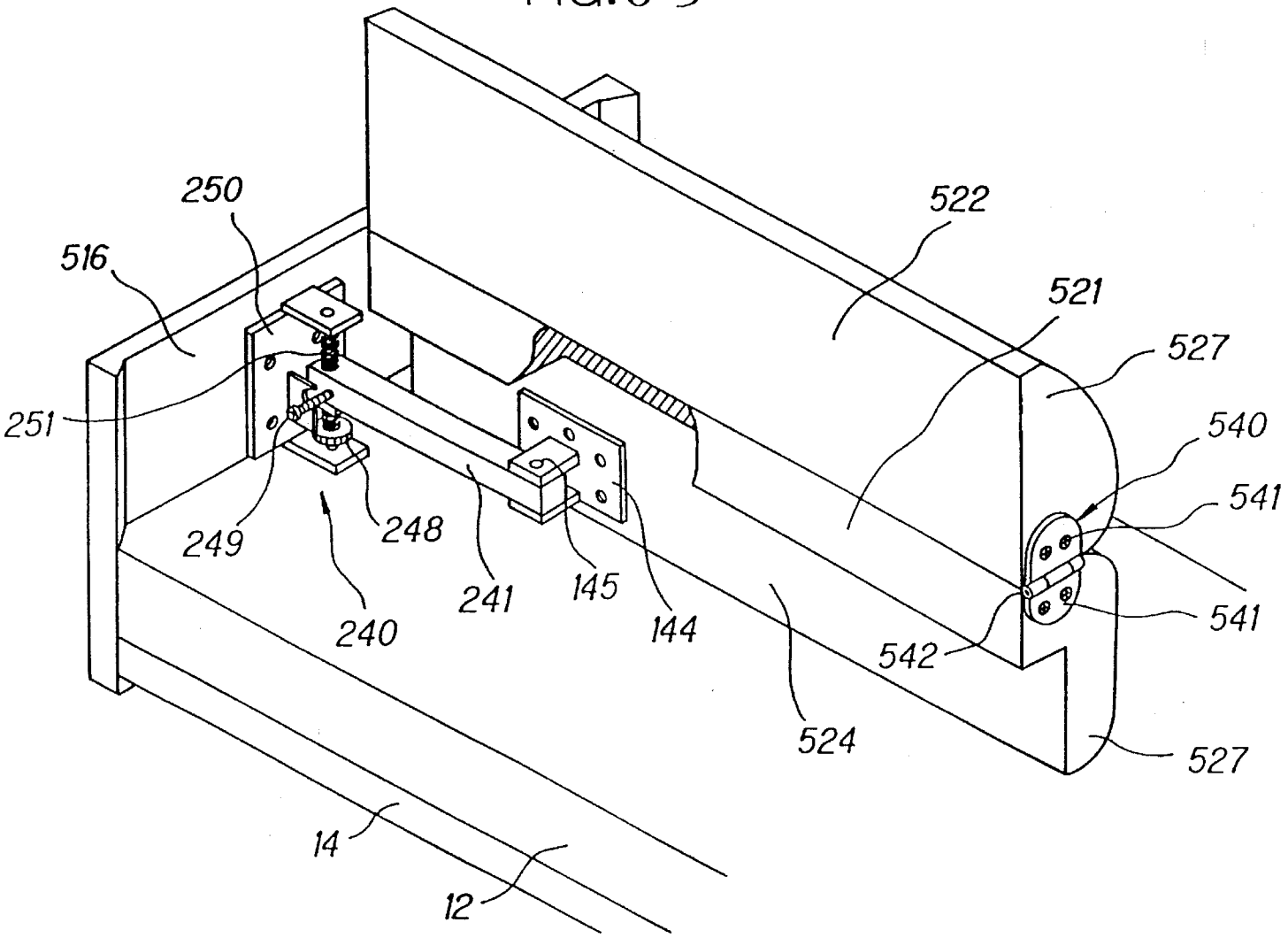
FIG. 65 is a perspective view showing a movable mechanism of the twelfth embodiment of the sofa-bed of the present invention seeing from the rear side of the sofa-bed in a sofa mode, a part of the movable half backrest being broken away for clearness.

As shown in FIGS. 58 and 65, the sofa-bed 510 is easily changeable to the state for using as a sofa only by setting manually a movable backrest 520 from the first position of a head board in a bed mode to the second position in a sofa mode (see FIG. 60) passing through an intermediate state (see FIG. 59).

The sofa-bed 510 comprises a panel 14 for laying out a mattress 12 etc. and a head board 16 and a foot board 18 respectively supporting longitudinal two end portions of said panel 14 (If his head lies in the foot board side 18, the foot board serves as a head board).

Furthermore a movable backrest 520 is provided to the sofa-bed 510. The movable backrest 520 consists of two movable half backrests 521,522 which can be moved among positions; the first position where one movable half backrest 522 is piled on top of the other 521 over the head board 16 (see FIG. 58), the intermediate position where the piled backrests are parallel to the longitudinal center line of said panel 14 (see FIG. 59) and the second position where the backrests are placed sideways parallel to said center line 14 (see FIG. 60).

The backrest side of the base of each movable half backrest 521,522 is provided with a cushion portion 526 comprised of cushion, etc. Said each movable half backrest 521,522 is supported, through the movable mechanism 140 common to the fourth embodiment (see FIG. 27), on the head board 16 moveably between said first position and said intermediate position.

Figure 60:
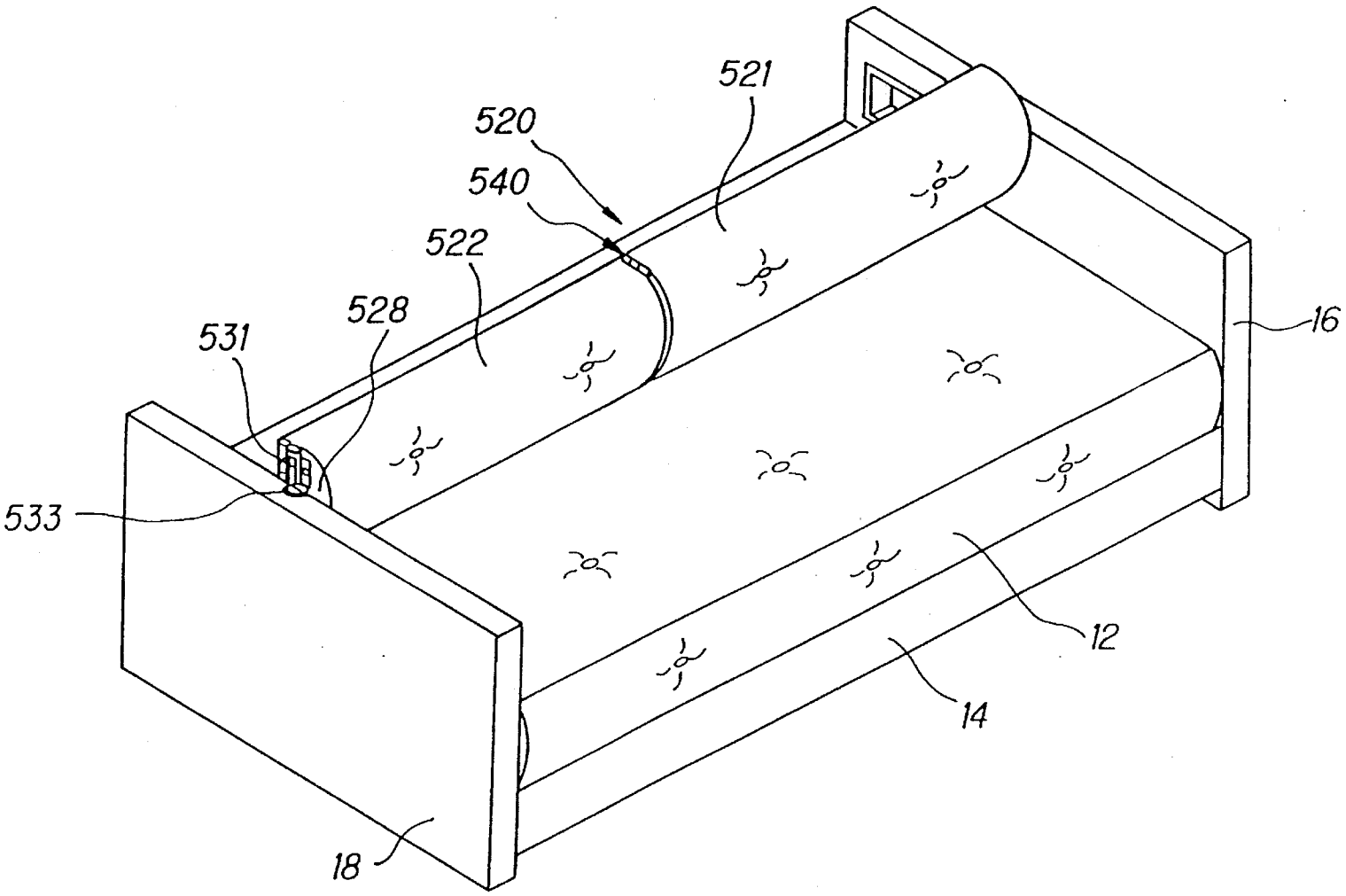
FIG. 60 is a perspective view illustrating a state of the eleventh embodiment of the sofa-bed of this invention as it is used in a sofa mode.
Figure 6:
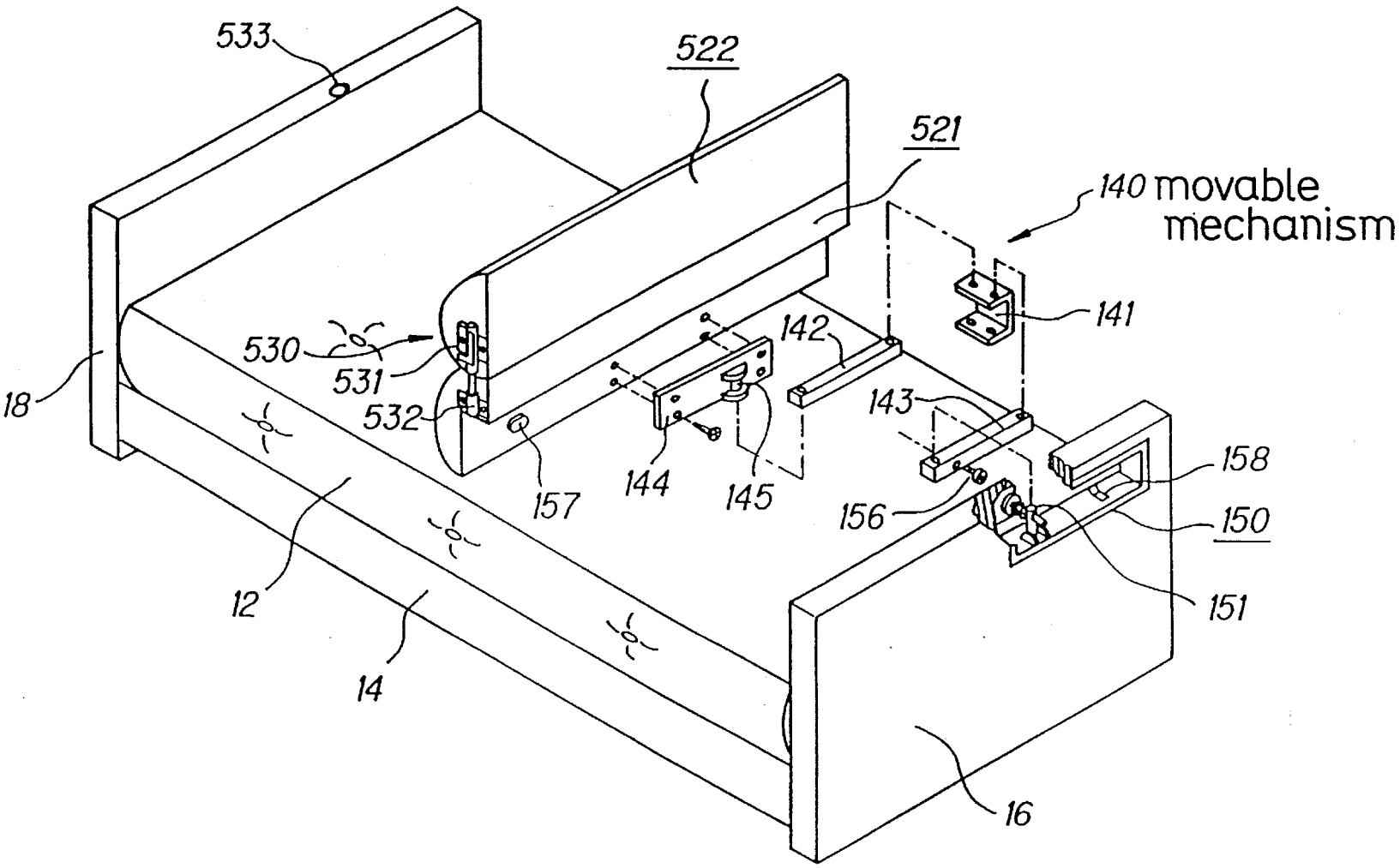
Figure 62:
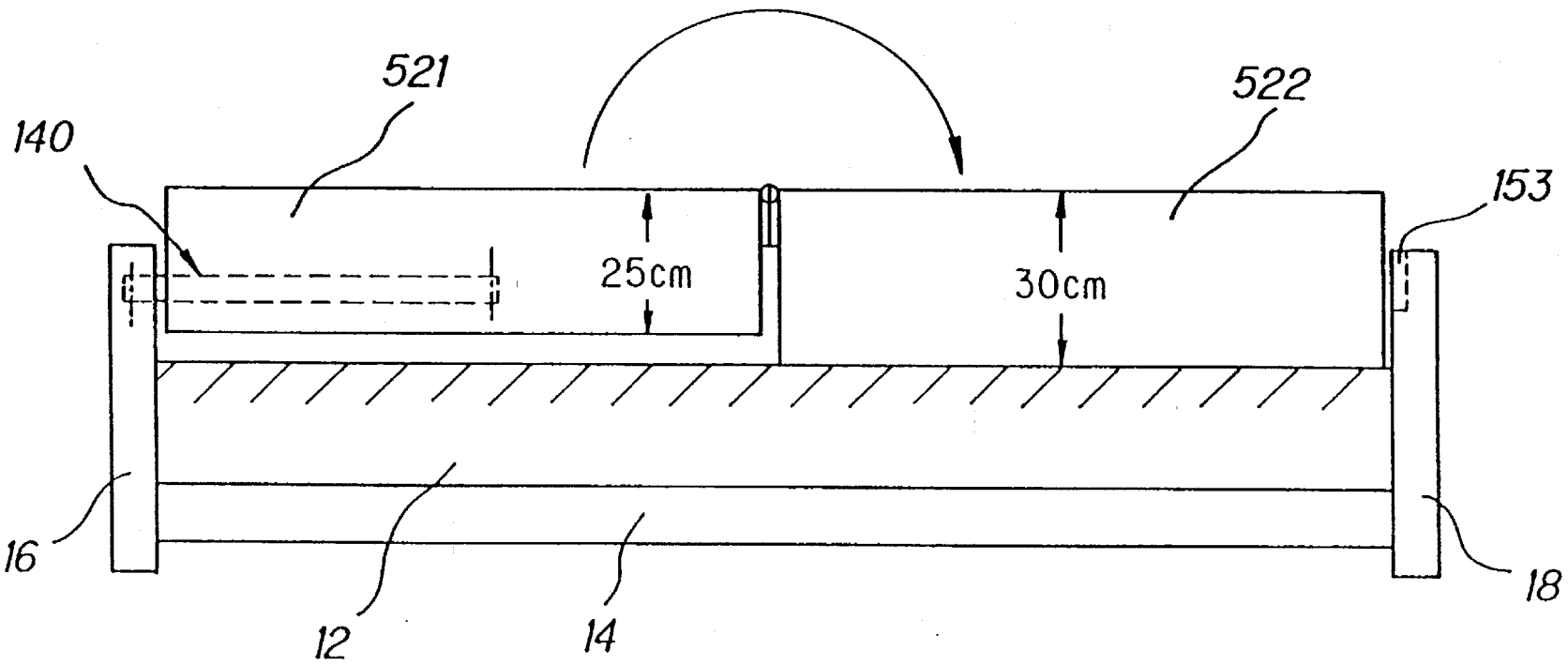
FIG. 62 is a rear elevation view illustrating a state of the eleventh embodiment of the sofa-bed being in a sofa mode.
Figure 63:
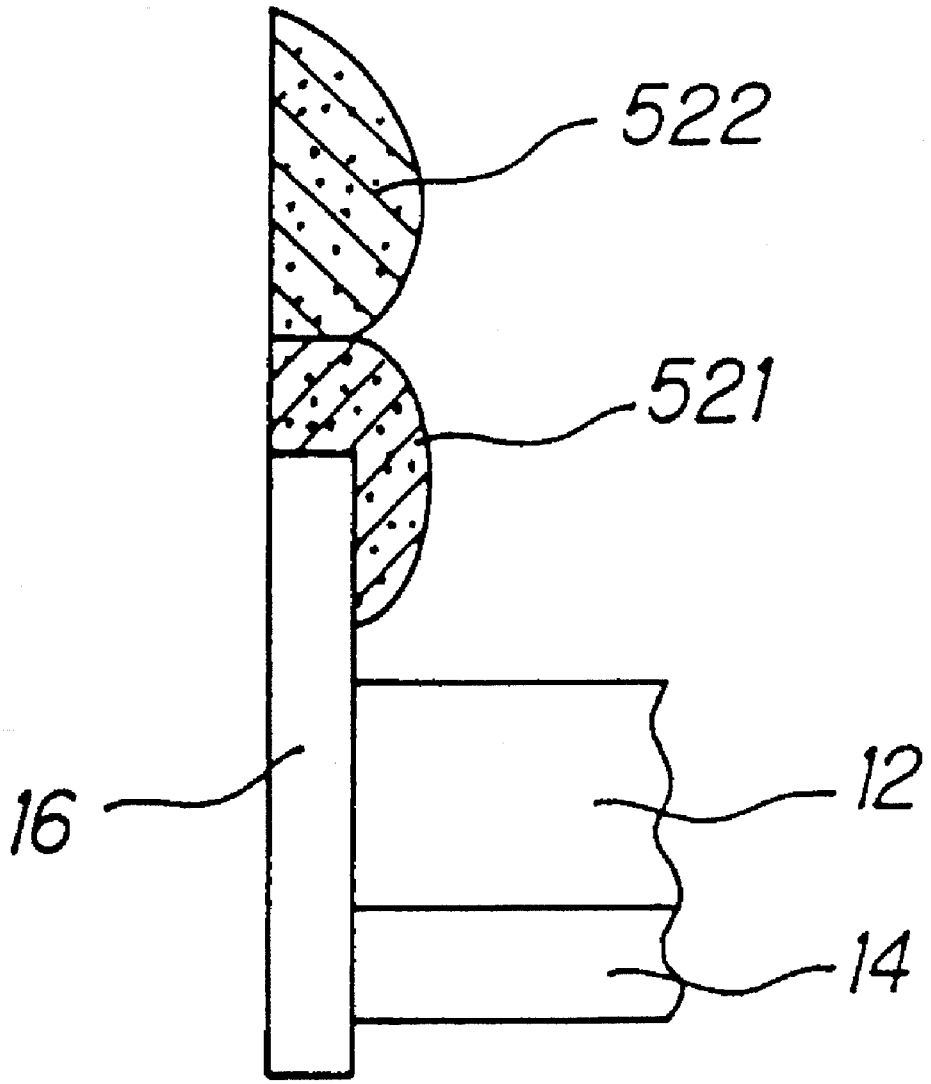
FIG. 63 is a side view illustrating a state of the eleventh embodiment of the sofa-bed being in a bed mode.
Figure 6:
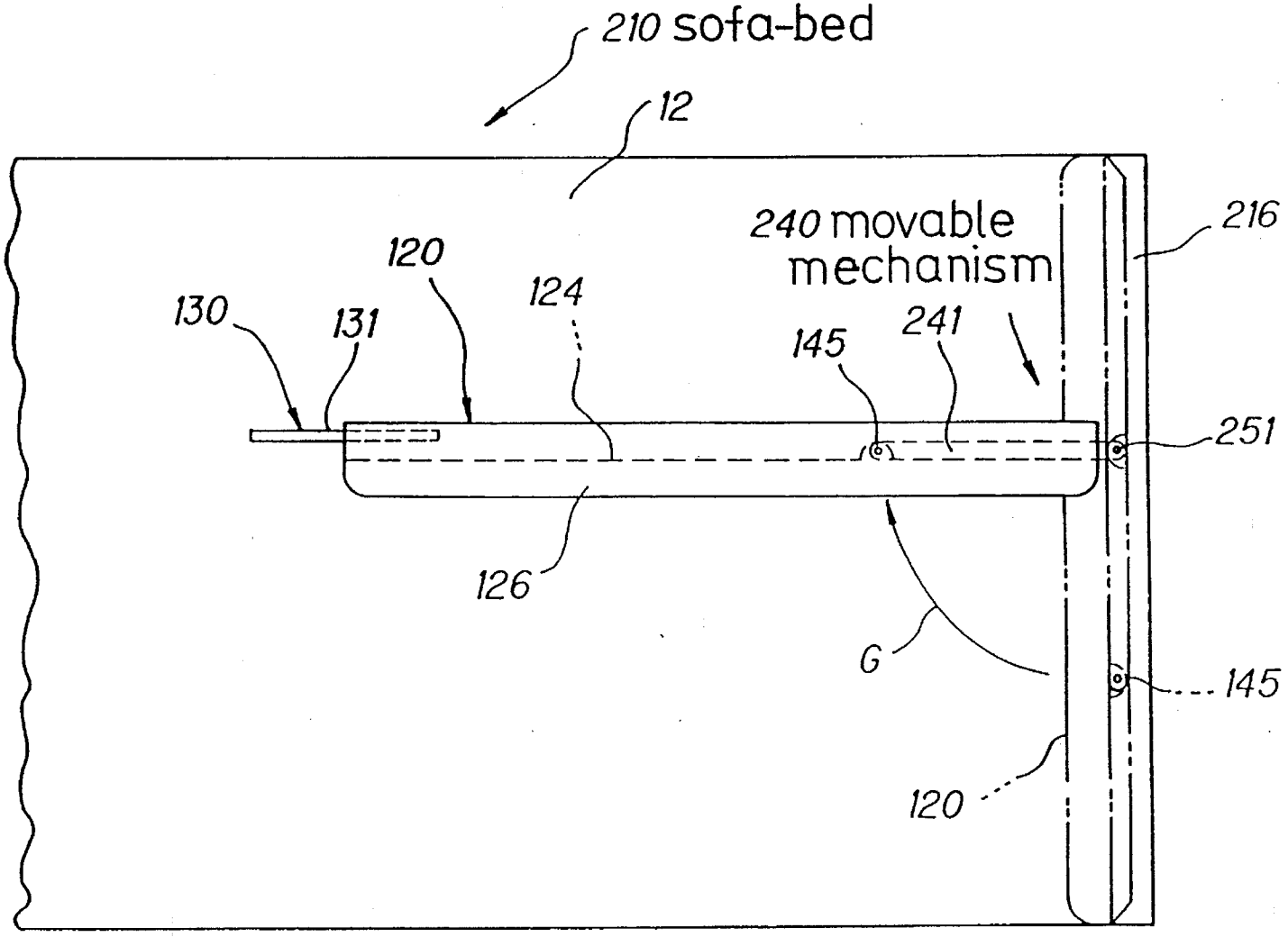

As shown in FIGS. 59 and 60, each movable half backrest 521,522 is coupled together by the hinge (coupling mechanism) 540 both in the state that one backrest is piled on top of the other and the state that the backrests are placed sideways in a straight line.

More particularly the hinge 540, as illustrated in FIG. 59, is comprised of two leaves 541,541 coupled together turnably by a pivot pin 542 and one of the leaves is fixed by screws on upper portion of one end surface 527 of the movable half backrest 521 which is on the lower position when two backrests are piled, and the other leaf 541 is fixed by screws on lower portion of one end surface 527 of the movable half backrest 522 which is on the upper position when two backrests are piled, so that one movable half backrest 521 is supported almost in a straight line against the other movable half backrest 522 because each end surface 527,527 faced together when said half backrests 521,522 are placed in a row.

In the other end surface 528 of the movable half backrest 522, as shown in FIG. 58, a bolt 531 which is a part of the lock mechanism for supporting the movable backrest 520 in the first position (see FIG. 58) or the second position (see FIG. 60) is mounted thereon in the vertical position. A plate 532 which is engaged with said bolt 531 in the bed mode is mounted on the other end surface 528 of the movable half backrest 521. This bolt 531 and plate 532 keep two movable half backrests 521,522 in the first position to be piled.

As shown in FIG. 60, a hole 533 with which the bolt 531 is engaged in the sofa mode is formed on the upper edge of the footboard 18. This bolt 551 and hole 532 serve to prevent two movable half backrests 521,522 in the second position from being warped backwardly.

Referring to FIG. 61, there is shown a movable mechanism 140 for supporting the movable backrest 520 on the head board 16 moveably between the first position (see FIG. 58) and the intermediate position (see FIG. 59). The movable half backrests 521,522 supported in each position (especially in the second position) can be adjusted slightly in vertical direction and in the front and back by the movable mechanism 140, and said mechanism 140 is comprised of the position controlling and break preventing mechanism for preventing said backrests from being broken by the weight when excessive weight is loaded on them. Because the movable mechanism 140 is similar to that of the fourth embodiment, its repeated explanation will be omitted.

Action of above-mentioned sofa-bed 510 of the eleventh embodiment of the present invention will described hereinafter.

As shown in FIG. 58, if the user wants to change the state of each movable half backrest 521,522 put away in the first position on the head board 16, from the bed mode to the sofa mode, he needs to push the movable backrest 520, in the state that the movable half backrests 521 and 522 are piled, in the direction indicated by arrow "A" to move the backrest 520 to the intermediate position.

Then as shown in FIG. 61 (see FIG. 27), the movable half backrest 521 supported directly by movable mechanism 140 and one arm 142 of the mechanism 140 are turnably coupled together; furthermore the arm 142 and the other arm 143 which is turnably coupled to head board 16 through the position controlling and break preventing mechanism are coupled together turnably in the horizontal direction via the hinge bracket 141, so that the user can move easily the movable backrest 520 from the first position to the intermediate position manually by himself.

Then as illustrated in FIG. 59, he turns upper movable half backrest 522 of movable backrest 520 from the intermediate position in the direction indicated with an arrow "B" by 180 degrees, to the second position where the movable half backrests 521 and 522 are placed sideways in a longitudinal direction of them. As shown in FIG. 61 (see FIG. 27) the movable half backrest 522 is turnably coupled to the movable half backrest 521 with hinge 540, so that one movable half backrest 521 is supported almost in a straight line against the other movable half backrest 522 because each end surface 527,527 faced together when said half backrests 521,522 are placed sideways in straight line.

As above described, although two arms 142,143 of the movable mechanism 140 is almost in straight line, as shown in FIG. 27, when each movable half backrest 521,522 is in the intermediate position or the second, if the location of each movable half backrest 521,522 in the second position is not appropriate on account of unevenness of accuracy of woodwork, the user can adjust the position(angle) of arm 143 exactly at least vertically(shown in FIG. 28 with phantom line) or the front and back direction by means of rotating the adjusting nut 155 and/or the stopper 156, the position controlling and break preventing mechanism of the movable mechanism 140, in an optional direction.

Thus the appropriate position adjustment for the bolt 531, a part of lock mechanism 530 provided to one end surface 528 of the movable half backrest 522, to just engage with the hole 533 formed on the upper edge of foot board 18 could be achieved and two movable half backrests 521,522 are prevented from being warped backwardly by means of said lock mechanism.

In the sofa mode illustrated in FIG. 60, eve if each movable half backrest 521,522 is loaded with excessive weight, the product is prevented from been broken because said excessive weight is absorbed by the spring 154 of the position control and break prevent mechanism of the movable mechanism 140 appropriately.

To change the each movable half backrest 521,522 held in the second position, from the sofa mode to the bed mode, the user may reverse the operation described previously. In the bed mode, since each movable half backrest 521,522 is piled together and is put away in the position substantially above and along the head board 16, the half backrests are not to be obstacles. And they are located on one end of the bed therefore so that the dead space on the mattress 12 is decreased and a larger lying space is gained.

Referring to FIGS. 64 and 65, there is shown a twelfth embodiment of a sofa-bed 550 of the present invention. The members and portions which are identical to those of eleventh embodiment are given like reference characters and their repeated explanation will be omitted.

Both in a bed mode and a sofa mode, although an outward appearance of this embodiment of the sofa-bed 550 and the movable mechanism 240 having the position controlling and break preventing mechanism are almost similar to those of the eleventh embodiment, the construction of said movable mechanism 240 and of its position controlling and break preventing mechanism of this embodiment are different from those of the eleventh embodiment.

As shown in FIG. 64, each movable half backrest 521,522 is supported on a head board 516 via a movable mechanism 240 common to the fifth embodiment moveably between the first position (indicated by phantom line) and the intermediate position (indicated by solid line).

As seen in FIG. 65, the movable mechanism 240 is equipped with a metal arm 241. The top end portion of this arm 241 is coupled turnably with a shaft 145 to the back of the movable half backrest 521 via a mount bracket 144. A base end portion of the arm 241 is coupled rotatably in the horizontal direction to a shaft 251 which is pivotably supported almost perpendicularly to the mount bracket 250 of the head board 516. Since the movable mechanism 240 is similar to that of the fifth embodiment, its repeated explanation will be omitted.

Action of above-mentioned sofa-bed 550 of the twelfth embodiment will described hereinafter.

As shown in FIG. 64, if a user wants to move the movable backrests 520 from the first positions (indicated by phantom line) on the head board 516 wherein the backrests are put away in the bed mode to the second positions in the sofa mode, he may move the movable half backrest 521 pivotably supported on the top end side of the arm 241 via shaft 145 to the intermediate position (indicated by solid line) extending in the longitudinal direction of the sofa-bed by turning arm 241 at the movable shaft 251 of movable mechanism 240 in the direction shown by arrow "C".

Thus the arm 241 is positioned to be almost perpendicular to the head board 516 as illustrated in FIG. 65. Even if the movable half backrest 521 in the intermediate position is tilted to the vertical direction on account of unevenness of accuracy of woodwork, the inclination of the movable half backrest 521 can be adjusted because the arm 241 is adapted to be rocked to some degrees vertically on the supporting shaft 251 inserted into the oval aperture 242.

By means of rotating the adjusting nut 248 and/or the stopper 249 in an optional direction, the height and/or position in lateral direction of the movable half backrest 521 can be adjusted appropriately. Furthermore in the sofa mode (see FIG. 60), even if each movable half backrest 521,522 is loaded with excessive weight, they are prevented from been broken because the springs 247,247 of the position controlling and break preventing mechanism (see FIG. 33) absorb said excessive weight. Then the arm 241 tilted by excessive load temporarily is returned to the horizontal position immediately by the position returning member 244 (see FIG. 33) whose protruding portion 245 is pressed to its hollow portion 243 (see FIG. 33) by means of the restoring force of said spring 247.

Figure 66:
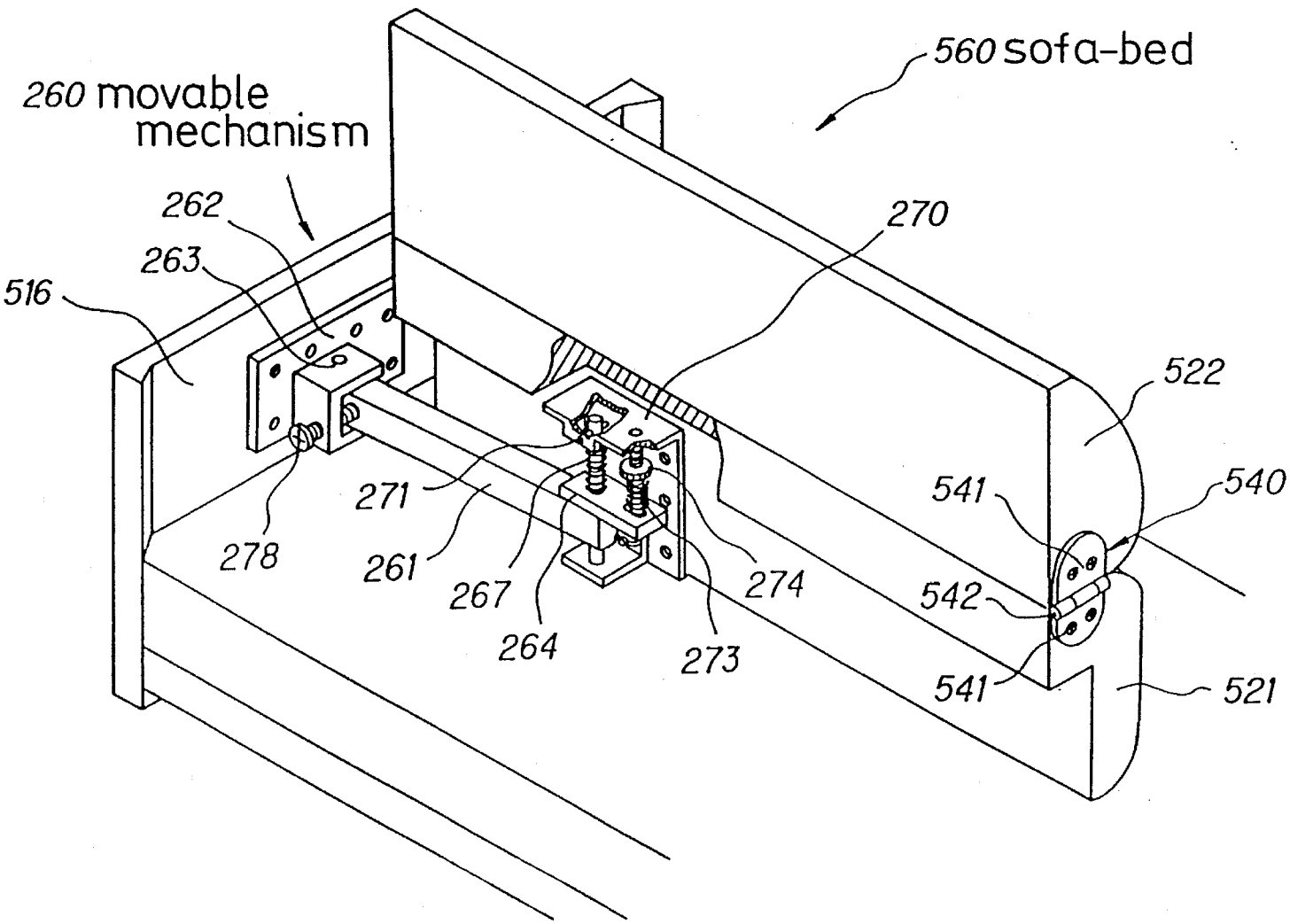
FIG. 66 is a perspective view showing a movable mechanism of the thirteenth embodiment of the sofa-bed of the present invention seeing from the rear side of the sofa-bed in a sofa mode, a part of the movable half backrest being broken away for clearness.

Referring to FIG. 66, there is shown a thirteenth embodiment of a sofa-bed 560 of the present invention. The members and portions which are identical to those of twelfth embodiment are given like reference characters and their repeated explanation will be omitted.

Both in a bed mode and a sofa mode, although an outward appearance of this embodiment of the sofa-bed 560 is almost similar to that of the twelfth embodiment, the construction of said movable mechanism 260 and its the position controlling and break preventing mechanism of this embodiment are different from those of the twelfth embodiment.

As shown in FIG. 65, a movable mechanism 250 which supports each movable half backrest 521,522 moveably on a head board 515 is provided with an arm 261. This base end portion of the arm 261 is pivotably connected in the horizontal direction, with a shaft 263 to a bracket 262 of the head board 516. And the movable half backrest 521 is coupled to the top end portion of of arm 261 via the position controlling and break preventing mechanism of the movable mechanism 260.

A screw type stopper 278, which touches the side of base end portion of the arm 261 when the movable half backrest 521 is in the intermediate position, is mounted to the bracket 262 which is a part of the movable mechanism 260. Said stopper 278 sets a final position of straight extending arm 261 which is turning in a horizontal plane at the movable shaft 263 by appropriately adjusting the tip projection of the stopper 278 with a screwdriver, and adjusts a position of movable half backrest 520 on the intermediate location in front and back direction. Since the movable mechanism 260 is almost similar to that of the sixth embodiment, its repeated explanation will be omitted.

Action of above-mentioned sofa-bed 560 of the thirteenth embodiment will be described hereinafter.

If a user wants to move movable backrests 521,522 from the first position on the head board 16 (see FIG. 24) wherein said backrests are put away in the bed mode to the second position in the sofa mode, he may move them with ease from the first position to the second passing through the intermediate (or reverse) manually in a manner similar to that of the sofa-bed 550 of twelfth embodiment.

Thus the arm 261 is positioned to be almost perpendicular to the head board 515 as illustrated in FIG. 66. Even if each movable half backrest 521,522 in the intermediate position is tilted in the vertical direction on account of unevenness of accuracy of woodwork, the inclination can be adjusted because the movable half backrest 521 is adapted to be rocked in some degrees vertically against the upper end portion of said arm 261 on the pivot shaft 271 of supporting bracket 270 mounted to the back of the movable half backrest 521.

Then the angle adjustment of the movable half backrest 521 can be done easily by turning the adjusting nut 274 in an optional direction. Furthermore the angle adjustment of the movable half backrest 521 in the front and back direction is possible because said movable half backrest 521 is adapted to turn about the first supporting shaft 267 in the front and back direction.

Furthermore also in this embodiment, in the sofa mode, even if each movable half backrest 521,522 is loaded with excessive weight, the product are prevented from been broken because the springs 268,275 of the position controlling and break preventing mechanism absorb said excessive weight. Then the arm 261 tilted by excessive load temporarily is returned to the horizontal position immediately by the restoring force of said springs 268,275.

Figure 67:
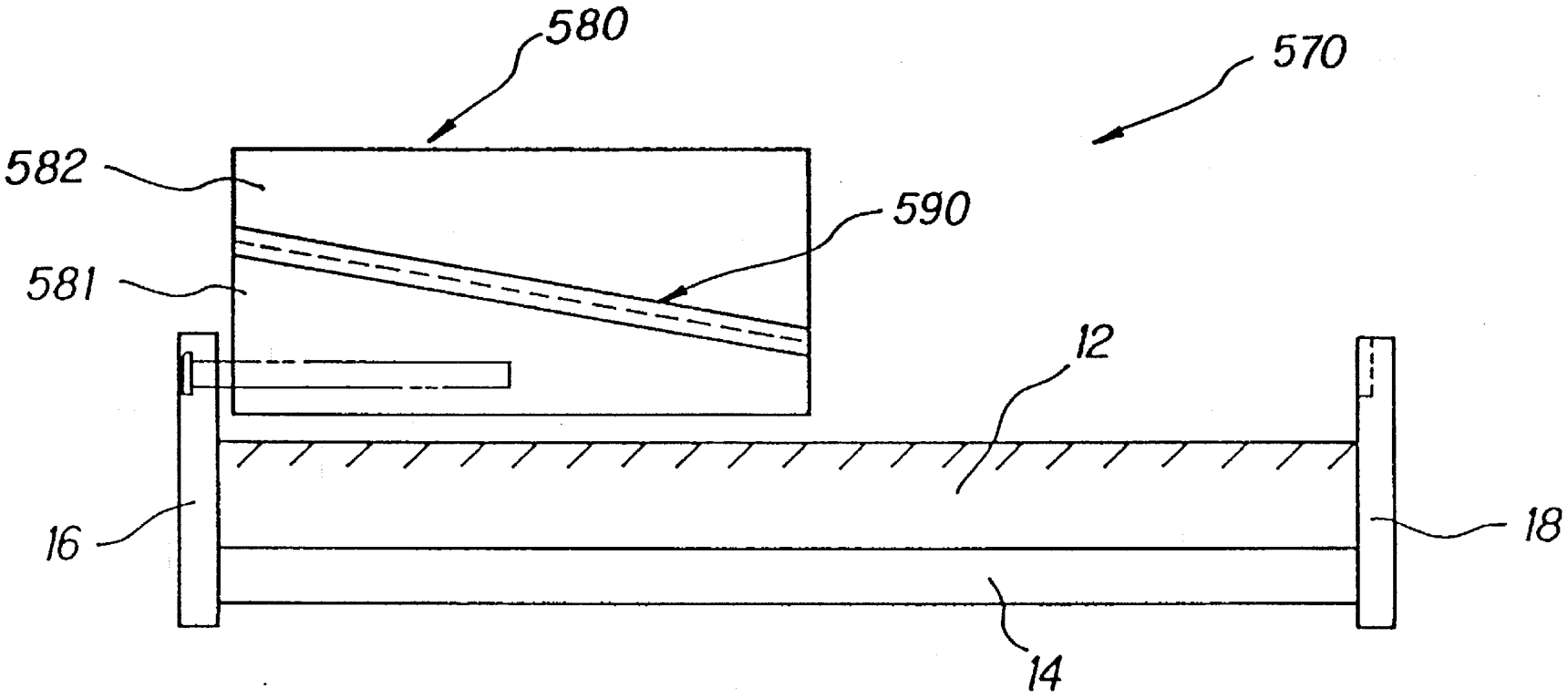
FIG. 67 is a rear perspective view illustrating a state of a movable backrest of a fourteenth embodiment being positioned in the intermediate position.
Figure 68:
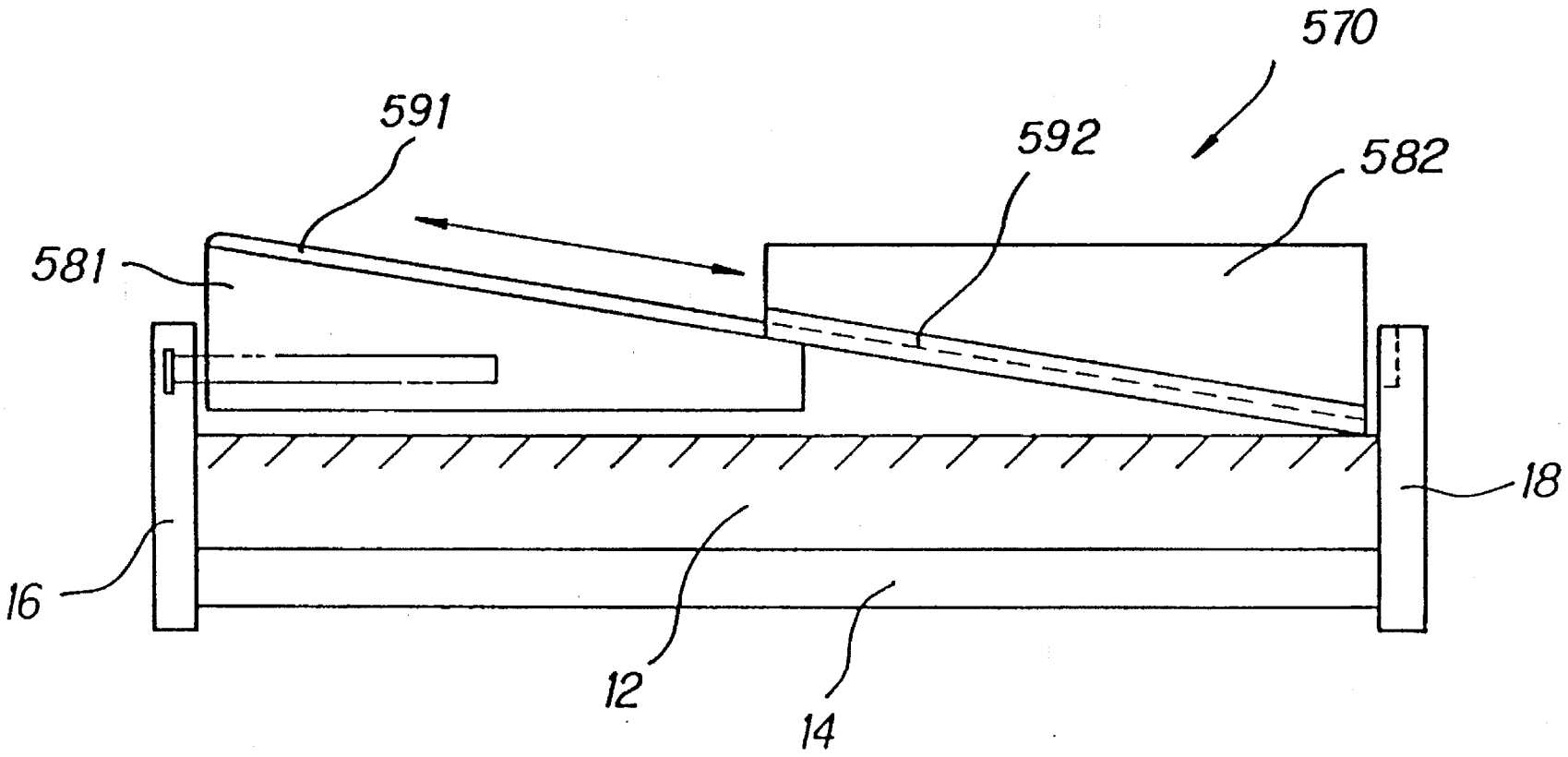
FIG. 68 is a front view illustrating each movable half backrest of the fourteenth embodiment being in the second position in a sofa mode.
Figure 69:
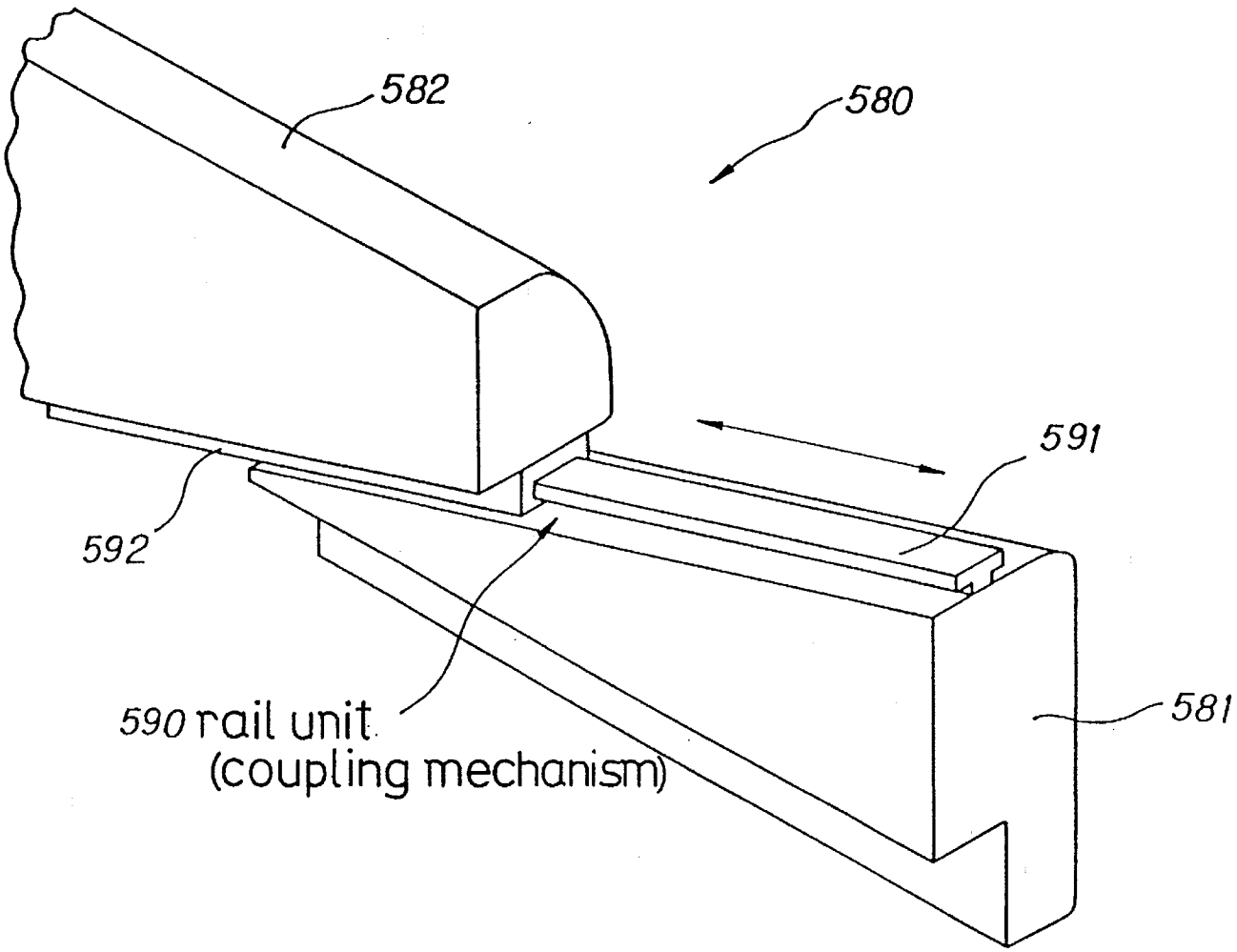
FIG. 69 is a perspective view of a rail unit (coupling mechanism) for coupling the movable half backrests of the fourteenth embodiment with each other.

Referring to FIGS. 67–69, there is shown a fourteenth embodiment of a sofa-bed 570 of the present invention.

Characteristics of the sofa-bed of this embodiment are in the following coupling mechanism 590. The basic construction of said sofa-bed 570 is identical to that of the sofa-bed 510 of the eleventh embodiment and therefore the common members are designated by the same characters and their repetitive explanation will be omitted.

As shown in FIG. 67, a movable backrest 580 is obliquely divided into two movable half backrests 581,582 which are coupled together with a rail unit (coupling mechanism) so as to be in the state that one half backrest 582 is piled on the top of the other 581 above the head board 16 and in the state that the half backrests are placed sideways in a straight line. Said rail unit 590 consists of a lower rail 591 which is fixed to a lower movable half backrest 581 and a upper rail 592 which is fixed to a upper movable half backrest 582.

Referring now in detail to FIG. 69 in detail, the cross section of said lower rail 591 is formed like character "T" so as to engage with a groove of upper rail 592 and is mounted on the obliquely extending upper edge of the lower movable half backrest 581. On the other hand, said upper rail 592 is formed with the groove extending in the longitudinal direction of the rail and is mounted on the obliquely extending lower edge of the upper movable half backrest 582. Each movable half backrest 581,582 (directory the lower movable half backrest 581) is supported via the movable mechanism on the head board 16 moveably between the first position (see FIG. 58) and the intermediate position (see FIG. 67). Said construction is similar to that of the twelfth embodiment or the thirteenth embodiment.

Action of above-mentioned sofa-bed 570 of the fourteenth embodiment will be described hereinafter.

The user moves each movable half backrest 581,582 piled together to the intermediate position (see FIG. 67) herein they are in parallel to the longitudinal direction of the panel 14, then he lowers the upper movable half backrest 582 to the side of the lower movable half backrest 581 and, as shown in FIG. 68, causing the corner of the lower edge of the movable half backrest 582 to stop in the second position where it touches the mattress 12. In the second position, if the user fixes the movable half backrest 582 to the footboard 18, the sofa-bed 570 is set in the sofa mode.

Thus in the sofa-bed 570 of the embodiment, since each movable half backrest 581,582 is coupled together with rail unit 590 relatively movable in the horizontal direction, the vertical moving length of the upper movable half backrest 582, in the movement of the movable backrest 580 from the intermediate position (see FIG. 67) to the second position (see FIG. 68), is much shorter than that of the eleventh embodiment so that the vertical space can be decreased.

Figure 70:
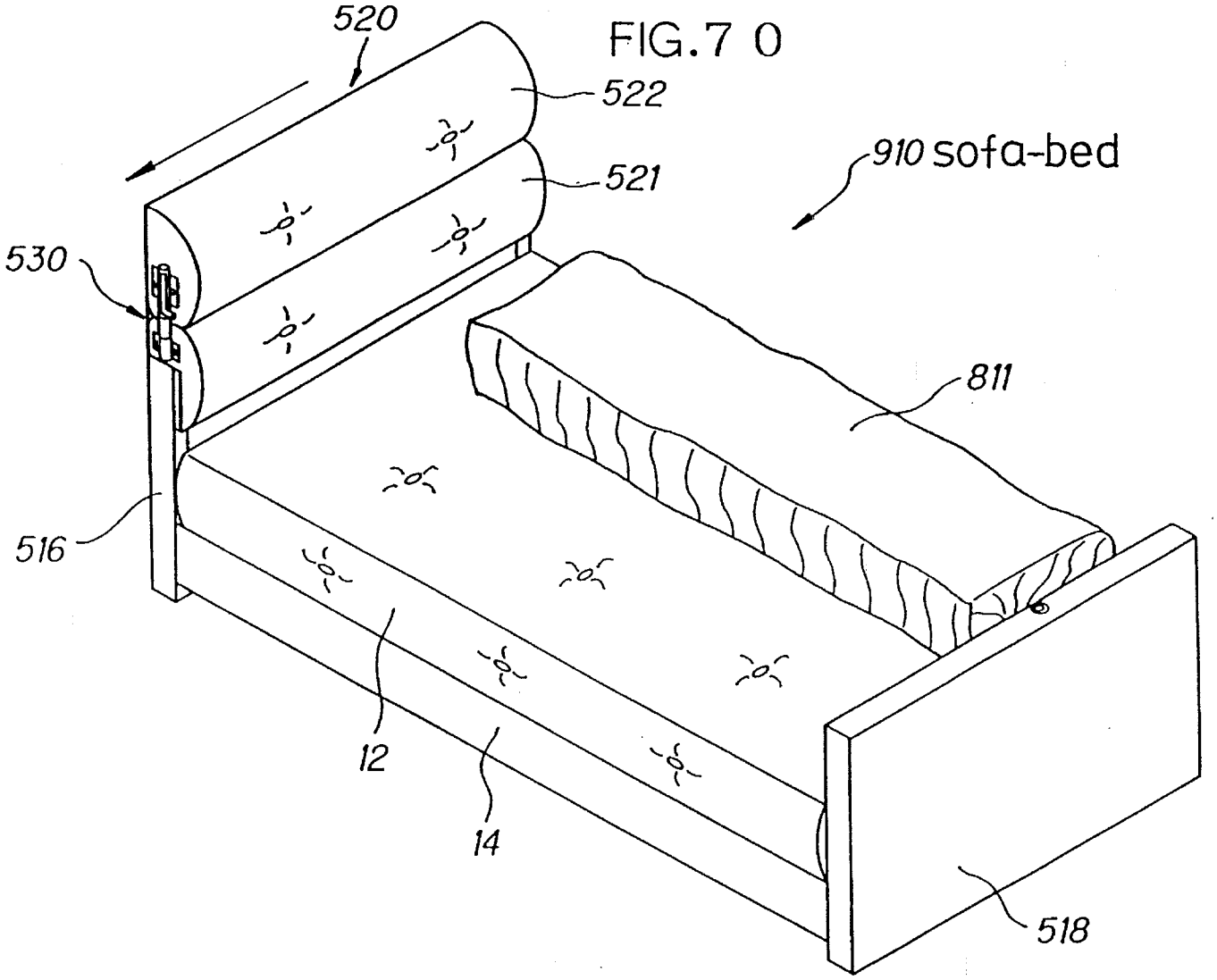
FIG. 70 is a perspective view illustrating a fifteenth embodiment of the sofa-bed of the present invention being in a bed mode, and a state which bedding on the mattress being folded in half along its longitudinal direction.
Figure 7:
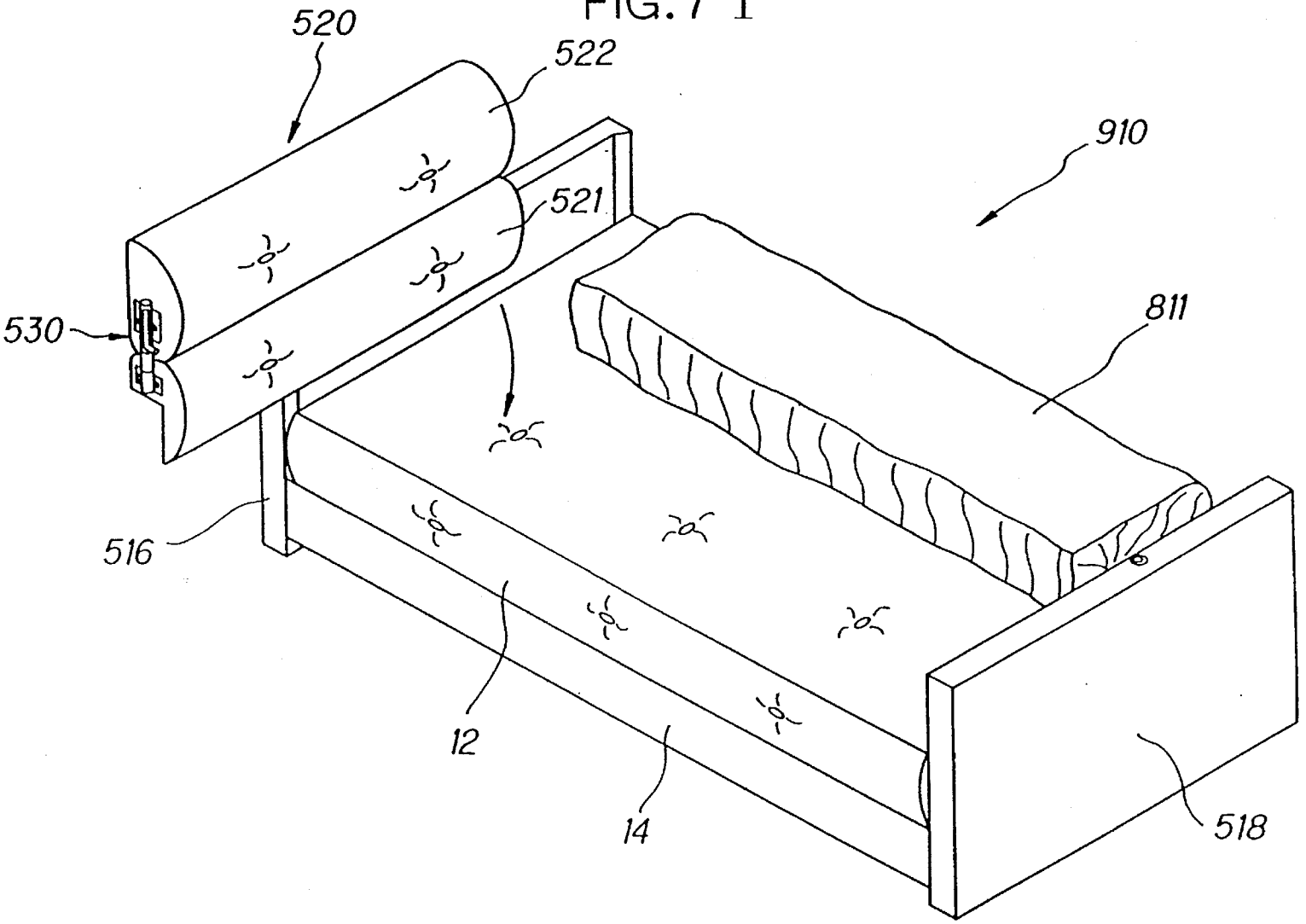
Figure 72:
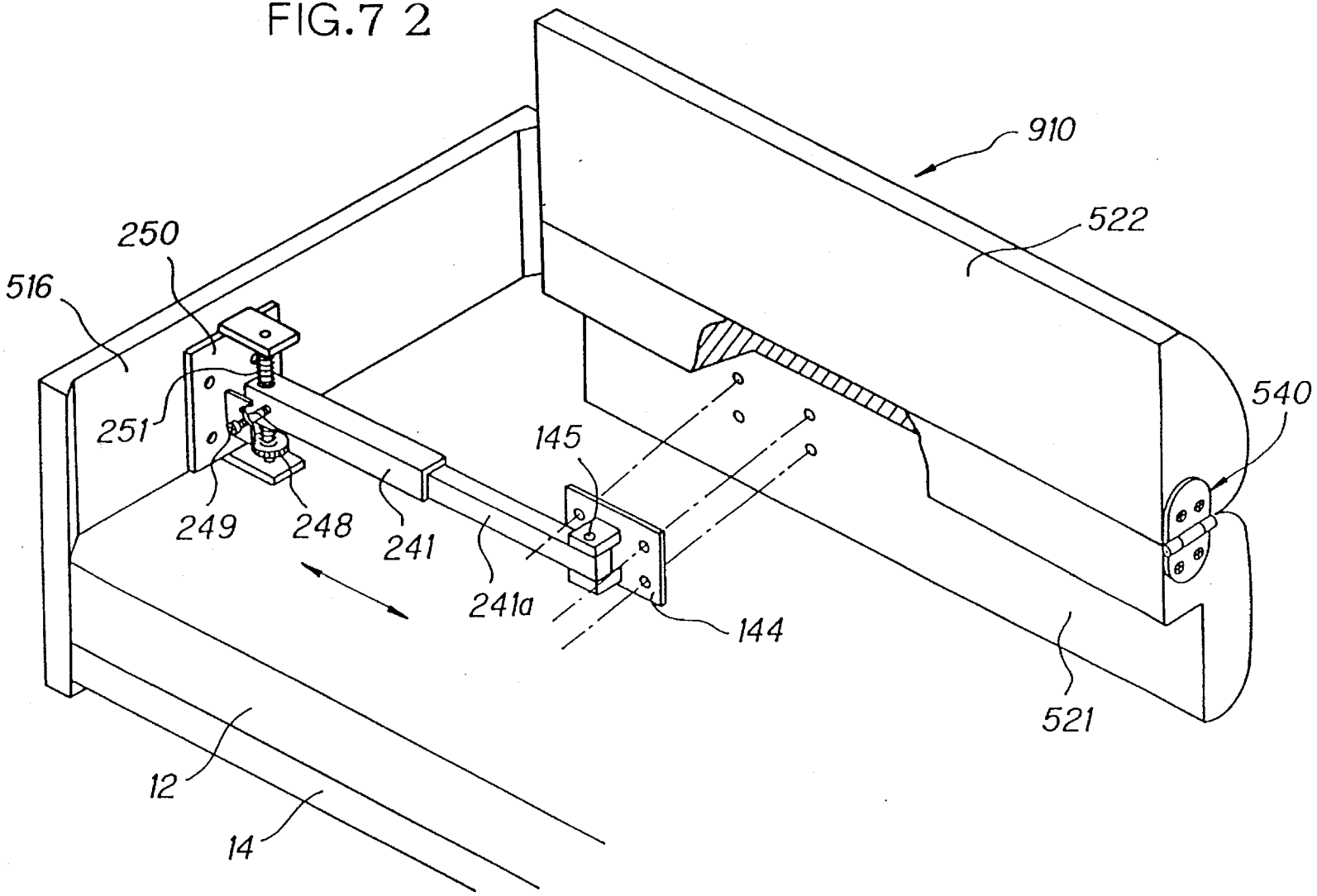
FIG. 72 is an enlarged perspective view illustrating a movable mechanism and a telescopic arm of the fifteenth embodiment.

Referring to FIGS. 70–72, there are illustrated a fifteenth embodiment of a sofa-bed 910 of the present invention. The members and portions which are identical to those of twelfth embodiment are given like reference characters and their repeated explanation will be omitted.

In a bed mode and a sofa mode, although an outward appearance of this embodiment of the sofa-bed 910 is almost similar to the one of the twelfth embodiment, the method for coupling said movable mechanism 240 to said movable half backrest 521 is different from that of the twelfth embodiment.

As shown in FIG. 70, an arm 241*a* is inserted into the arm 241 of a movable mechanism 240 and a mount bracket 144 mounted to the back of movable half backrest 521 is coupled to the top end portion of the arm 241*a* through the shaft 145 turnably in the horizontal direction.

Each half backrest 521,522, kept in the piled state, can be positioned beside the first position or the intermediate position by the length of arm 241*a* away from the arm 241.

Action of above-mentioned sofa-bed 910 of the fifteenth embodiment will be described hereinafter.

As shown in FIG. 70, if the user wants to change the sofa-bed from the bed mode to the sofa mode, he needs to fold the bedding 811, on the mattress 12, in half along the longitudinal direction of the sofa bed. Then as shown in FIG. 72, he needs to pull the arm 241*a* from the arm 241 and, as shown in FIG. 71, to move each movable backrest 521,522 from the first position to the position beside the first position.

In this state (see FIG. 71), when the user moves each movable backrest 521,522 from the first position side to the intermediate position side with the movable mechanism 240 in the horizontal direction, each backrest 521,522 turns to the intermediate position without touching the bedding 811 on the mattress 12.

Therefore when the user moves the sofa-bed 910 from the position in the bed mode to the position in the sofa mode, the bedding 811 on the mattress 12 is not to be an obstacle and he may move said backrests 521,522 easily from the first position to the intermediate position.

In above described various embodiments, although two divided movable half backrests of the movable backrest are explained to be same size, they may be different sizes as necessity requires and the embodiments using the different size half backrests in above described various embodiments are in the spirit of the invention. Furthermore the sofa-bed whose panel is replaced by the pipe structure is in the spirit of the invention.

In above mentioned various embodiments, although two divided movable half backrests of the movable backrest have been explained to be piled together, they may be arranged side by side closely.

FIGS. 73–85 illustrate a sofa-bed 610 of the sixteenth embodiment of the invention.

Figure 73:
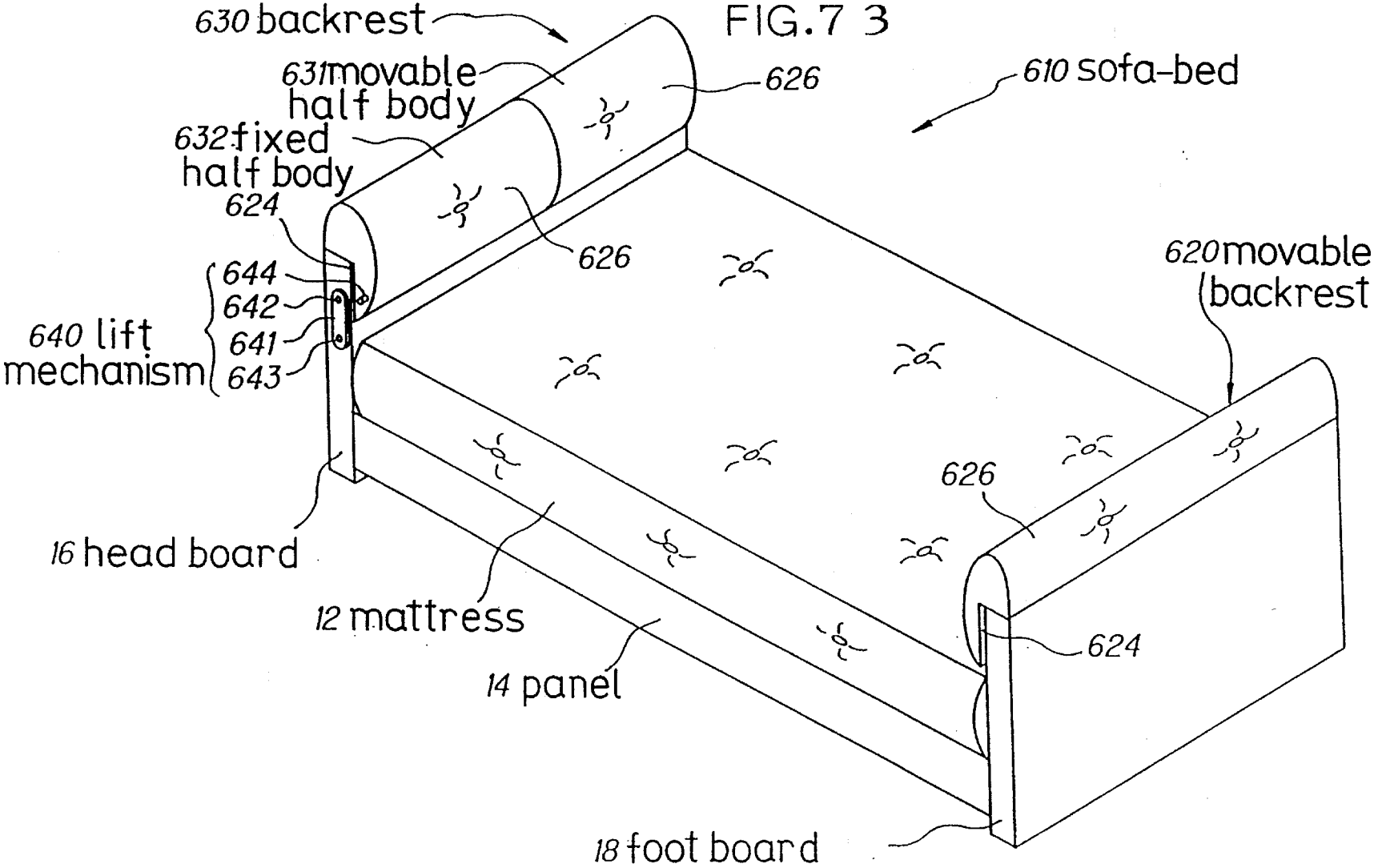
FIG. 73 is a perspective view illustrating a state of an sixteenth embodiment of the sofa-bed of this invention as it is used in a bed mode.
Figure 76:
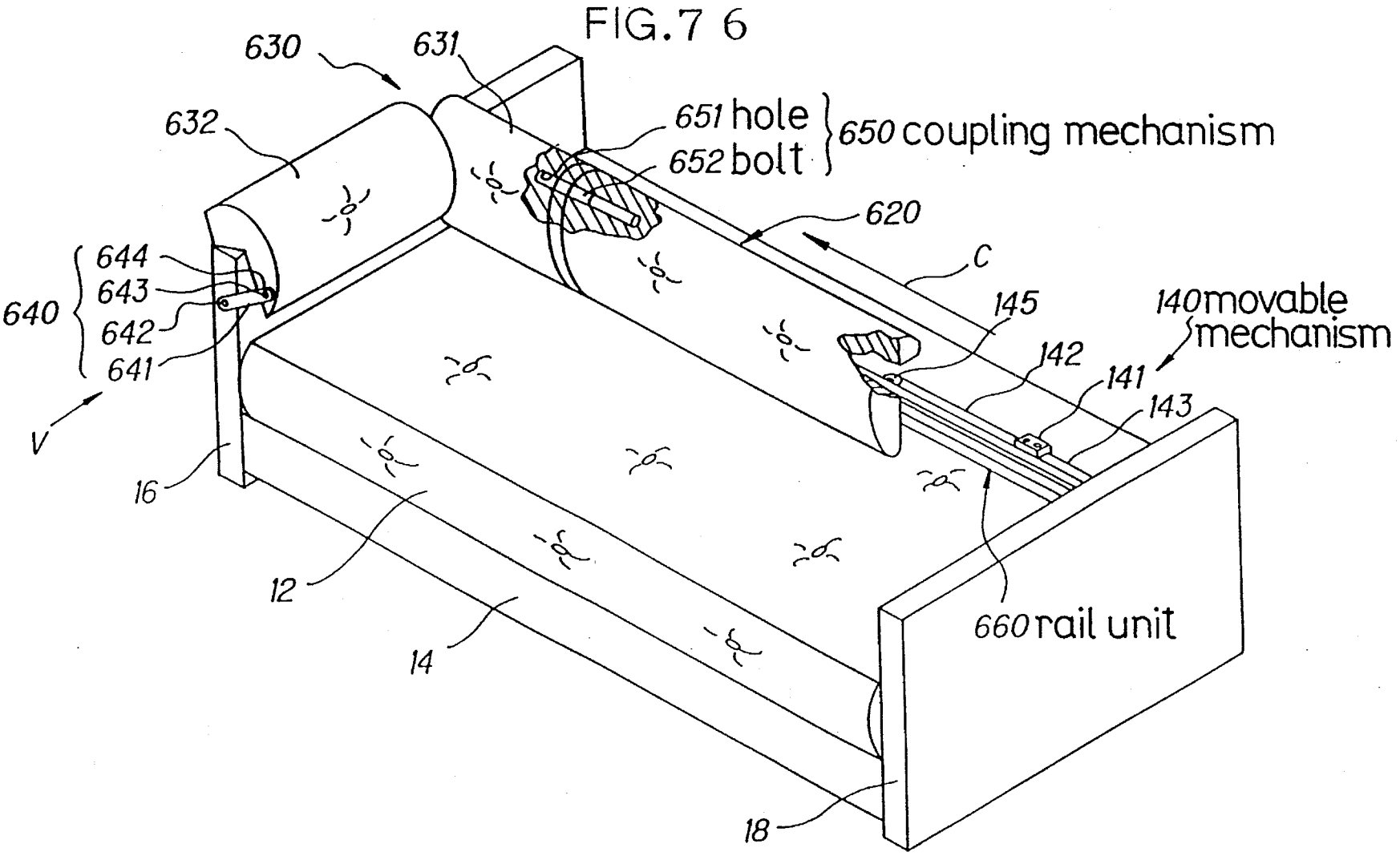
FIG. 76 is a perspective view illustrating a state of the sixteenth embodiment of the sofa-bed of this invention as it is used in a sofa mode.
Figure 77:
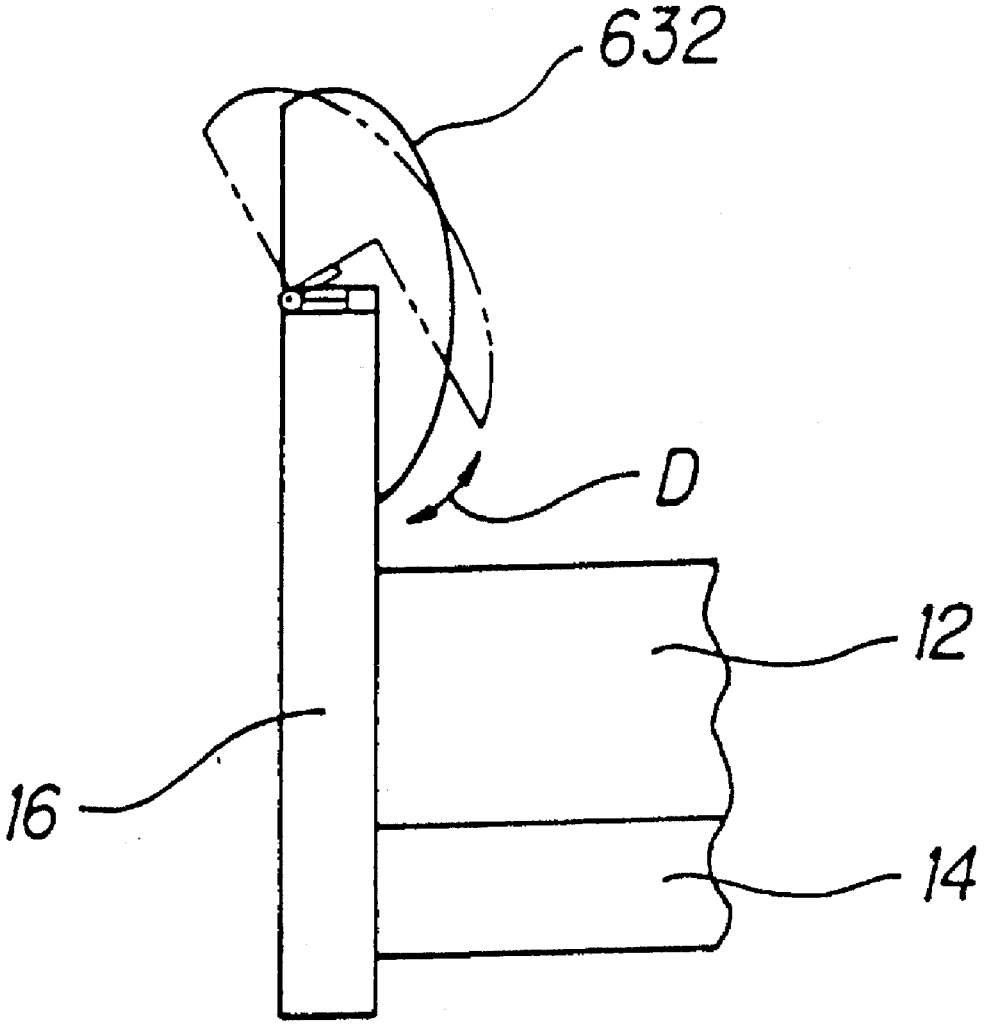
FIG. 77 is a fragmentary view taken in direction of the arrow V of FIG. 73.

As shown in FIG. 73, a sofa-bed 610 can be used by changing it from usual bed mode to the sofa mode that the user can sit and lie on the upper part of his body on the mattress (see FIG. 76).

The basic structure of the sofa-bed 610 includes a panel 14 for supporting a mattress on it and a head board 16, also serving as an armrest, and a foot board 18, also serving as an armrest, supporting both end portions of panel 14 in longitudinal direction (if the head of a user is on a foot board 18 side, the foot board serves as a head board.).

Furthermore this sofa-bed 610 is provided with a backrest 630, also serving as an armrest, mounted on the head board 16 and a movable backrest 620 mounted on the foot board 18. The movable backrest 620 and the backrest 630 are provided respectively with a cushion portion 626 comprised of an outer cover, cushion, etc. which are bonded to the backrest portion of the base board 624.

Figure 78:
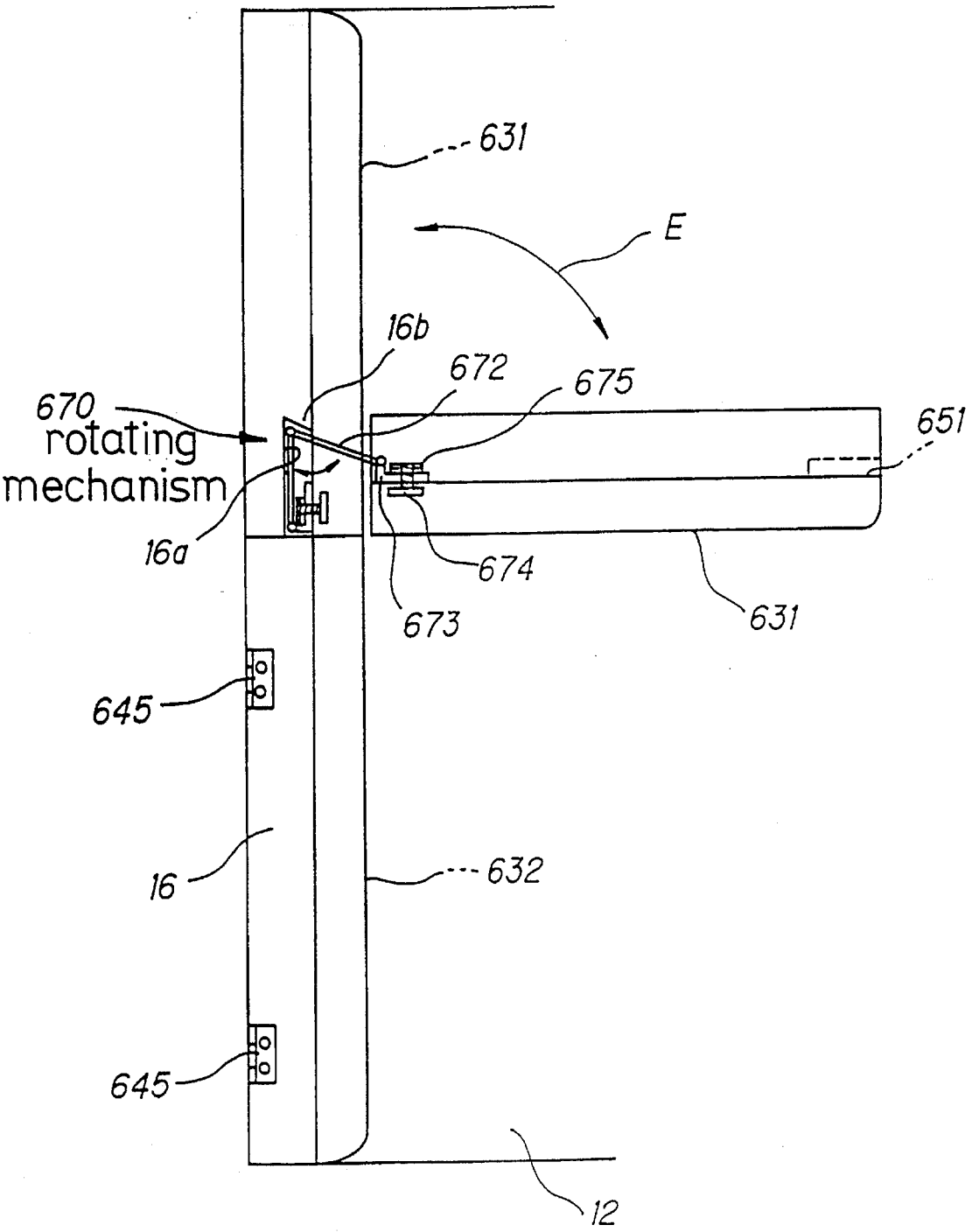
FIG. 78 is a plan view illustrating a movable half body of the sixteenth embodiment of this invention being moved from the first position to the second with a pivotal mechanism.
Figure 7:
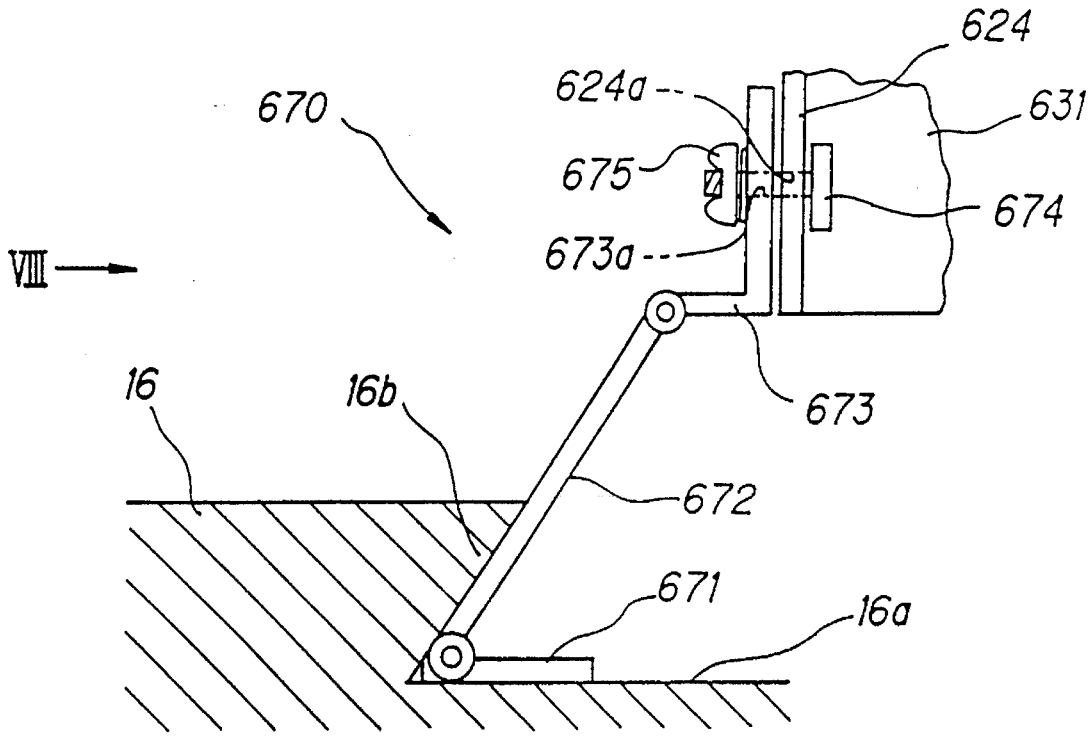
Figure 8:
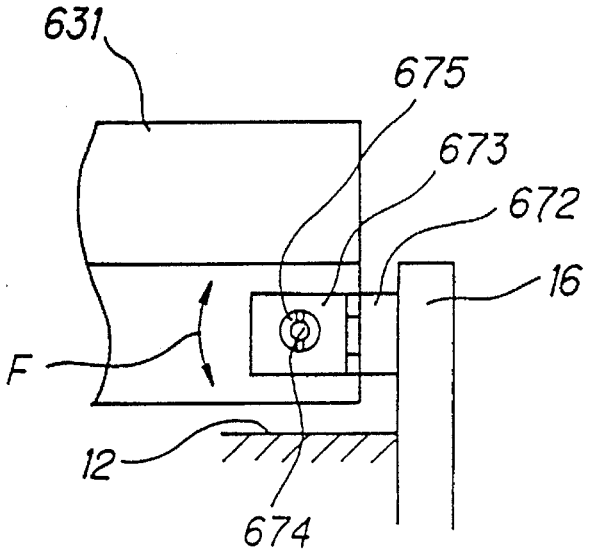

Said backrest 630 is divided into two parts or a movable half body 631 and a fixed half body 632, and said movable half body 631 is coupled to one end of the head board 16, moveably between the first position where the half body 631 is located above and along the head board (see FIG. 73) to the second position parallel to a longitudinal center line of the panel 14 (see FIG. 74), through a rotating mechanism 670 shown in FIG. 78. While the fixed half body 632 is coupled to the other end of the head board 16 through a lift mechanism 640 so as to permit an angle of inclination which is made between the half body 632 and the upper end portion of the head board 16 to be adjusted.

As shown in FIG. 73, said lift mechanism 640 comprises a supporting arm 641 which is supported turnably on the side end of the head board 16 through a pivot shaft 642 and a stop pin 644 fastened in the side end of the fixed half body 632 so as to engage a stop hole 643 formed in the top end of the supporting arm 641. The lift mechanism 640 is a mechanism which holds the fixed half body 632 rotated from the state that said base plate 624 of the fixed half body 632 is touched to an inner surface of the head board 16 with the upper state (shown with phantom line in FIG. 77) about a hinge 645 (shown in FIG. 78) as shown with an arrow "D" in FIG. 77.

As illustrated in FIGS. 78 and 79, said rotatable mechanism 670 which supports said movable half body 631 moveably between the first position (see FIG. 73) and the second position (see FIG. 74) comprises a first link segment 671 fastened to the cut away portion **16*a* formed in the center of said head board 16, a second link segment 672 coupled to the first link segment 671 turnably and a third link segment 673 coupled to the second link segment 672. A side edge of an acute angle cut away portion 16*a* serves as a stopper 16*b* which holds the second link segment 672 so as not to rotate over the prescribed angle formed between it and the first link segment 671**.

Figure 81:
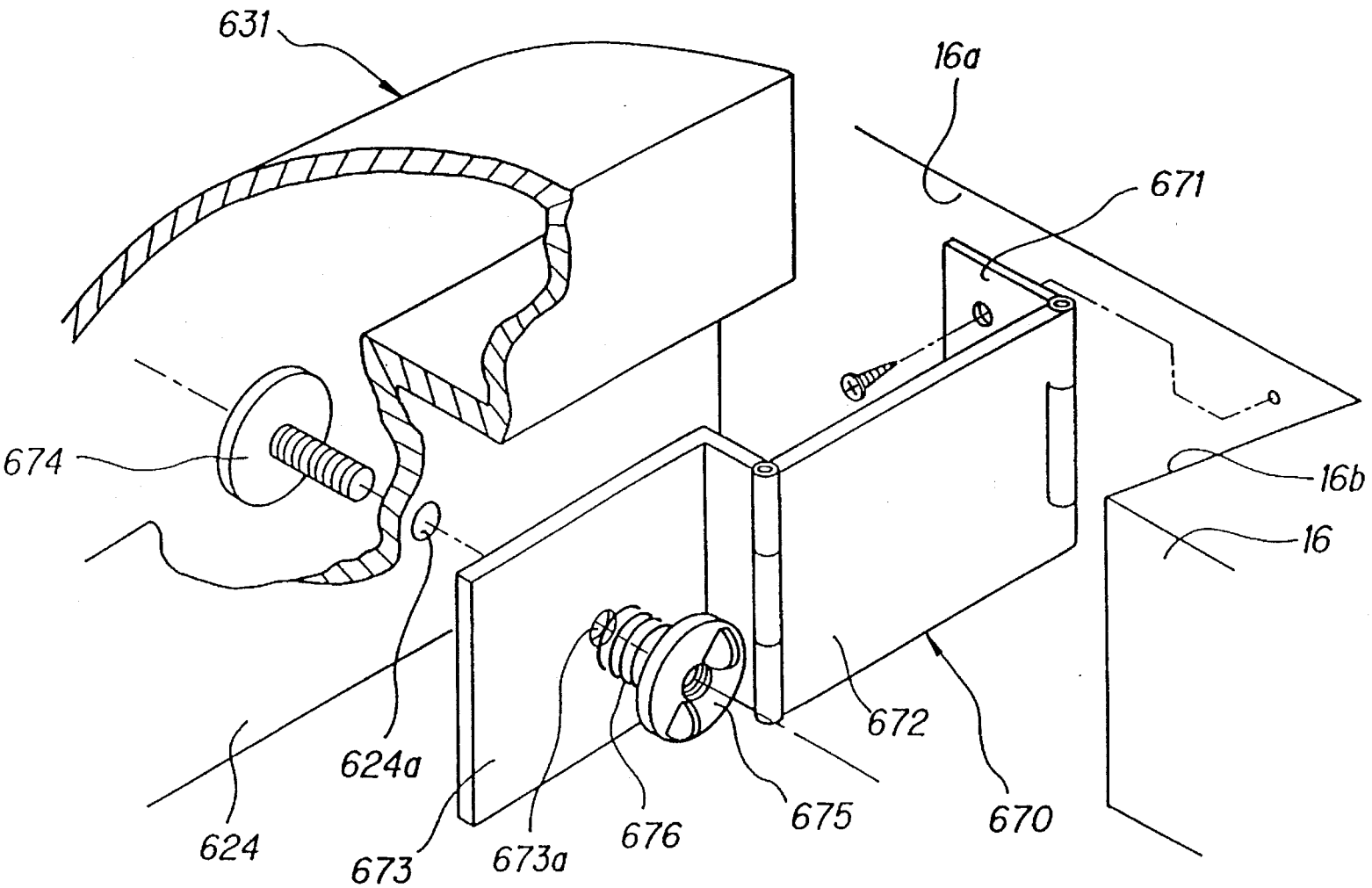
FIG. 81 is an exploded perspective view of the composition of the pivotal mechanism which supports the movable mechanism of the sixteen embodiment of this invention.

Said third link segment 673 is fixed to one end of said base plate 624 on the back of said movable half body 631 by means of a screw 674 and an adjusting nut 675. More specifically in FIG. 81, the screw 674 is inserted from the inside of the third link segment 673 into an under screw hole **624*a* formed in the base plate 624, and into a hole 673*a* formed in the third link segment 673 and engages with the adjusting nut 675. Thus the movable half body 631 is supported so that its angle may be adjusted as shown in FIG. 80 with an arrow "F" by loosening the screw 674. And the adjustment is done by rotating the movable half body 631 on the screw 674. As illustrated in FIG. 81, a spring 676 is provided between the third link segment 673 and the adjusting nut 675 and even if the movable half body 831 is loaded with excessive weight, the product is prevented from been broken because said excessive weight is absorbed by the spring 676** appropriately.

Figure 75:
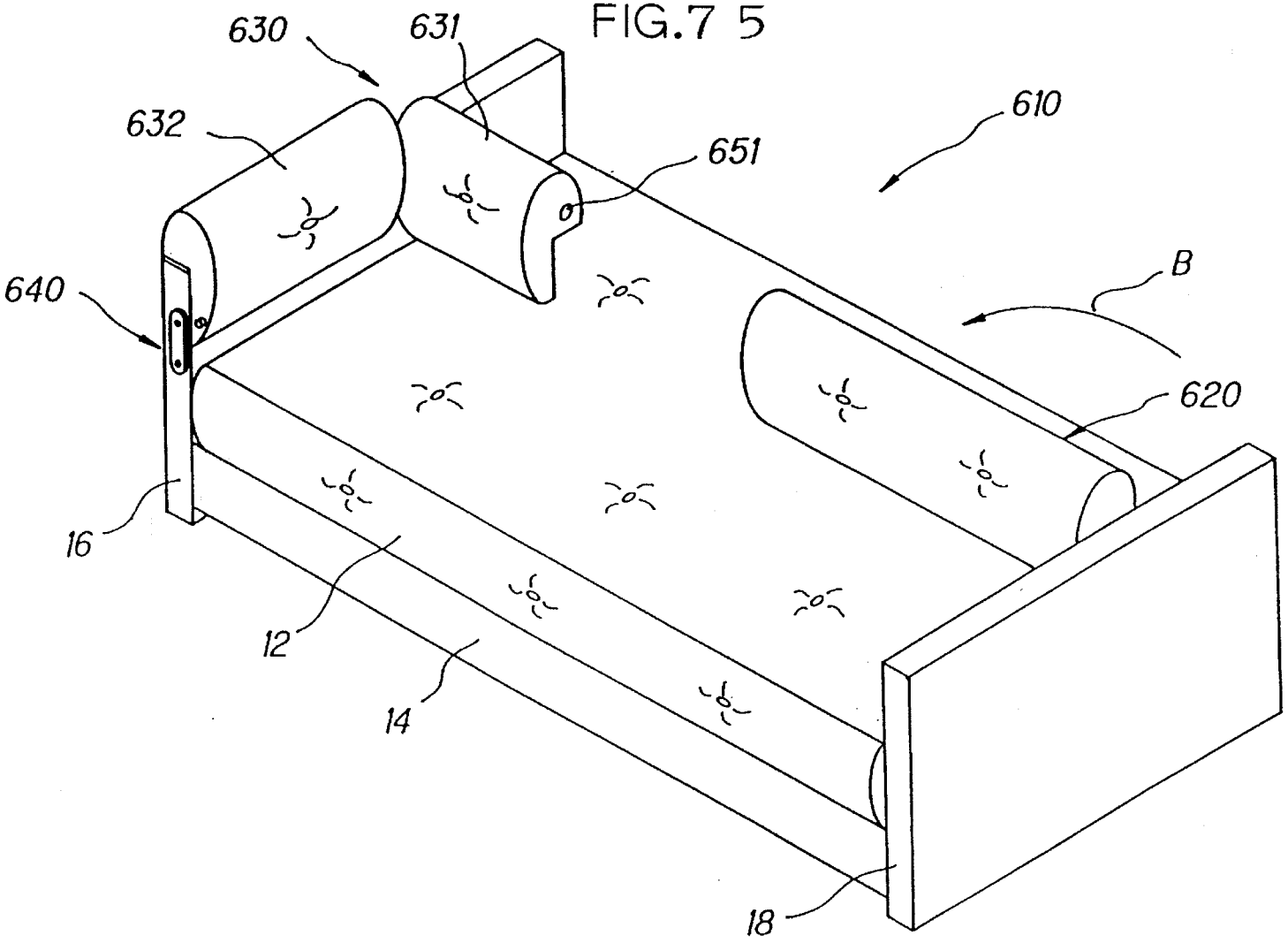
FIG. 75 is an operational diagram illustrating an intermediate state of the sixteenth embodiment of this invention in changing from a bed mode to a sofa mode.
Figure 82:
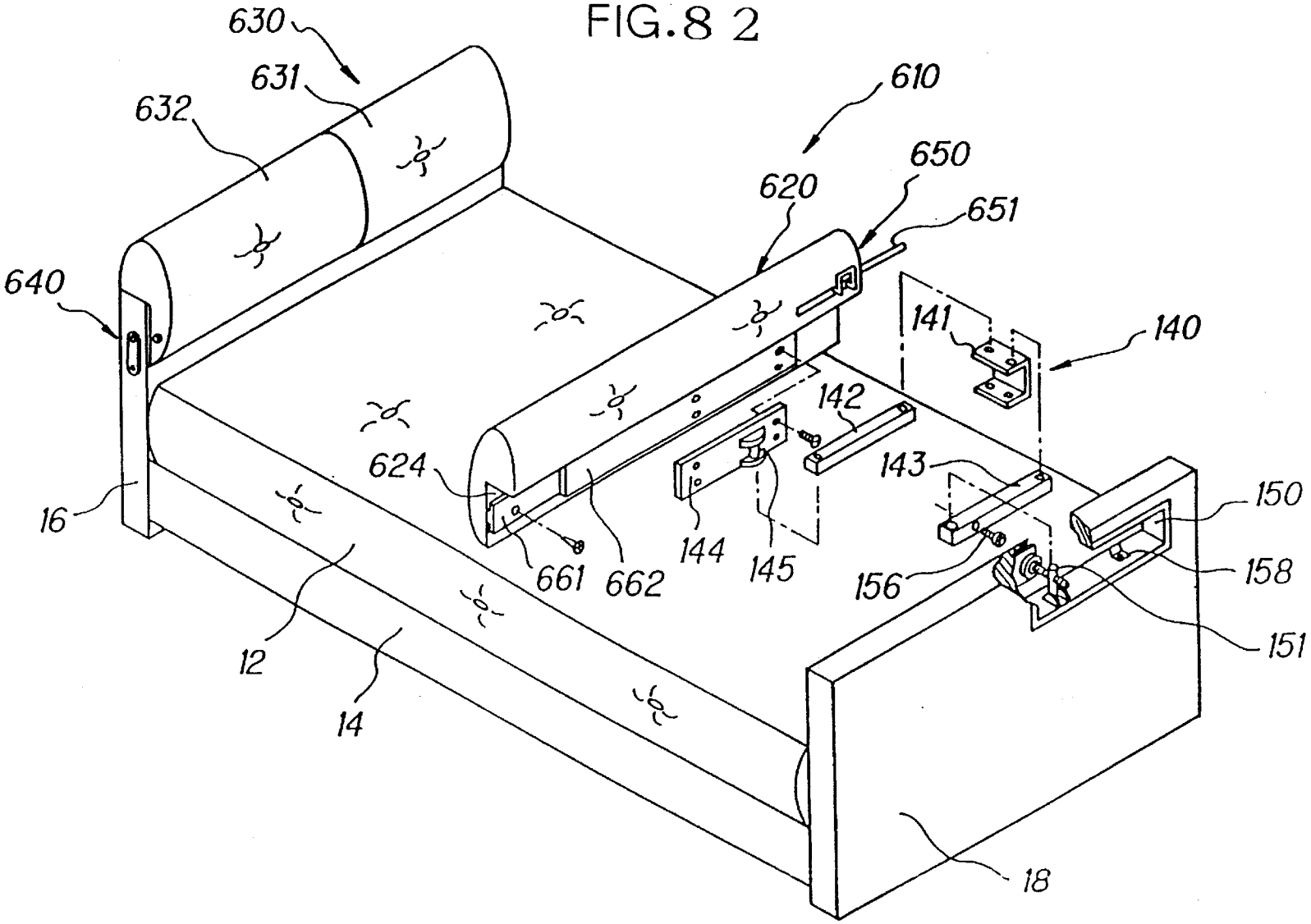
FIG. 82 is an exploded view in perspective of the movable mechanism of the sixteenth embodiment of this invention.

As shown in FIG. 82, said movable backrest 620 is supported to said foot board 18 through a movable mechanism 140 moveably between the first position (see FIG. 73) and the second position (see FIG. 75). The movable backrest 620 can be adjusted slightly in the vertical direction and in the front and back direction by this movable mechanism 140 in each position (especially in the second position) where it is supported. The movable mechanism 140 comprises the position controlling and break preventing mechanism which can absorb the excessive weight loaded on movable backrest 620. Since the movable mechanism 140 is identical to that of fourth embodiment, its repeated explanation will be omitted.

Figure 83:
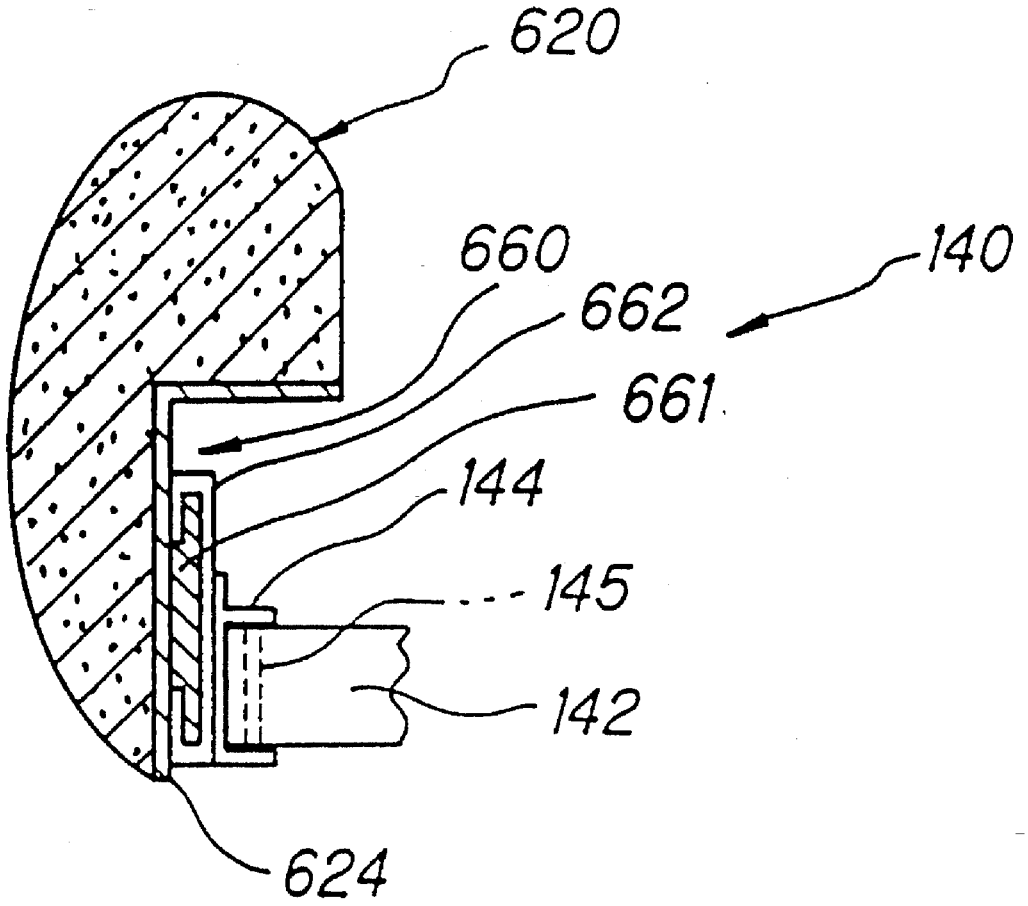
FIG. 83 is a sectional view illustrating an arm coupled to the movable half backrests of the sixteenth embodiment.

As shown in FIGS. 82 and 83, a mount bracket 144 is turnably mounted to one end of one arm 142 by a shaft 145 and is fastened to an outer rail 662 of rail unit 660 by screws. This rail unit 660 is provided for moving said movable backrest 620, in the direction indicated by an arrow "C" in FIG. 76, from the position shown in FIG. 75 to the second position close to said movable half body 631 and is coupled together with arms 142,143, etc. which are also members of said movable mechanism 140. As seen in FIG. 76, the shaft 145 of said base plate 624 is arranged to be inside of the side end of the movable backrest 620 when the movable backrest 620 is in the second position.

More particularly said rail unit 660, comprises an inner rail 661 extending in lateral direction of the plate 524 and fastened to said base plate 624 of movable backrest 620 and said outer rail 662 engaged with the inner rail 621 slidably in the lateral direction. As illustrated in FIGS. 82 and 83, the cross section of the inner rail 661 is formed like character "T" so as to engage with a groove of the outer rail 662.

As shown in FIG. 76, a bolt 652 is mounted to one end surface of said movable backrest 620 so as to slide and project in the lateral direction and is a part of a coupling mechanism 650. The coupling mechanism 650 couples and supports the movable backrest 620 and movable half body 631 which are in the second position. While a hole 651 into which the bolt is inserted is formed in one end surface of the movable half body 631. The bolt 652 and hole 651 of the coupling mechanism 650 are provided to prevent the movable backrest 620 and the movable half body 631 in the second position from being warped to the back side of them.

Action of above-mentioned sofa-bed 610 of the sixteenth embodiment will be described hereinafter.

In the case of the sofa-bed 610 of this embodiment, as shown in FIG. 73, since said backrest 630 and said movable backrest 620 are respectively located above and along said head board 16 or foot board 18 in the bed mode, they are not obstacles to the use of the bed.

Moreover the sofa-bed 610 has a practical use. For example, if the user read a book sitting up in the sofa bed, he can lean on said backrest 630 or said movable backrest 620. Furthermore the backrest 630 and the movable backrest 620 enhance a visual impression of the sofa-bed or impress a man who looks the sofa-bed as a luxurious bed.

Figure 74:
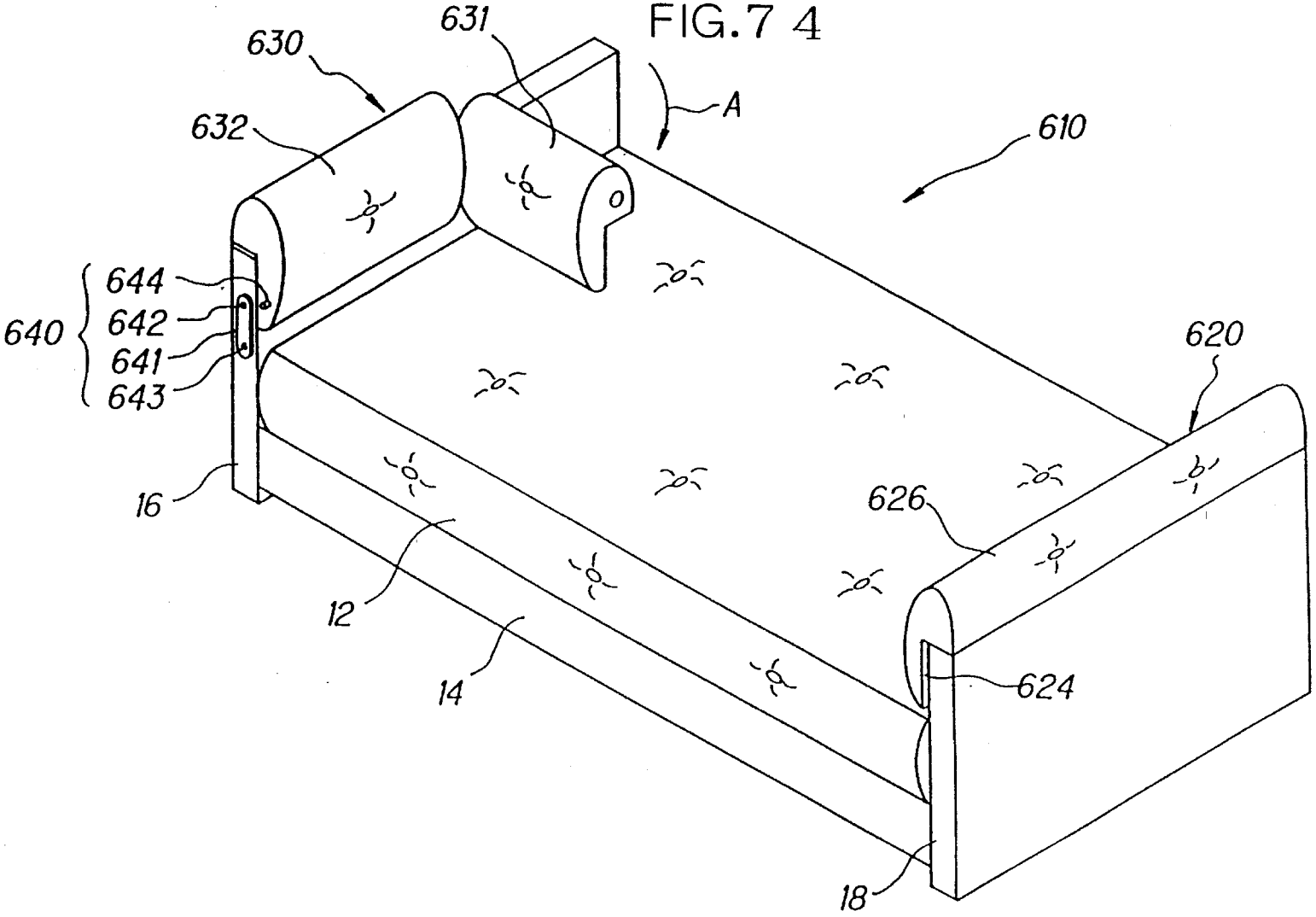
FIG. 74 is an operational diagram illustrating an intermediate state of the sixteenth embodiment of this invention in changing from a bed mode to a sofa mode.

If the user wants to change the mode of said sofa-bed 610 from the bed mode shown in FIG. 73 to the sofa mode shown in FIG. 76, he needs to move said movable half body 631 of the backrest 630 from the first position (see FIG. 73) along said head board 16 to the second position approximately parallel to the center line extending in the longitudinal direction of said panel 14 by moving in the direction indicated with an arrow "A" in FIG. 74. Said fixed half body 632 may be held in tilted state by said lift mechanism 640 before or after the above described step.

In the next step, the user may move said movable backrest 620 from the first position (see FIG. 74) along said foot board 18 to the second position approximately parallel in the center line extending to the longitudinal direction of said panel 14 where the backrest 620 is close to said movable half body 631 of said backrest 630 in the above mentioned second position and extends together in longitudinal direction (see FIG. 76).

To move said movable backrest 620 to said second position, first of all the user may push the movable backrest 620 in the direction indicated by an arrow "B" as shown in FIG. 75. Then as shown in FIG. 82, the movable backrest 620 and one arm 142 of said movable mechanism 140 are coupled together turnably and the arm 142 and the other arm 143 which is coupled to said head board 16 turnably through the position controlling and break preventing mechanism are coupled together turnably in the horizontal direction through a hinge bracket 141, so that the user can move the movable backrest 620 with his hand easily by himself. Then as shown in FIG. 76, the user may move, by sliding said rail unit 660 in the direction indicated by an arrow "C", the movable backrest 620 to the second position where it aligned with said movable half body 631 in longitudinal direction.

As shown in the above description, although said two arms 142,143 of the movable mechanism 140 (see FIG. 27) are nearly aligned in a straight line in the case that the movable backrest 620 moved in the second position is not in desired position on account of unevenness of accuracy of woodwork, the position (angle) of arm 143 can be adjusted continuously by exactly tuning the position (angle) of arm 143 in the vertical direction as indicated by phantom line in FIG. 28 or in front and backward direction by rotating optionally an adjusting nut 155 and a stopper 156 forming the position controlling and break preventing mechanism of the movable mechanism 140. And as shown in FIG. 80, if necessary, the supporting angle of said movable half body 631 being in the second position is adjustable in the direction indicated by an arrow "F".

Thus the appropriate position adjustment for said bolt 531, a part of said coupling mechanism 550 provided to one end surface of said movable backrest 620, to just engage with said hole 651 formed on one end surface of said movable half body 631 could be achieved, and the movable half body 631 and the movable backrest 620 respectively being in the second position are prevented from being warped backwardly by said coupling mechanism.

In sofa mode illustrated in FIG. 76, eve if said movable backrest 620 is loaded with excessive weight, the product is prevented from been broken because said excessive weight is appropriately absorbed by the spring 154 of the position control and break prevent mechanism of the movable mechanism 140.

In such a sofa mode, the user can sit comfortably on said sofa-bed 610 as lying in a couch, by using said fixed half body 632 of said backrest 630 along said head board 16 as a backrest and using said movable half body 631 of said backrest 630 in the second position as an armrest. The movable half body 631 of the backrest 630 and the movable backrest 620 respectively held in their second positions may be used as the backrest.

To change said movable backrest 620 and said movable half body 631, held in their second position, from the sofa mode to the bed mode, the user may reverse the operation described previously. The sofa-bed looks nice by covering the portions of each arm 142,143 and said rail unit 660 that are not hidden by said backrest 630 and said movable backrest 620.

Figure 84:
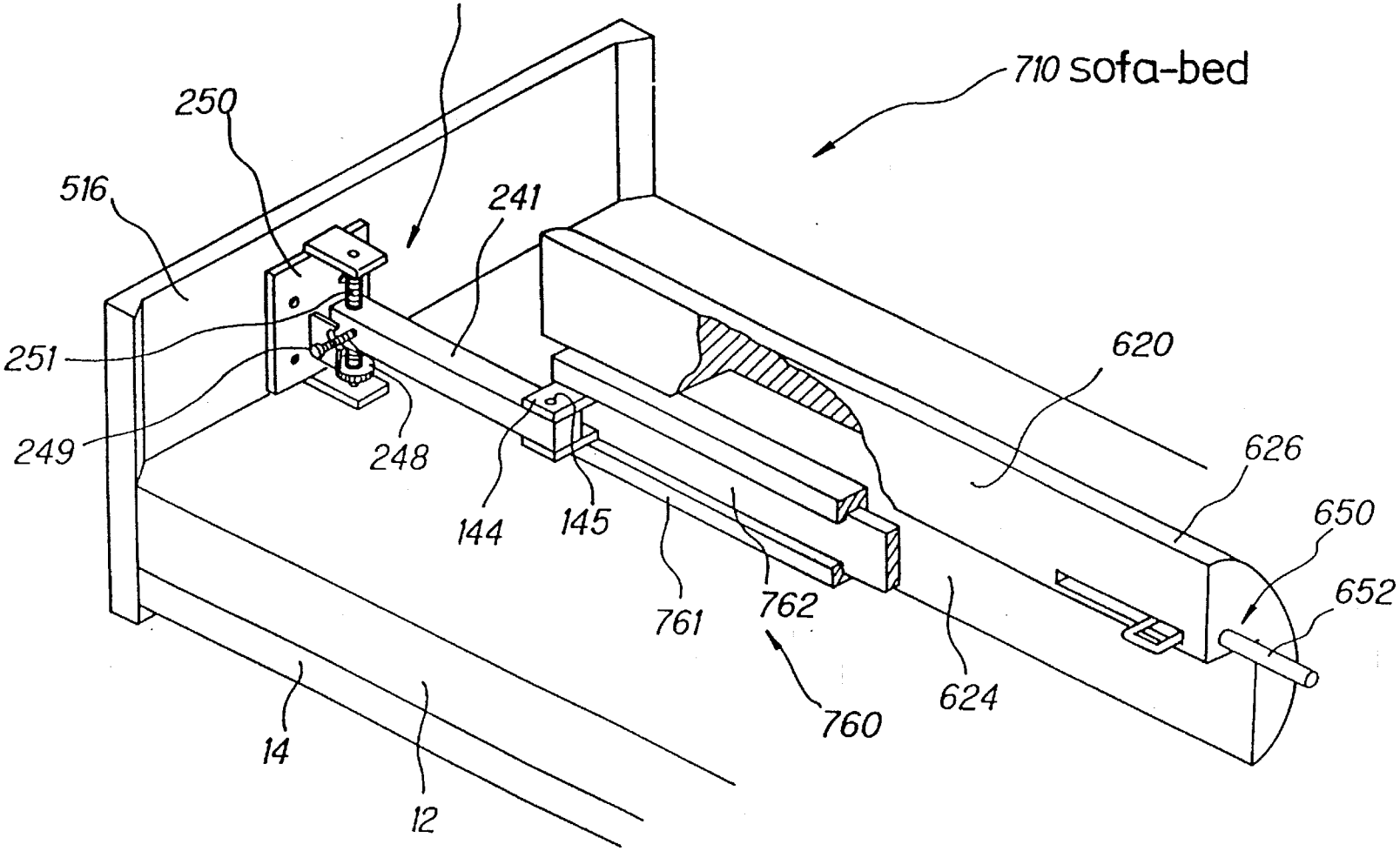
FIG. 84 is a perspective view showing a movable mechanism of seventeenth embodiment of the sofa-bed of the present invention seeing from the rear side of the sofa-bed in a sofa mode, a part of the movable half backrest being broken away for clearness.
Figure 85:
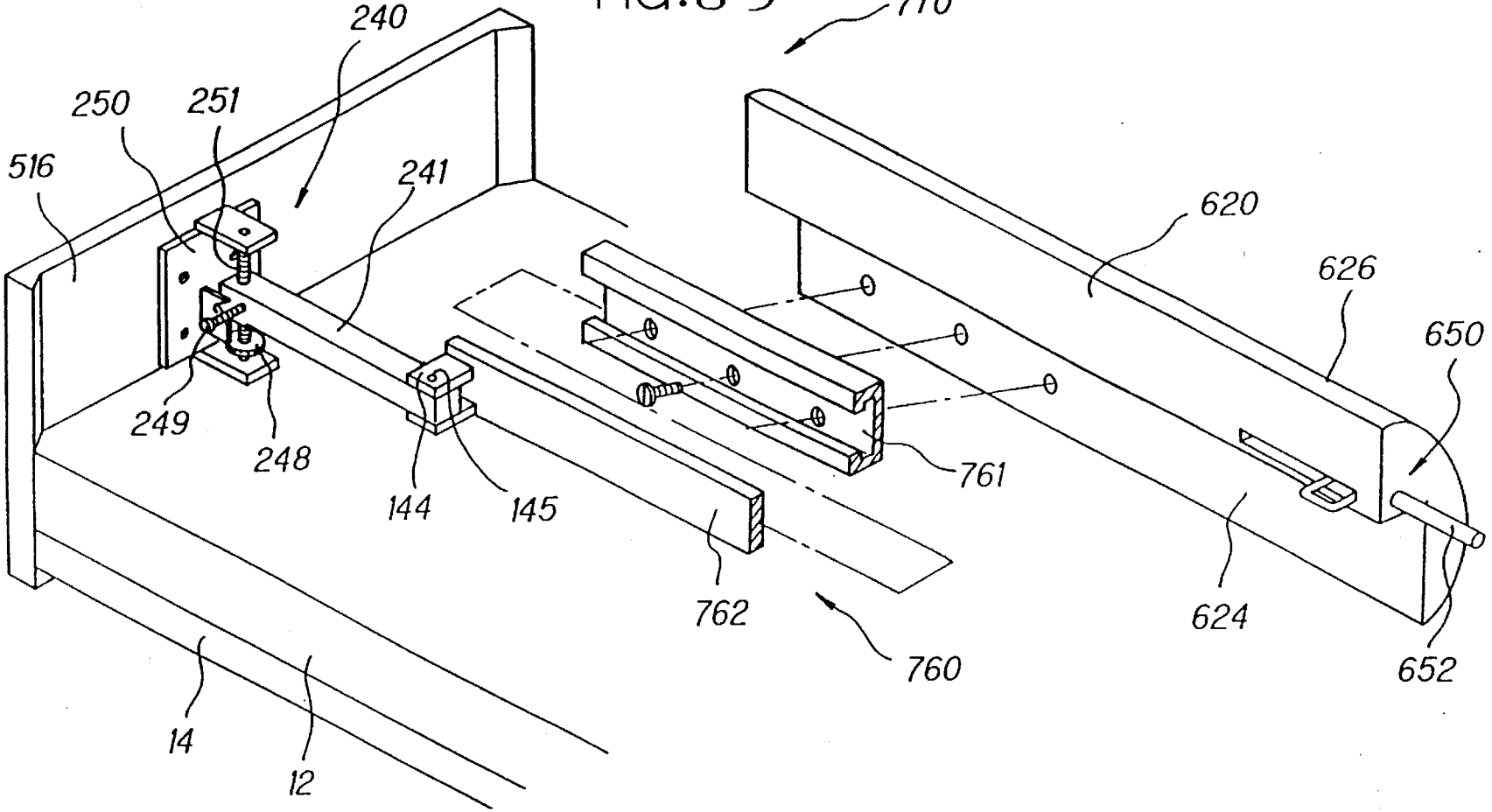
FIG. 85 is an exploded perspective view showing the movable mechanism of seventeenth embodiment of the sofa-bed of the present invention seeing from the rear side of the sofa-bed in a sofa mode, a part of the movable half backrest being broken away for clearness.
Figure 86:
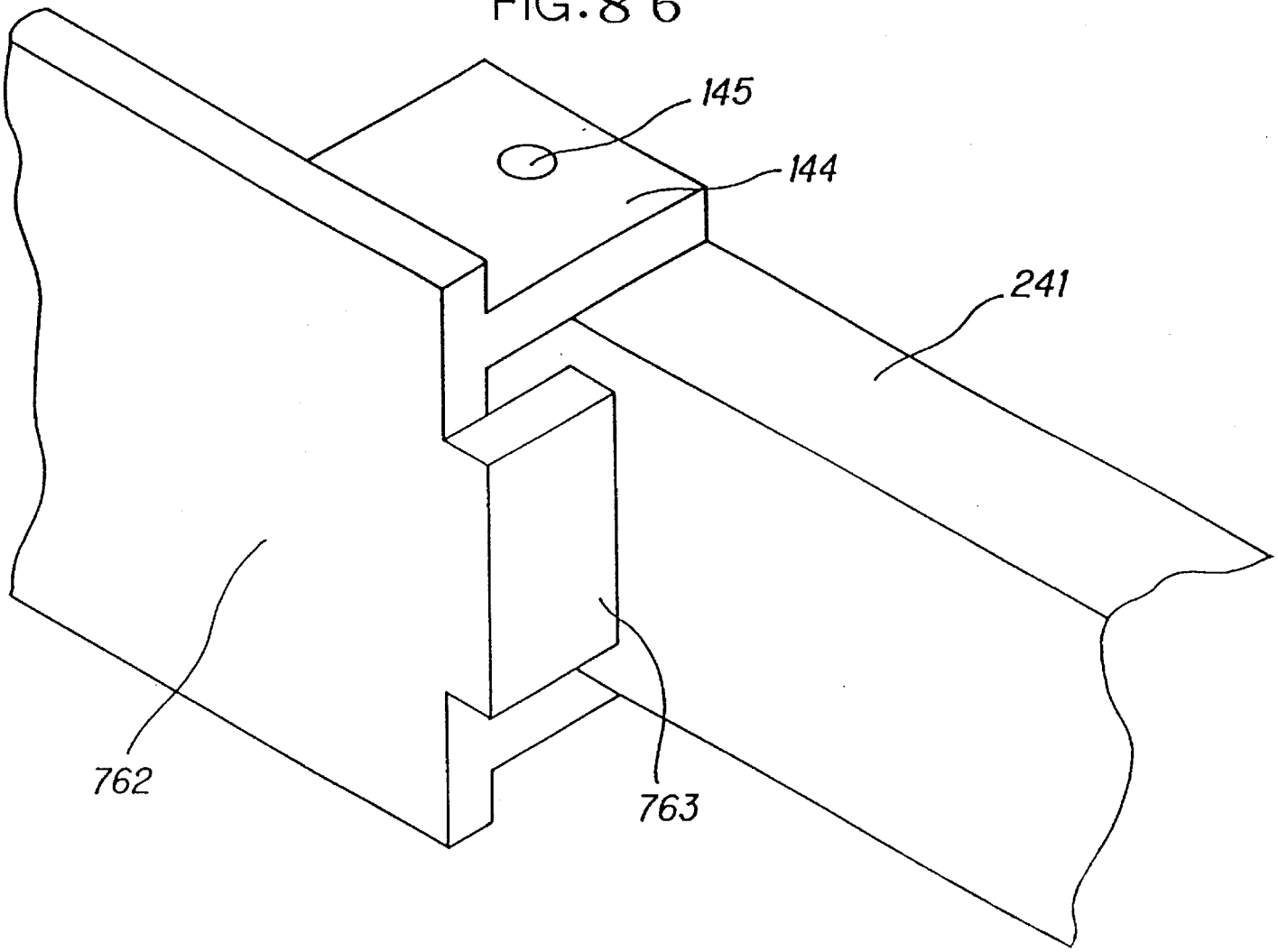
FIG. 86 is an enlarged perspective view showing an inner rail, composition of the movable mechanism of the seventeenth embodiment.

Referring to FIGS. 84–86, there are illustrated a seventeenth embodiment of a sofa-bed 710 of the present invention. The members and portions which are identical to those of sixteenth embodiment are given like reference characters and their repeated explanation will be omitted.

Both in a bed mode and a sofa mode, although an outward appearance of this embodiment of the sofa-bed 710 and the movable mechanism 240 having the position controlling and break preventing mechanism are appropriately similar to those of the sixteenth embodiment, the constructions of said movable mechanism 240 and of its position controlling and break preventing mechanism are different from those of the sixteenth embodiment.

As shown in FIG. 84, a movable backrest 620 is supported on a head board 516 via a movable mechanism 240 moveably between the first position and the second position. The movable mechanism 240 is equipped with a metal arm 241. The top end portion of this arm 241 is coupled turnably to a rail unit 760, described hereinafter, mounted on a base board 624 of the movable backrest 620 via a shaft 145. A base end portion of the arm 241 is coupled turnably in the horizontal direction to a shaft 251 which is pivotably supported almost perpendicularly to a mount bracket 250 of the head board 516. Since the movable mechanism 240 is similar to that of the fifth embodiment, its repeated explanation will be omitted.

As shown in FIG. 85, a mount bracket 144 which is turnably coupled to one end of said arm 241 by said shaft 145 is integrated to one end of inner rail 762 composing said rail unit 760. This rail unit 760 is provided for moving said movable backrest 620, in the direction indicated by an arrow "C" in FIG. 76, from the position shown in FIG. 75 to the second position close to said movable half body 631 and is coupled together with arms 142,143, etc. which are also members of said movable mechanism 240.

Referring more particularly to said rail unit 760, it comprises an outer rail 761 extending in lateral direction of the base plate 624 and fastened to the base plate 624 of movable backrest 620 and said inner rail 662 engaged with the outer rail 621 slidably in the lateral direction. As illustrated in FIG. 85, the outer rail 761 is formed with a groove with which the inner rail 762 is engaged. And as illustrated in FIG. 86, a stopper 763 which touches the side wall portion of said arm 241 is formed in one end portion of the inner rail 762.

In the seventeenth embodiment 710 above described, the mode of the sofa-bed can be changed from the bed mode to the sofa mode or reverse by a similar operation done in the case of the sofa-bed of the sixteenth embodiment.

Thus the arm 241 is positioned to be almost perpendicular to the head board 516, as illustrated in FIG. 84, when said movable backrest 620 moves to the second position. Even if the movable backrest 620 in the second position is tilted on account of unevenness of accuracy of woodwork, the inclination of the movable backrest 620 can be adjusted because the arm 241 is adapted to be rocked in some degree vertically on the supporting shaft 251 inserted into an oval hollow portion 242.

The position adjustment of the arm 241 or the adjustment of the movable backrest 620 in the vertical or the front and back direction can be done by turning the adjusting nut 248 or the stopper 249, of the position controlling and break preventing mechanism of said movable mechanism, in an optional direction. Furthermore in the sofa mode (see FIG. 73), even if the movable backrest 620 is loaded with excessive weight, the product is prevented from been broken because the springs 247,247 (see FIG. 33) of the position controlling and break preventing mechanism absorb said excessive weight appropriately. Then as shown in FIG. 33, the arm 241 tilted by excessive load temporarily is returned to the horizontal position immediately by a position returning member 244 engaged with a hollow portion 243 by the restoring force of the spring 247.

Figure 87:
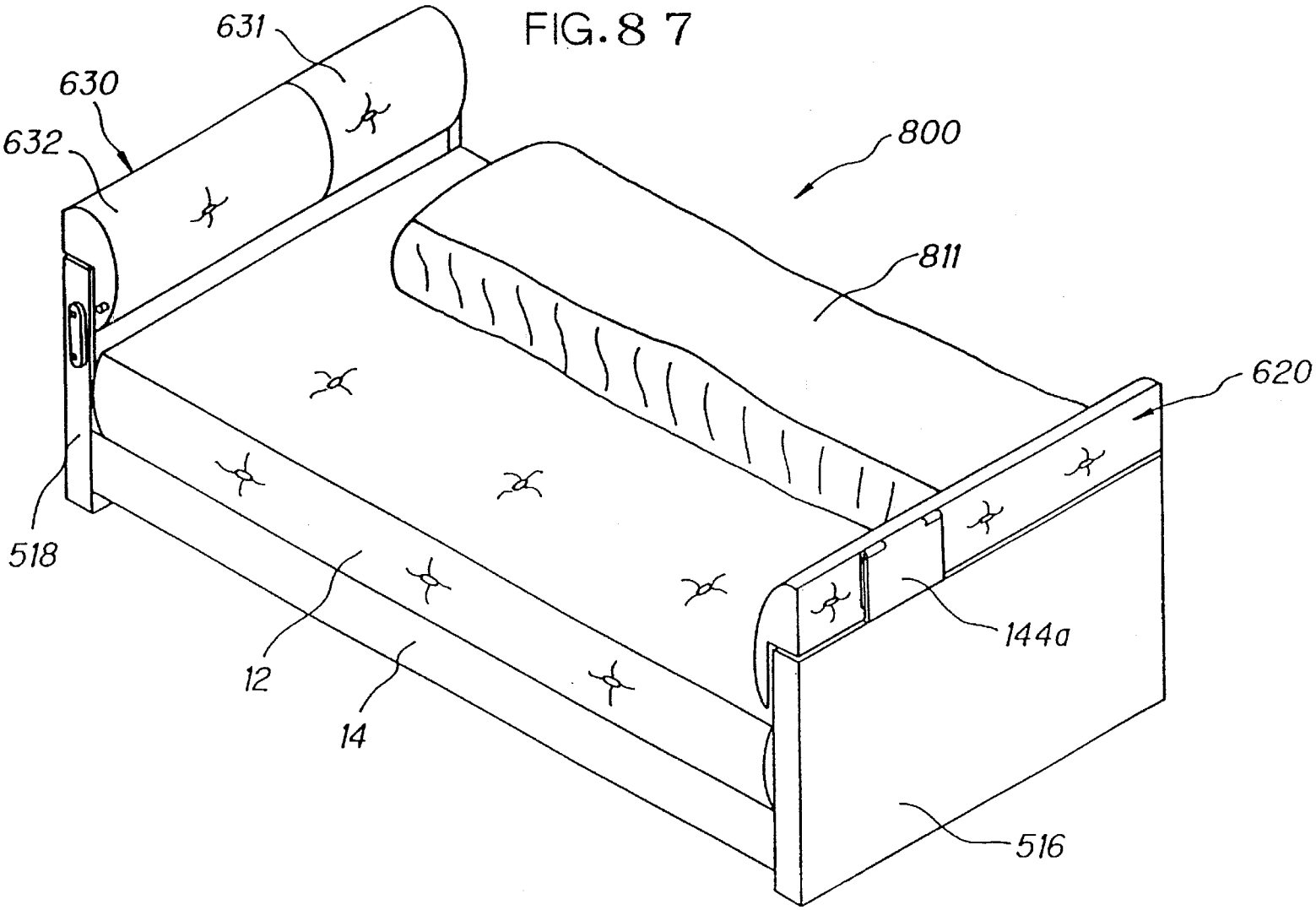
FIG. 87 is a perspective view illustrating a eighteenth embodiment of a sofa-bed of the present invention being in a bed mode, and a state which bedding on the mattress being folded in half along its longitudinal direction.
Figure 88:
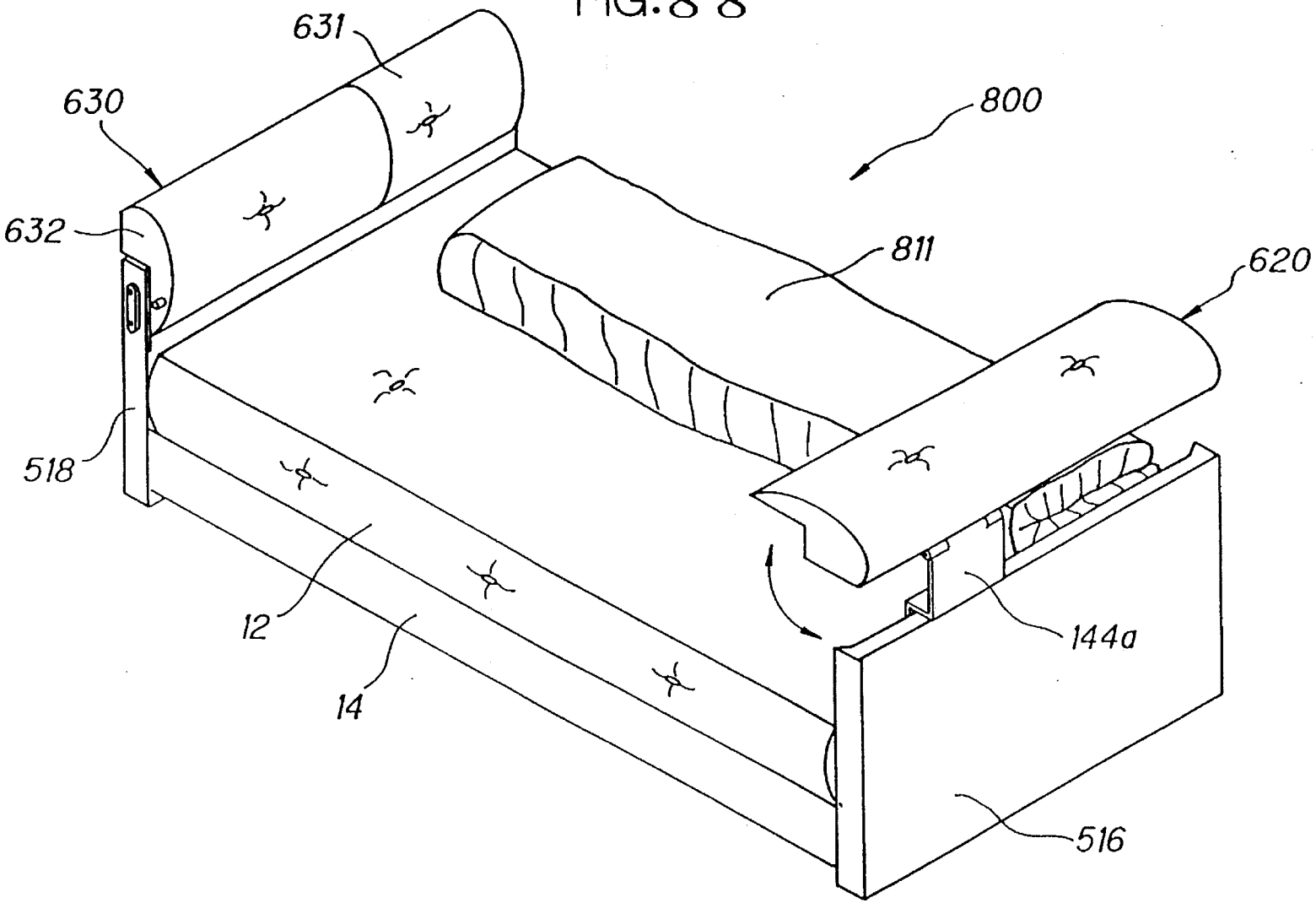
FIG. 88 is a perspective view illustrating a state of a movable backrest of the eighteenth embodiment substantially being positioned above the first position.
Figure 89:
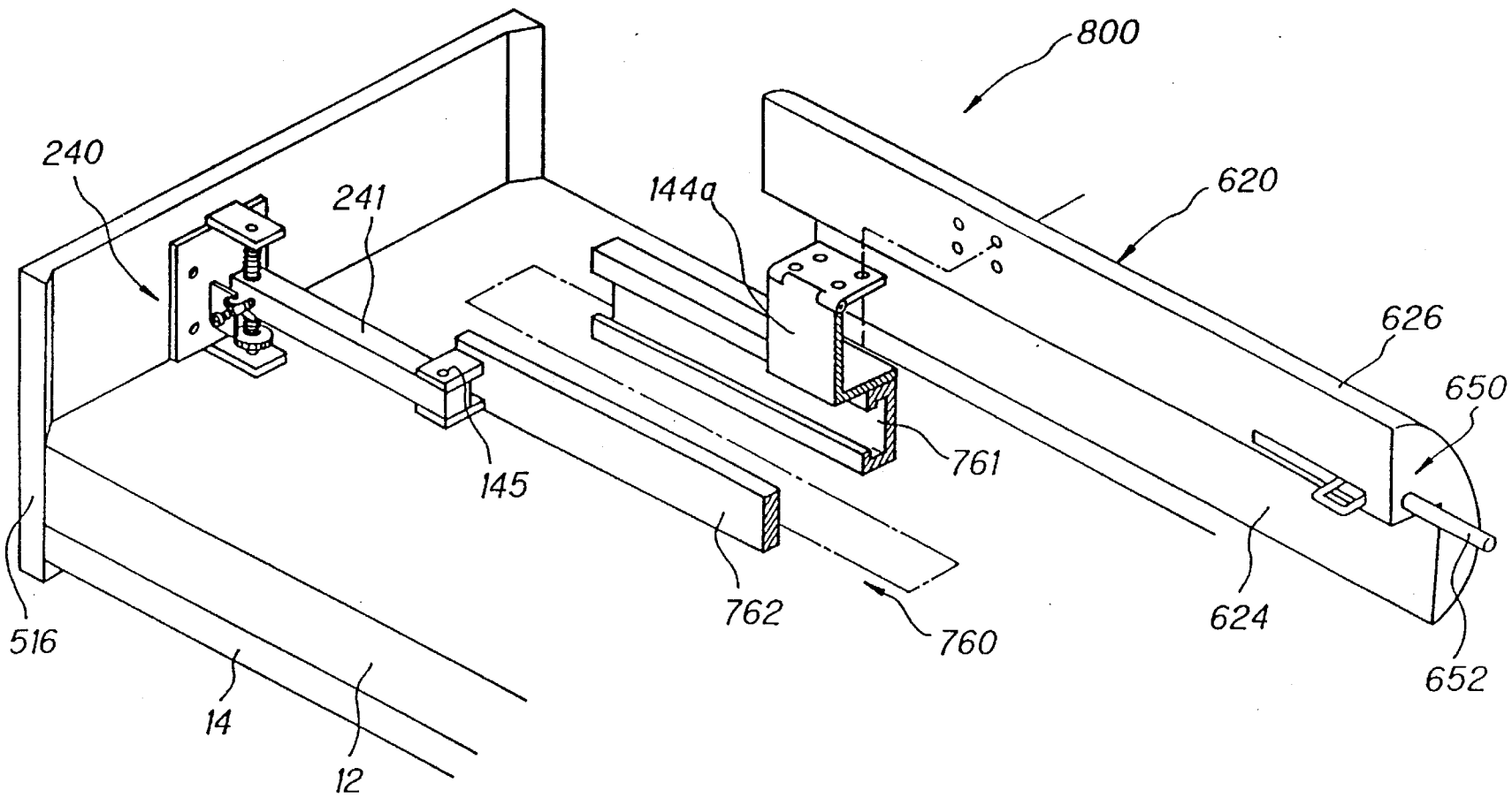
FIG. 89 is a perspective view illustrating a movable mechanism and a hinge bracket of the eighteenth embodiment.

Referring to FIGS. 87–89, there are illustrated an eighteenth embodiment of a sofa-bed 800 of the present invention. The members and portions which are identical to those of seventeenth embodiment are given like reference characters and their repeated explanation will be omitted.

Both in a bed mode and a sofa mode, although an outward appearance of this embodiment of the sofa-bed 800 and the movable mechanism 240 are appropriately similar to those of the seventeenth embodiment with the exception that the movable backrest 620 is moveably coupled to the movable mechanism 240 on a substantially upper position than the first and second position.

As shown in FIG. 89, a rail unit 760 is coupled to the top end of an arm 241 of a movable mechanism 240 turnably in the horizontal direction, and the back of said movable backrest 620 is mounted to an outer rail of the rail unit 760 through a hinge bracket 144*a*.

This hinge bracket 144*a* is provided for the movable backrest 620 to move from the first position (or the second position), as shown in FIG. 87, to a higher position than the first (or the second) position as shown in FIG. 88.

Action of above-mentioned sofa-bed 800 of the eighteenth embodiment of the present invention will described hereinafter.

As shown in FIG. 87, if the user wants to change the sofa-bed 800 from a bed mode to a sofa mode, he needs to fold the bedding 811, on a mattress 12, in half along the longitudinal direction of the sofa bed. Then, as shown in FIG. 88, he needs to move said movable backrest 620 from the first position to the higher position than the first by means of said hinge bracket 144*a*.

In this state (see FIG. 88), even if the user moves said movable backrest 620 from the first position side to the second position side with said movable mechanism 240 in the horizontal direction, the backrest 620 does not touch said folded bedding 811 located under the backrest 620. Therefore when the user moves the sofa-bed 800 from the position in the bed mode to the position in the sofa mode, the bedding 811 on the mattress 12 is not to be an obstacle and he may move the backrest 620 easily from the first position to the second position.

In the sofa-bed of this embodiment, since each movable half backrest (or movable half board) is substantially located above a head board or a foot board in the bed mode, they are not obstacles. Moreover the sofa-bed has a practical use. For example, if the user reads a book sitting up in the sofa bed, he can lean on said backrest or said movable backrest.

Furthermore in the case that cushions are provided to the movable half backrest (or the movable half board), a visual impression of the sofa-bed is improved or the sofa-bed impresses a man who looks the sofa-bed as a luxurious bed. And in the case that the sofa-bed equipped with a means for coupling together movable half backrests located in the second positions, the movable half backrests can be coupled together in longitudinal direction and can support the user's weight etc. Sine bedding can be put away behind movable half backrests, the sofa-bed is convenient.

Moreover in the case that the sofa-bed is equipped with a movable mechanism, changing between the bed mode and the sofa mode can be done easily. And in the case that the movable mechanism is equipped with a position controlling and break preventing mechanism, the problem of the uneven accuracy of woodwork of the sofa-bed after assembled can be resolved by adjusting the position of the movable half backrest or the movable half board at least either in the vertical direction or in the front and back direction. Furthermore even if excessive weight is loaded on the movable half backrest or the movable half board, the product is prevented from been broken by absorbing the excessive weight.

From another point of view of the present invention, since each movable half backrest (or movable half board) is put away in the first position along a head board or a foot board in the bed mode, they are not to be obstacles. Moreover the movable half backrests are located on only one end of the bed so that the dead space on the mattress 12 is decreased and a larger lying space is gained. And the sofa-bed has a practical use, for example, if the user reads a book sitting up in the sofa bed, he can lean on said backrest or said movable backrest.

In the case that the sofa-bed is equipped with a movable mechanism which supports each movable half backrest on head board moveably between the first position and the intermediate position and with a coupling mechanism which couples one of the movable backrests to the other moveably between the intermediate position and the second position, changing between the bed mode and the sofa mode can be done easily.

From another point of view of the present invention, in the sofa mode, the user can sit comfortably on a sofa-bed as lying in a couch, by using a fixed half body of a backrest along a head board as a backrest and using a movable half body of a movable backrest in the second position as an armrest. The movable half body of the backrest and the movable backrest respectively held in their second positions may be used as a backrest.

Moreover in the case that the sofa-bed is equipped with a movable mechanism for supporting the movable backrest moveably between the first position and the second position, the changing between bed mode and sofa mode can be done easily. And in the case that the movable mechanism equipped with a position controlling and break preventing mechanism, the problem of the uneven accuracy of woodwork of the sofa-bed after assembled can be resolved by adjusting the position of the movable backrest at least in the vertical direction or in the front and back or in the lateral direction, furthermore even if excessive weight is loaded on the movable backrest, the product is prevented from been broken by the excessive weight.

What is claimed is:

1. A sofa-bed comprising:

a panel for supporting a mattress;

a pair of boards provided in a pair of vertical planes and connected to opposite ends of said panel for supporting said panel in a horizontal plane;

a pair of movable half backrests movable between a first position substantially above said boards in a bed mode and a second position where said half backrests are disposed in a direction substantially parallel to a longitudinal direction of said sofa-bed in a sofa mode; and moving means connected between said boards and said half backrests and including an electrical apparatus for moving said movable half backrests between said first and second positions.

2. A sofa-bed according to claim 1, which further comprises a pair of cushions provided on said movable half backrests and having a surface slanted to support the users comfortably in said sofa mode.

3. A sofa-bed comprising:

a panel for supporting a mattress;

a pair of boards provided in a pair of vertical planes and connected to opposite ends of said panel for supporting said panel in a horizontal plane;

a pair of movable half backrests movable between a first position substantially above said boards in a bed mode and a second position where said half backrests are disposed in a direction substantially parallel to a longitudinal direction of said sofa-bed in a sofa mode; and moving means connected between said boards and said half backrests and including a pair of movable mechanisms for supporting said movable half backrests on said boards at said first position in said bed mode and at said second position in said sofa mode, wherein said movable mechanisms comprises:

adjusting means for adjusting said movable half backrests supported in said second position at least either in a vertical direction or in a front and back-ward direction and a position controlling and break preventing mechanism which prevents breakage of said sofa-bed when excessive weight is loaded on said movable half backrests.

4. A sofa-bed according to claim 3, in which said moving means further comprises bracket means for supporting said movable half backrests at a position higher than said first and second positions.

5. A sofa-bed comprising:

a panel;

a pair of boards connected to opposite ends of said panel for supporting said panel in a horizontal plane;

a pair of movable half backrests; and moving means connected between said boards and said half backrests for moving said half backrests among a first position where said half backrests are closely piled up one upon another on one of said boards in a bed mode, a second position where said half backrests are arranged in line between said boards in a sofa mode, and an intermediate position where said closely piled up half backrests are substantially parallel to a longitudinal center line of said panel.

6. A sofa-bed according to claim 5, wherein said moving means comprises a movable mechanism which movably supports said movable half backrests between said first and second positions, keeping their closely piled up state.

7. A sofa-bed according to claim 6, wherein said movable mechanism comprises:

adjusting means for adjusting one of said movable half backrests which is directly supported by said movable mechanism at least either in a vertical direction or in a front and back-ward direction, and a position controlling and break preventing mechanism which prevents breakage of said sofa-bed when excessive weight is loaded on said movable half backrests by absorbing the excessive weight.

8. A sofa-bed according to claim 6, wherein each movable half backrest is coupled to said movable mechanism so that the movable half backrests may move from said first position to a position substantially toward said intermediate position with their closely piled up state being kept.

9. A sofa-bed according to claim 5, which further comprises a coupling mechanism for coupling said movable half backrests together so as to move one of them between said intermediate position and said second position.

10. A sofa-bed according to claim 9, wherein said coupling mechanism comprises a hinge for coupling an end portion of one of said movable half backrests to an end portion of the other half backrest so that said movable half backrests may be closely piled up one upon another.

11. A sofa-bed according to claim 9, wherein said coupling mechanism comprises a lower rail mounted on one of said movable half backrests along a longitudinal direction thereof and an upper rail mounted on the other movable half backrest along its longitudinal direction and engaged with said lower rail for sliding along said lower rail.

12. A sofa-bed according to claim 9, which further comprises a lock mechanism for holding said movable backrests in one of the first position and the second position.

13. A sofa-bed changeable between a bed mode and a sofa mode comprising:

a) a panel;

b) a pair of boards connected to both ends of said panel for supporting it in a horizontal plane;

c) a movable backrest also serving as an armrest mounted on one of said boards; and d) a backrest mounted on the other board and divided into a fixed half body and a movable half body which is movable between a first position along said other board and a second position substantially parallel to a longitudinal direction of said panel, and said movable backrest being movable between a first position along said one of boards and a second position which is close to said movable half body of said backrest located in said second position and extends in said longitudinal direction, and in said bed mode, said movable half body of said backrest being held in said its first position and said movable backrest being held in said first position and, in said sofa mode, said movable half body of said backrest being held in said second position and said movable backrest being held in said second position.

14. A sofa-bed comprising:

a panel for supporting a mattress;

a pair of boards provided in a pair of vertical planes and connected to opposite ends of said panel for supporting said panel in a horizontal plane;

a pair of movable half backrests movable between a first position substantially above said boards in a bed mode and a second position where said half backrests are disposed in a direction substantially parallel to a longitudinal direction of said sofa-bed in a sofa mode; and moving means connected between said boards and said half backrests and including a pair of movable mechanisms for supporting said movable half backrests on said boards at said first position in said bed mode and at said second position in said sofa mode;

said movable mechanisms including adjusting means for adjusting said movable backrests at least either in a vertical direction or in a front and back-ward direction or in its longitudinal direction and a position controlling and break preventing mechanism which prevents breakage of said sofa-bed when excessive weight is loaded on said movable backrest by absorbing the load.

15. A sofa-bed as in claim 14, which further comprises a coupling mechanism for coupling, in said sofa mode, said movable half body of said backrest held in said second position to said movable backrest held in said second position.

16. A sofa-bed according to claim 14, which further comprises adjusting means for adjusting an inclination angle of said fixed half body of said backrest along said board.

17. A sofa-bed as in claim 14, in which said movable backrest is coupled to said movable mechanism moveably from said first position and said second position to a position substantially above them.

* * * * *